US011746555B2

(12) United States Patent
Johnson et al.

(10) Patent No.: US 11,746,555 B2
(45) Date of Patent: Sep. 5, 2023

(54) RAPIDLY DEPLOYABLE MODULAR SHELTER SYSTEM

(71) Applicant: WEATHERHAVEN GLOBAL RESOURCES LTD., Coquitlam (CA)

(72) Inventors: Brian D. Johnson, Mill Bay (CA); Ryan Douglas Savenkoff, Vancouver (CA); Matt Christensen, Vancouver (CA); Jean-Marc Bennett, Surrey (CA)

(73) Assignee: Weatherhaven Global Resources Ltd., Coquitlam (CA)

( * ) Notice: Subject to any disclaimer, the term of this patent is extended or adjusted under 35 U.S.C. 154(b) by 197 days.

(21) Appl. No.: 17/397,900

(22) Filed: Aug. 9, 2021

(65) Prior Publication Data

US 2021/0363776 A1 Nov. 25, 2021

Related U.S. Application Data

(63) Continuation-in-part of application No. 17/023,279, filed on Sep. 16, 2020, now Pat. No. 11,377,868, (Continued)

(51) Int. Cl.

| | |
|---|---|
| ***E04H 15/46*** | (2006.01) |
| ***E04H 15/52*** | (2006.01) |
| *E04H 15/58* | (2006.01) |

(52) U.S. Cl.

CPC ..... *E04H 15/46* (2013.01); *E04H 15/52* (2013.01); *E04H 15/58* (2013.01)

(58) Field of Classification Search

CPC ..... E04H 15/46; E04H 15/52; E04H 15/58

See application file for complete search history.

(56) References Cited

U.S. PATENT DOCUMENTS

| | | | |
|---|---|---|---|
| 1,170,188 | A | 2/1916 | Rassmussen et al. |
| 2,771,896 | A | 11/1956 | Call |

(Continued)

FOREIGN PATENT DOCUMENTS

| | | | |
|---|---|---|---|
| CA | 1287725 | A | 8/1991 |
| CN | 201169955 | Y | 12/2008 |

(Continued)

OTHER PUBLICATIONS

International Search Report dated Oct. 25, 2019 issued on PCT/CA2019/050237.

*Primary Examiner* — Noah Chandler Hawk

(74) *Attorney, Agent, or Firm* — Oyen Wiggs Green & Mutala LLP

(57) ABSTRACT

A purlin connection assembly including a purlin, a frame segment and a spring. The purlin has a protrusion that is receivable in a first end of a slot of the frame segment. The purlin is slidable to a smaller second end of the frame segment. Locking engagement is achieved in a direction parallel to the frame segment by a pair of push buttons projecting from the frame segment that flank the purlin when in the second end, and in a direction perpendicular to the frame segment by constraining of a flared head of the protrusion in an interior of the frame segment when in the second end. The push buttons are part of a spring compressingly disposed in the interior of the frame segment, wherein the first button and the second button are biased to extend outwardly through button holes of the frame segment.

7 Claims, 73 Drawing Sheets

Related U.S. Application Data which is a continuation of application No. 16/287,539, filed on Feb. 27, 2019, now Pat. No. 10,794,080, which is a continuation-in-part of application No. 16/072,124, filed as application No. PCT/CA2017/050071 on Jan. 25, 2017, now Pat. No. 10,392,828.

(60) Provisional application No. 62/287,313, filed on Jan. 26, 2016.

(56) References Cited

U.S. PATENT DOCUMENTS

| | | | | |
|---|---|---|---|---|
| 2,828,756 | A | 4/1958 | Worley | |
| 3,424,179 | A * | 1/1969 | Minot | E04H 3/165 52/63 |
| 3,564,784 | A | 2/1971 | Mollinger | |
| 3,820,553 | A * | 6/1974 | Huddle | E04H 15/18 135/132 |
| 4,066,089 | A | 1/1978 | Rainwater | |
| 4,365,908 | A | 12/1982 | Thiboutot | |
| 4,583,331 | A * | 4/1986 | Hunt | E04H 15/52 135/132 |
| 4,593,710 | A * | 6/1986 | Stafford | E04H 15/644 52/63 |
| 4,667,692 | A | 5/1987 | Tury et al. | |
| 4,841,688 | A * | 6/1989 | Rinaldi | E04H 15/34 52/63 |
| 5,146,722 | A * | 9/1992 | Stafford | E04H 15/18 52/63 |
| 5,159,790 | A | 11/1992 | Harding | |
| 5,167,246 | A | 12/1992 | Mortenson | |
| 5,263,507 | A | 11/1993 | Chuang | |
| 5,771,651 | A | 6/1998 | Shiina | |
| 5,884,647 | A | 3/1999 | Dwek | |
| 6,550,491 | B1 | 4/2003 | Bixler et al. | |
| 6,575,656 | B2 | 6/2003 | Suh | |
| 7,290,553 | B2 | 11/2007 | Prevost | |
| 7,395,830 | B2 | 7/2008 | Seo | |
| 7,975,712 | B2 | 7/2011 | Beacco | |
| 8,033,289 | B2 | 10/2011 | Buckley | |
| 8,186,369 | B2 | 5/2012 | Reeb et al. | |
| 8,205,627 | B2 | 6/2012 | Zhou | |
| 2005/0217713 | A1 | 10/2005 | Chu et al. | |
| 2006/0051159 | A1 | 3/2006 | Tsai | |
| 2006/0062632 | A1 | 3/2006 | Jang | |
| 2011/0284044 | A1 | 11/2011 | Baldussi | |
| 2016/0265246 | A1 | 9/2016 | Becher et al. | |

FOREIGN PATENT DOCUMENTS

| | | | |
|---|---|---|---|
| CN | 101463671 | A | 6/2009 |
| EP | 0020770 | A1 | 1/1981 |
| EP | 0248540 | A | 12/1987 |
| EP | 0494053 | A1 | 7/1992 |
| EP | 0534843 | A1 | 3/1993 |
| GB | 680294 | A | 10/1952 |
| GB | 982411 | A | 2/1965 |
| GB | 2254630 | A | 10/1992 |
| GB | 2475512 | A | 5/2011 |
| WO | 2008120071 | A2 | 10/2008 |

* cited by examiner

RAPIDLY DEPLOYABLE MODULAR SHELTER SYSTEM

REFERENCE TO RELATED APPLICATIONS

The present application is a continuation in-part of U.S. patent application Ser. No. 17/023,279, which is pending and is a continuation of U.S. Pat. No. 10,794,080 granted 6 Oct. 2020, which claims benefit and is a continuation-in-part of U.S. Pat. No. 10,392,828 granted 27 Aug. 2019, which claims the benefits, under 35 U.S.C. § 119(e), of U.S. provisional application No. 62/287,313 filed Jan. 26, 2016, and which is a 371 of international application no. PCT/CA2017/050071 filed 25 Jan. 2017, all of which are entitled "RAPIDLY DEPLOYABLE MODULAR SHELTER SYSTEM", and all of which are incorporated herein by this reference.

TECHNICAL FIELD

The invention relates to the field of collapsible structures, in particular fabric-covered structures such as tents and collapsible frames for supporting same.

BACKGROUND

Numerous designs have been developed for large-scale collapsible fabric-covered structures which are portable and can be rapidly erected and disassembled. Such structures have use in military applications, for resource exploration, for large public events such as concerts and festivals and the like. Typically the frames for such structures consist of multiple separate pieces which can become misplaced and are complicated to assemble, dis-assemble and pack for shipment. There is therefore a need for more simple and efficient frames for large-scale collapsible structures.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

The present invention therefore provides a leg element for use in a folding tent frame system, the folding tent frame system having a roof frame comprising arch brackets configured to receive a plurality of the leg elements, each leg element comprising: a) a first inner leg element comprising a base and a rigid vertical element mounted on the base, the rigid vertical element having a plurality of vertically spaced latch-receiving slots; and b) a second outer sliding leg element slideably movable vertically on the first inner leg element, the second outer sliding leg element comprising a horizontally extending lifting bar secured thereto and a spring-biased latch element for securing the outer sliding leg element at selected vertical locations on the inner leg element.

According to a further aspect there is provided a folding tent frame comprising a folding roof frame, and a plurality of leg elements engageable with the folding roof frame wherein the folding roof frame comprises a plurality of arch brackets located on the periphery thereof for releasably receiving and securing the plurality of leg elements. each arch bracket comprises a vertical passage open on the outer side thereof for receiving one of the outer sliding leg elements and opposed tapered interior surfaces for bearing against an outer surface of the outer sliding leg elements. The outer sliding leg elements may comprise tapered outer surfaces configured to engage the tapered interior surfaces of the plurality of arch brackets. There is further provided a shelter system comprising the folding tent frame described above, and a flexible tent body removably suspended from the folding tent frame when the folding tent frame is in an unfolded and locked configuration.

According to a further aspect there is provided a method of deploying a shelter wherein the shelter comprises a folding tent frame as described above and a flexible tent body, the method comprising the steps of: a) unfolding the roof frame, reversibly locking the roof frame in an unfolded configuration and placing the unfolded roof frame on a generally horizontal surface such as the ground; b) removably securing the flexible tent body to the unfolded roof frame at a plurality of points; c) securing the plurality of leg elements to the arch brackets of the unfolded roof frame wherein the leg elements are in a first lowered configuration to thereby raise one or both sides of the unfolded roof frame above the generally horizontal surface; d) raising the roof frame further above the generally horizontal surface by sliding each outer sliding leg elements of the plurality of leg elements vertically on each first inner leg element to thereby secure each leg element in a further extended configuration; e) repeating step d) until the unfolded roof frame has been raised to a selected extended height; f) before or in the course of any one of steps c), d) or e) securing each base of the plurality of leg elements to the generally horizontal surface; and g) further securing the flexible tent body to the roof frame and extended leg elements and the generally horizontal surface. Where the bases of the leg elements comprise apertures each base of the plurality of leg elements may be secured to the generally horizontal surface using stakes extending through the apertures into the generally horizontal surface. The outer sliding leg elements may slid vertically on each first inner leg element by lifting the horizontally extending lifting bars.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
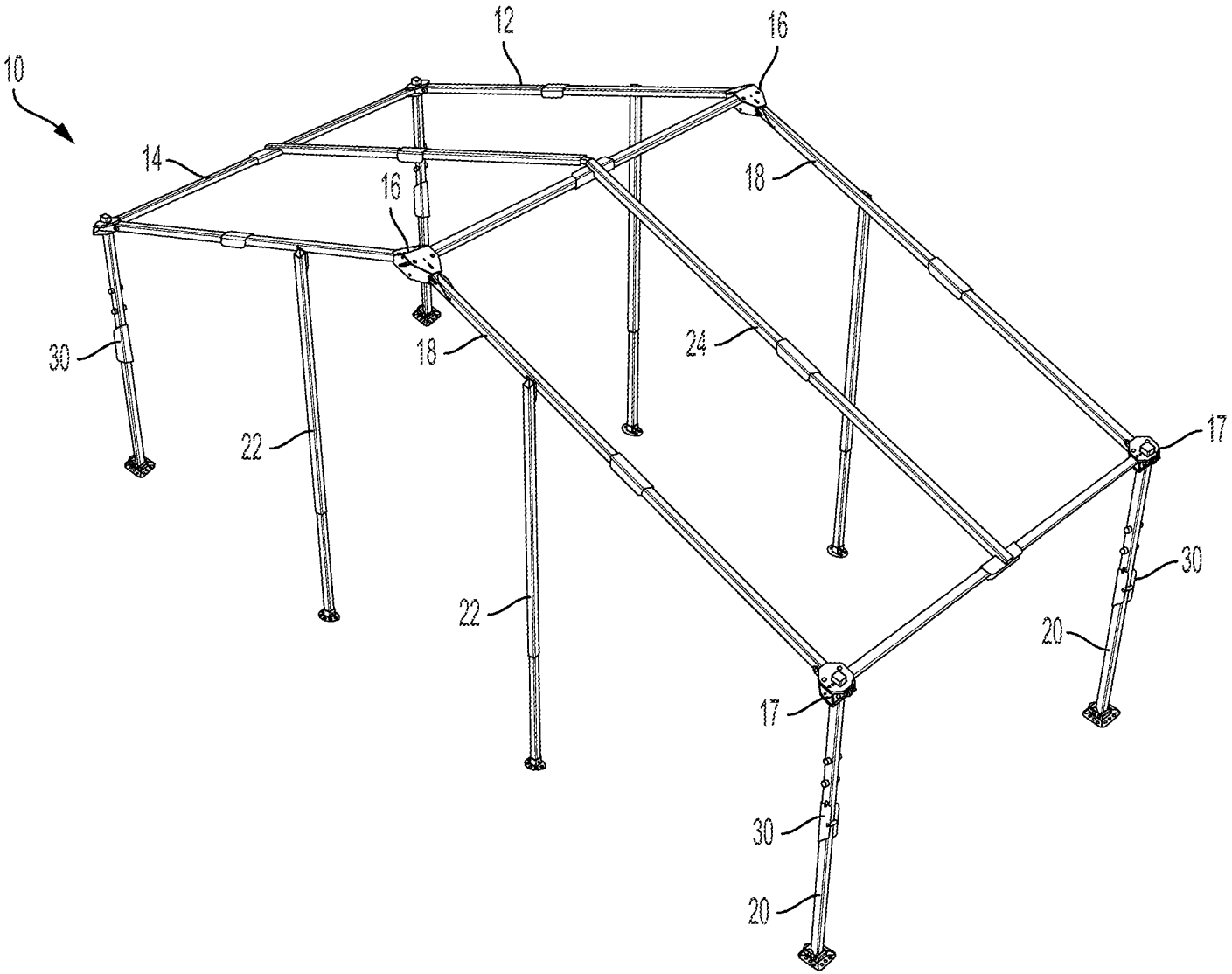
FIG. 1 is a perspective view of the unfolded assembled frame for a one bay structure according to an embodiment of the invention.
Figure 34:
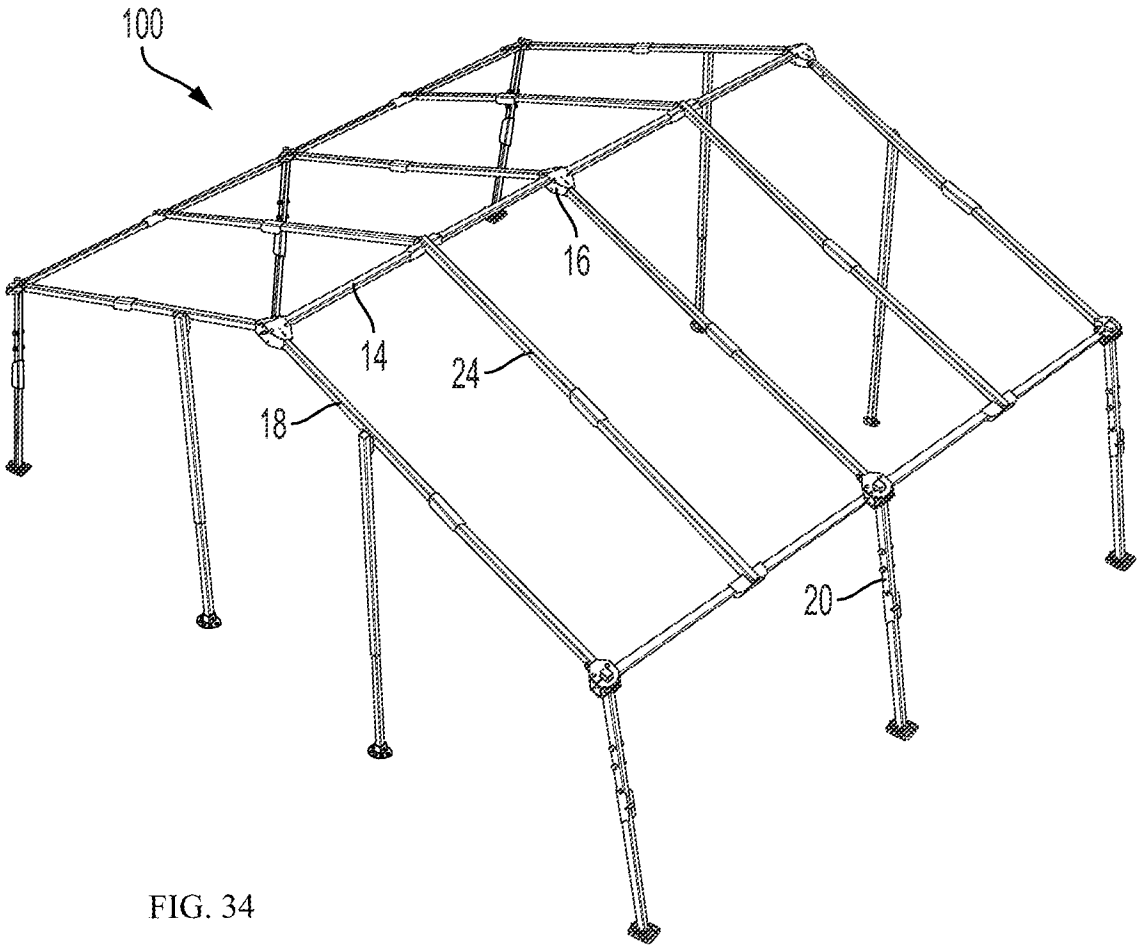
FIG. 34 is a perspective view of the unfolded assembled frame for a two bay structure according to an embodiment of the invention.
Figure 35:
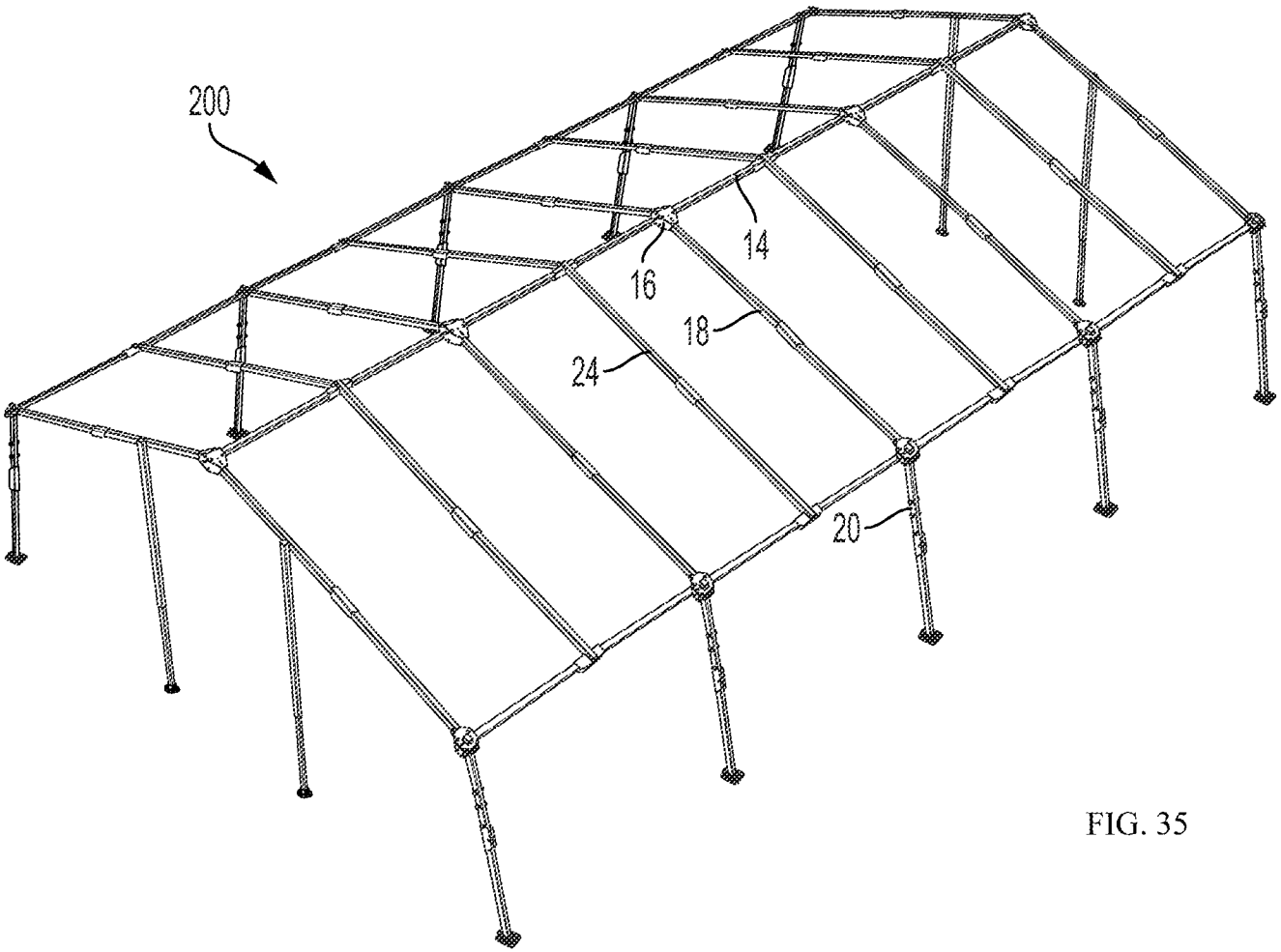
FIG. 35 is a perspective view of the unfolded assembled frame for a four bay structure according to an embodiment of the invention.

With reference to FIG. 1, an unfolded frame assembly 10 for a one bay structure according to an embodiment of the invention is shown. Unfolded frame assemblies 100 and 200 for two and four bay structures according to an embodiment of the invention are shown in FIGS. 34 and 35. Each frame assembly 10 comprises an upper section assembly 12 (FIG. 2) which includes fully attached folding purlins 14. Frame assembly 10 also comprises peak brackets 16, eave brackets 17, chords 18, legs 20, wind kit posts 22, midspan chords 24, chord knee joints 26, purlin knee joints 28, and leg knee joints 30. Such joints contain self-resetting lock mechanisms as described below. During set up they lock the joints into place without needing to be touched. Once unlocked they reset to automatically lock the joints into place on the next setup.

Peak bracket and chord joint locks contain a secondary feature which allows joints to be set into an unlocked position until the joint is bent, at which time the lock resets, ready to lock the joint into position on the next setup. This facilitates the pack up procedure, as multiple joint locks need not be manually held unlocked at the same time.

Figure 2:
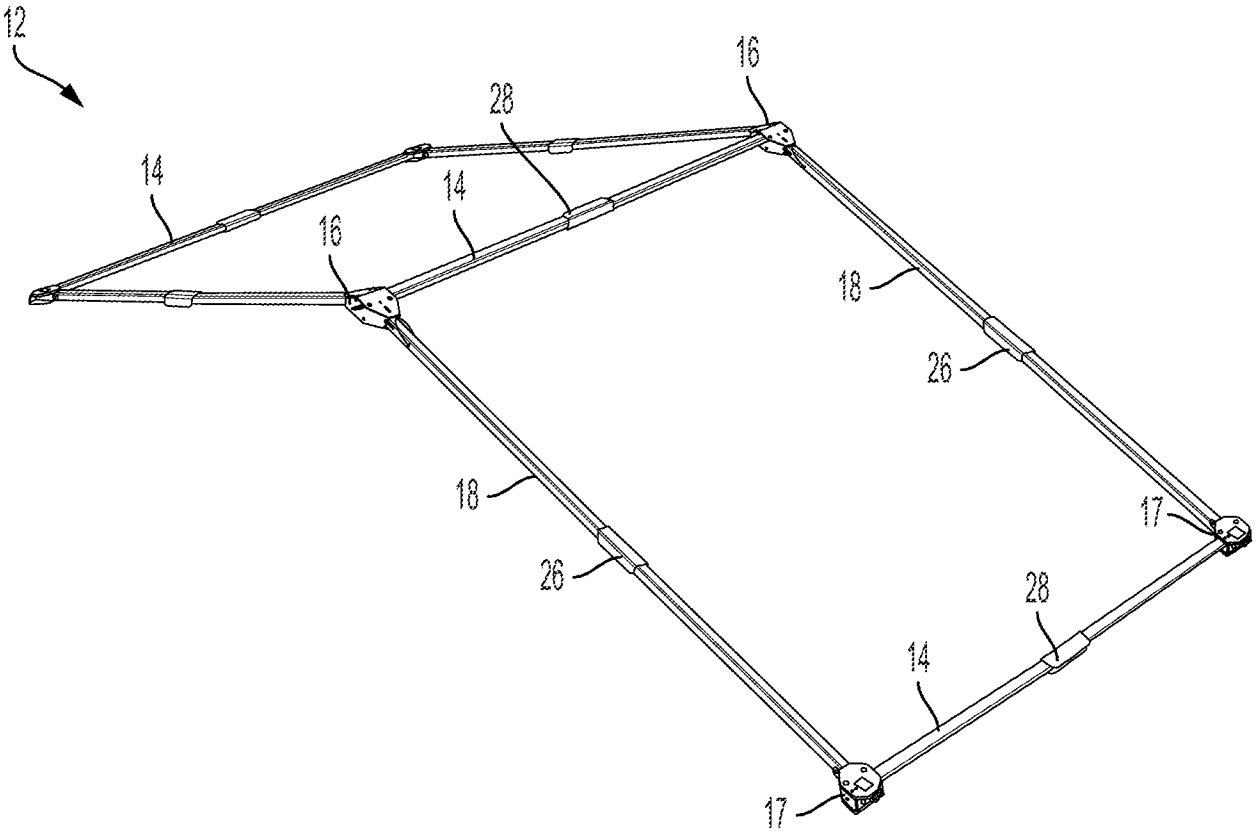
FIG. 2 is a perspective view of the upper folding assembly for the frame in FIG. 1, expanded with frame components unfolded.
Figure 3:
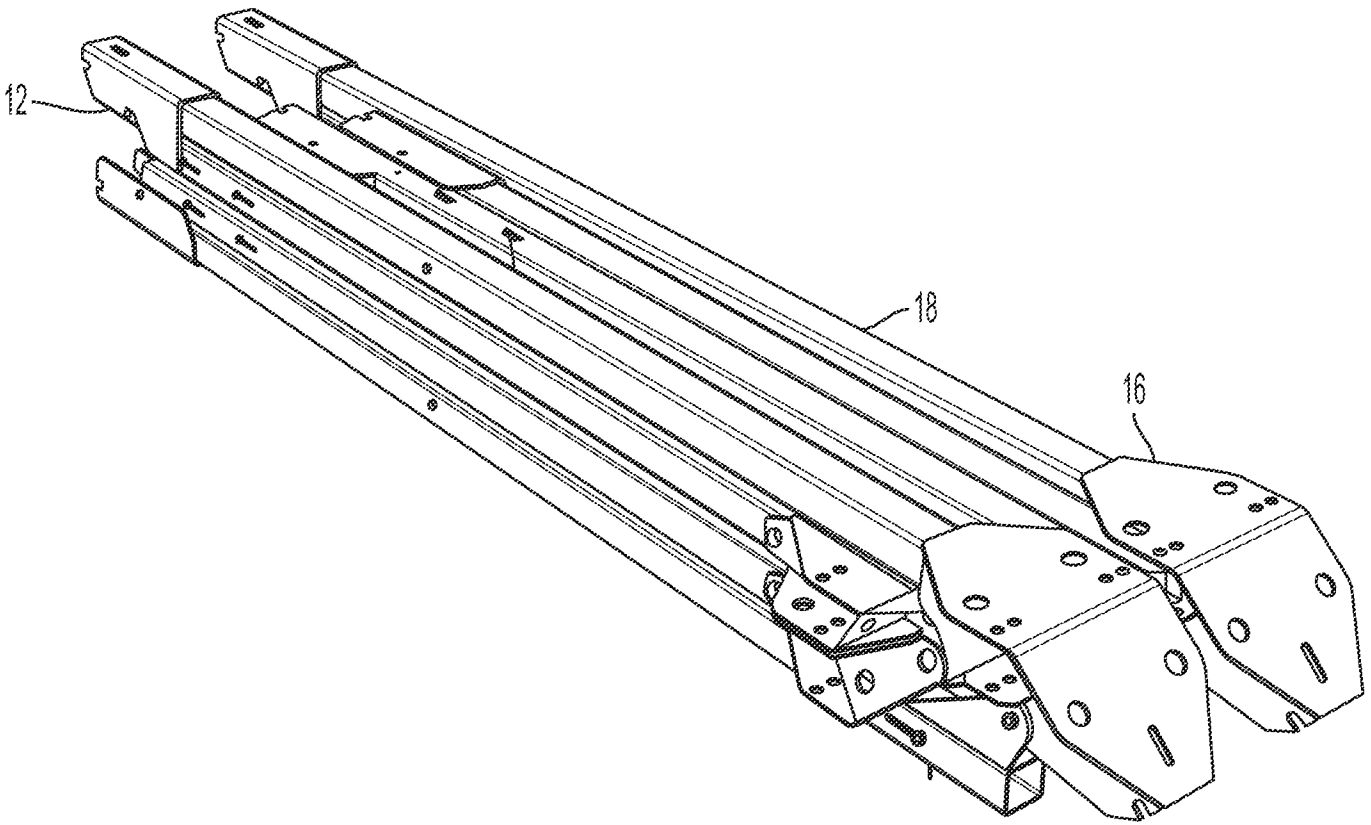
FIG. 3 is a perspective view of the upper folding assembly for the frame as shown in FIG. 2, folded for packing.
Figure 4:
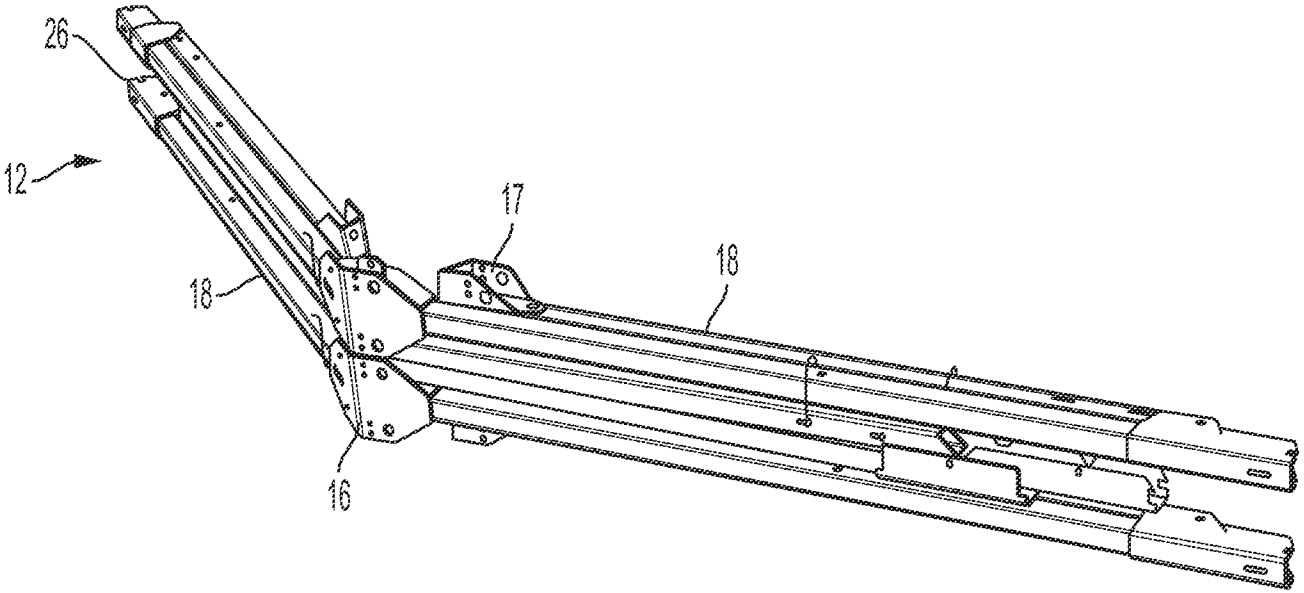
FIG. 4 is a perspective view of the upper folding assembly for the frame as shown in FIG. 2, partially unfolded.
Figure 5:
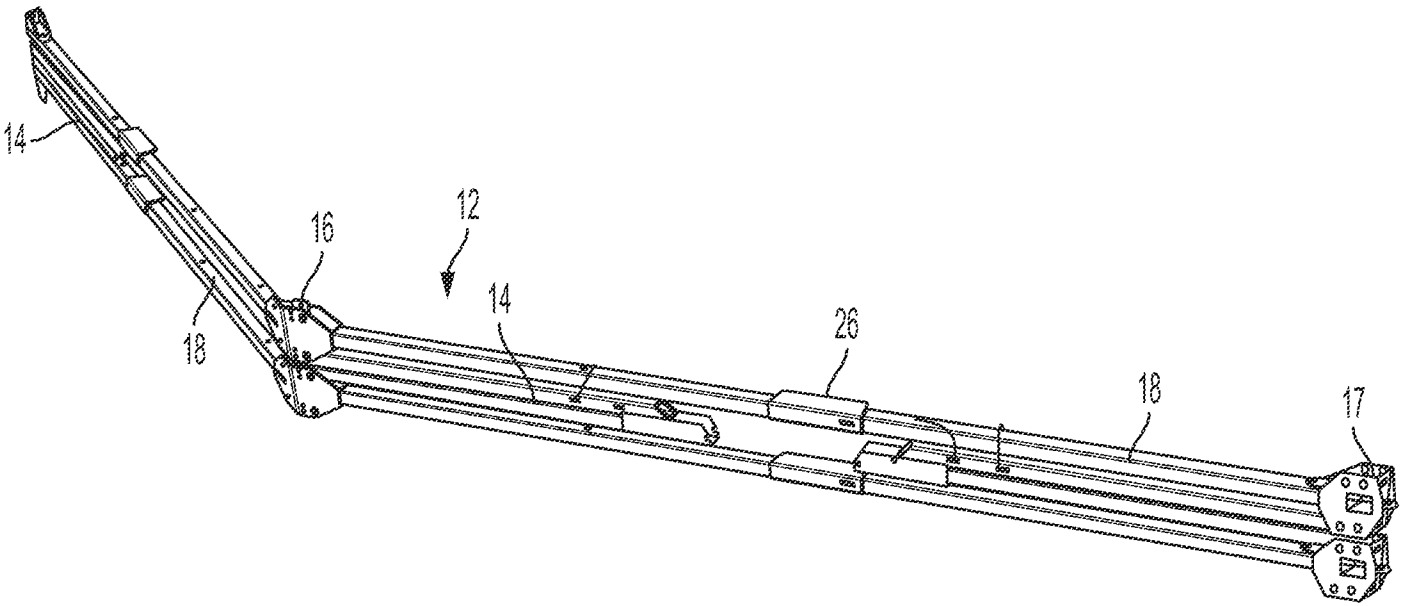
FIG. 5 is a perspective view of the upper folding assembly for the frame as shown in FIG. 2, further unfolded.
Figure 6:
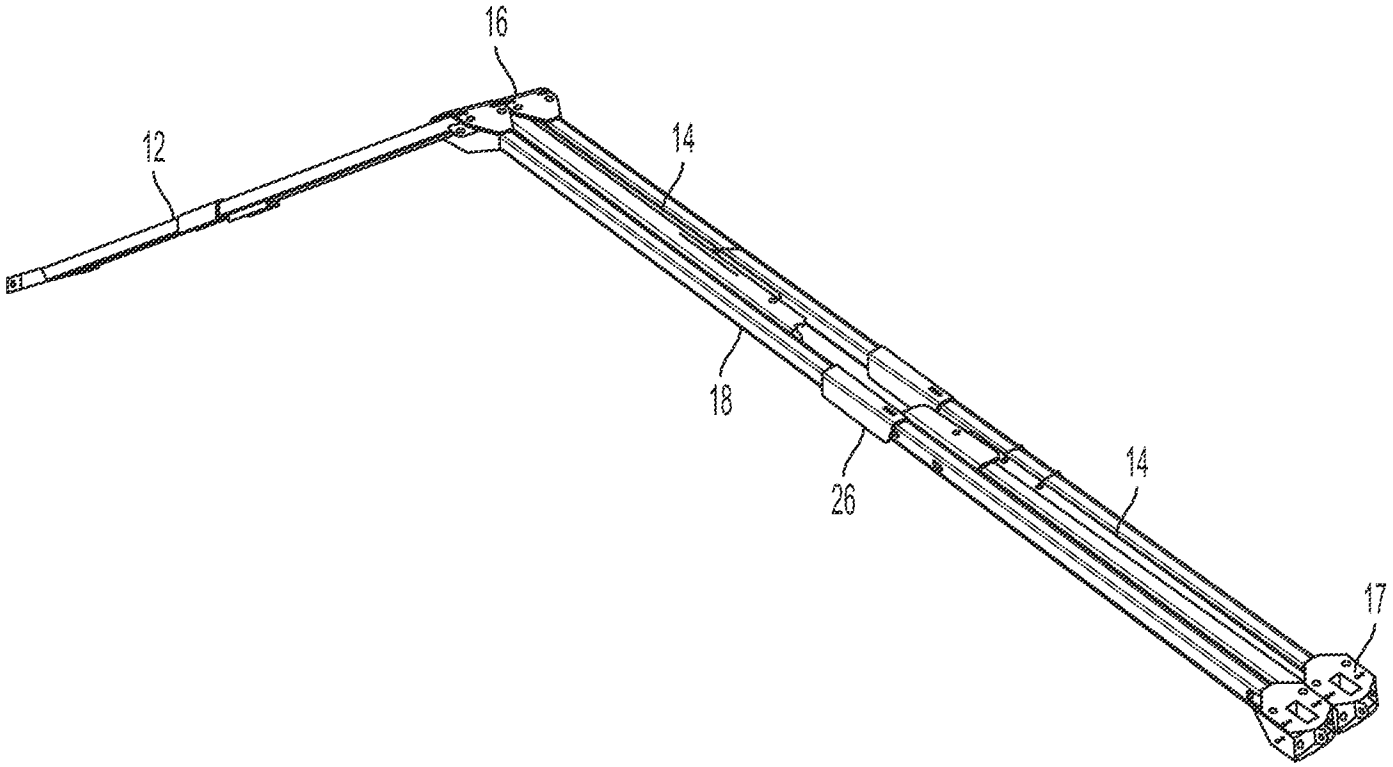
FIG. 6 is a perspective view of the upper folding assembly for the frame as shown in FIG. 2, further unfolded and standing upright.
Figure 7:
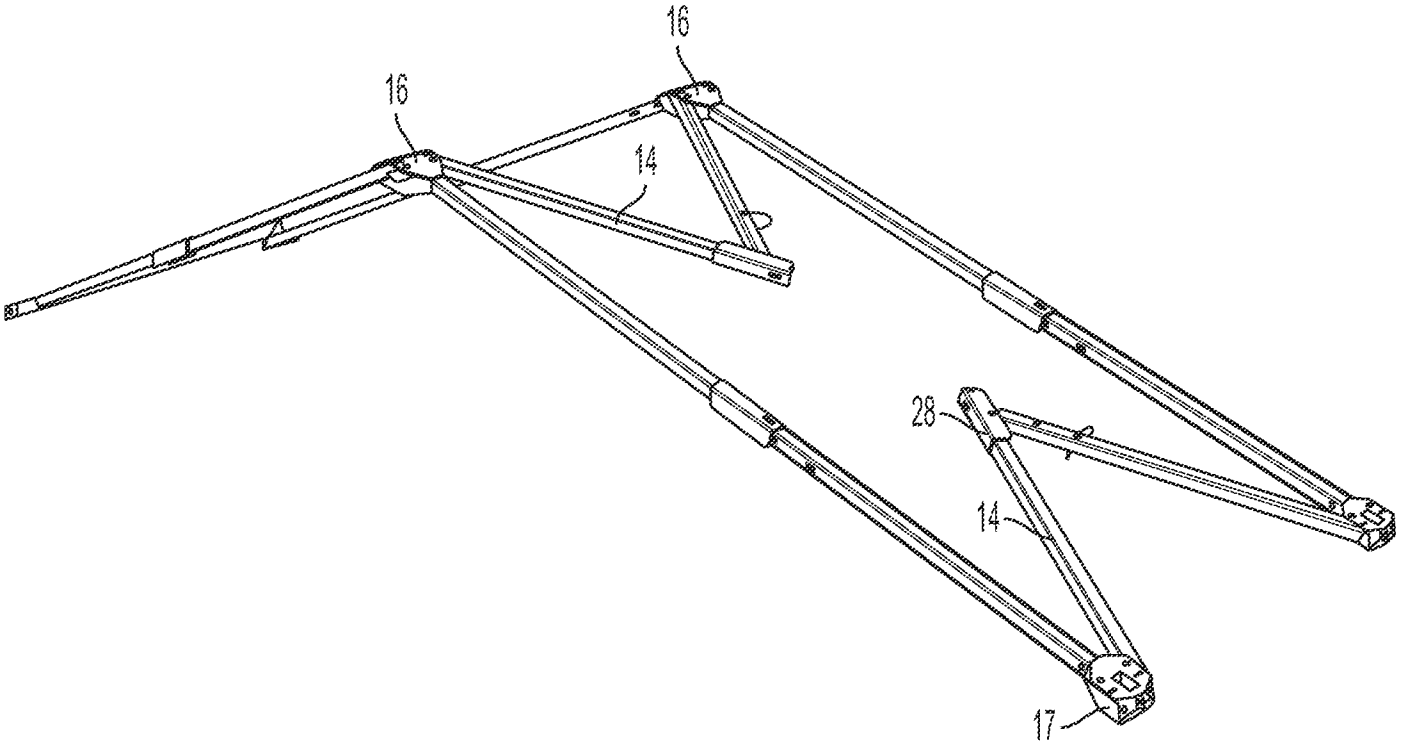
FIG. 7 is a perspective view of the upper folding assembly for the frame as shown in FIG. 2, standing upright further unfolded.

FIG. 3 shows the upper folding assembly 12 for the frame as shown in FIGS. 1 and 2, folded for packing. In FIG. 4 one set of two folded chords 18 and one folded purlin 14 are rotated about the hinged peak bracket 16 to separate from the set of two folded chords 18 and two folded purlin 14. In FIG. 5 the chords 18 are unfolded by rotating at chord knee joints 26. In FIG. 6 the partially unfolded upper frame assembly is placed in an upright position and as shown in FIG. 7 purlins 14 are unfolded about hinged purlin knee joints 28, to reach the unfolded configuration shown in FIG. 8.

Figure 9:
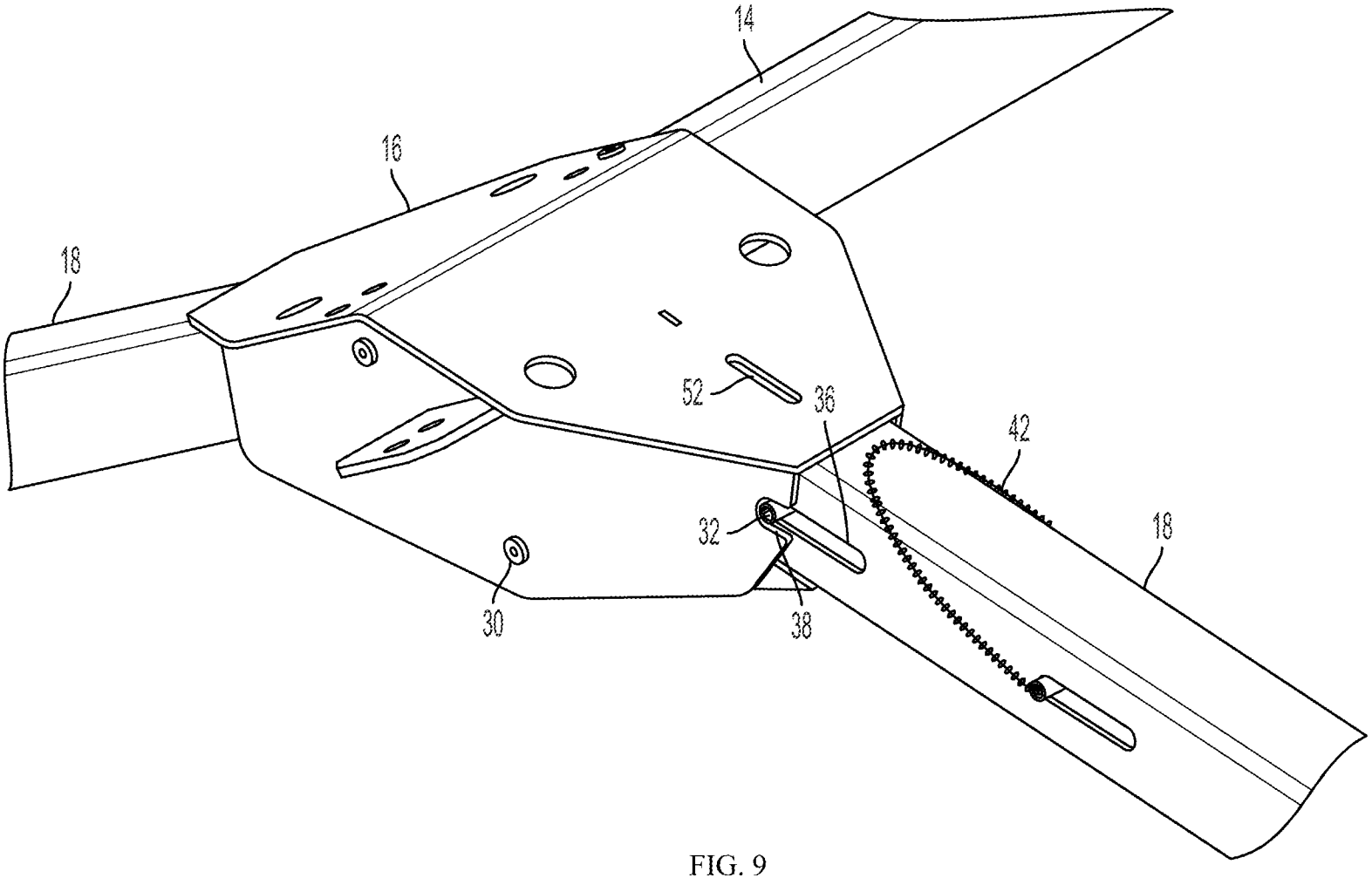
FIG. 9 is a perspective view of a Peak Bracket.
Figure 10:
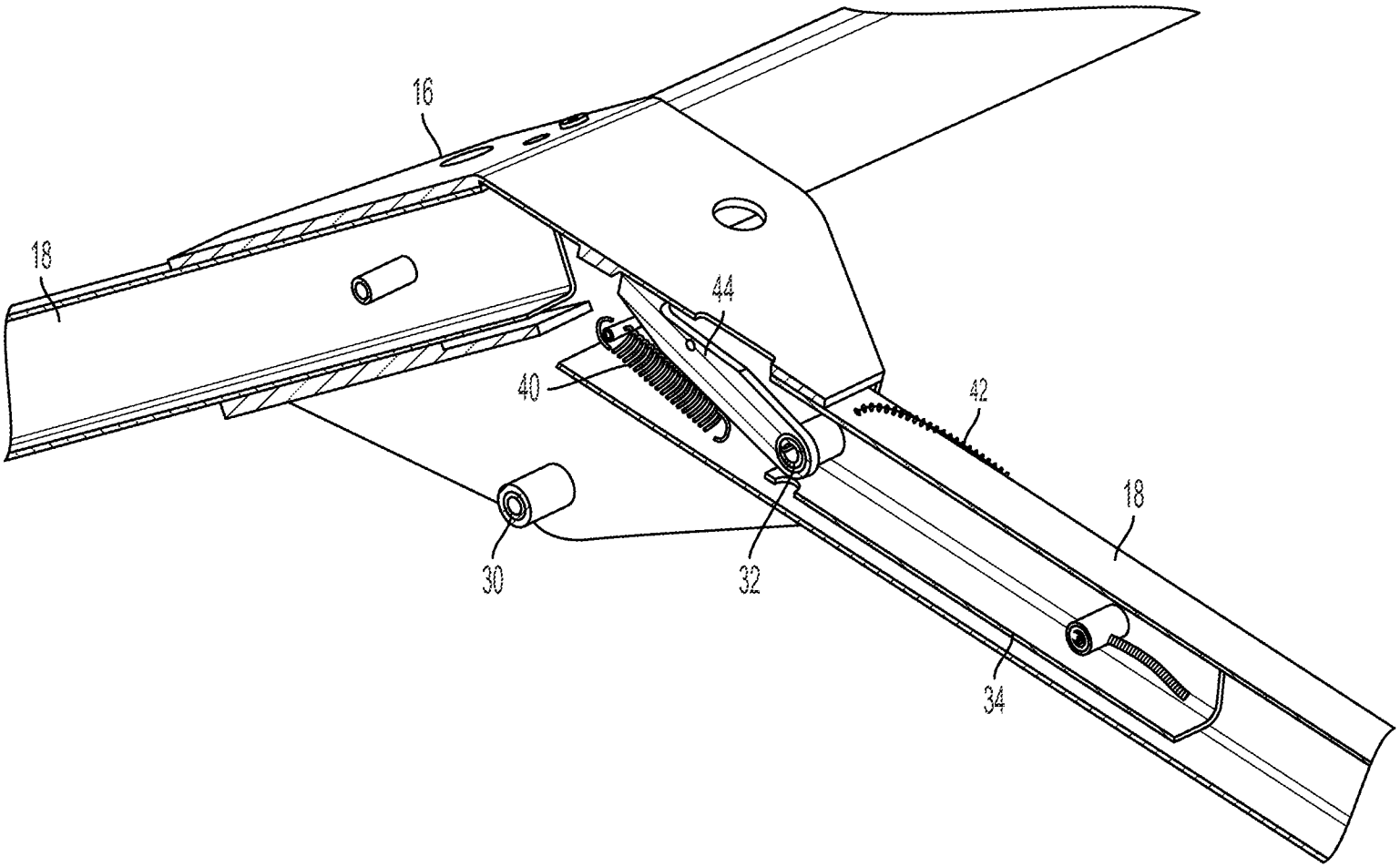
FIG. 10 is a perspective view of the Peak Bracket shown in FIG. 9 partially in cross-section, showing chord connections, peak hinge, and sliding lock mechanism with lockout feature.

Peak brackets 16 are hingedly connected to chord 18 about axis 30. When in the unfolded position shown in FIGS. 9 and 10, the chord 18 is locked in place by pins 32 which are mounted on interior sliding locking frame 34 and extend through slots 36 in the sides of chords 18, and into slots 38. Pins 32 are biased by spring 40 into the locked position shown in FIG. 9. Pulling on cable 42 slides subframe 34 away from the peak bracket 16, releasing pin 32 from slot 38 and allowing chord 18 to rotate.

Thus peak bracket joints, chord knee joints, purlin knee joints, and leg knee joints all contain self-resetting lock mechanisms. During set up they lock the joints into place without needing to be touched. Once unlocked they reset to automatically lock the joints into place on the next setup.

Figure 11:
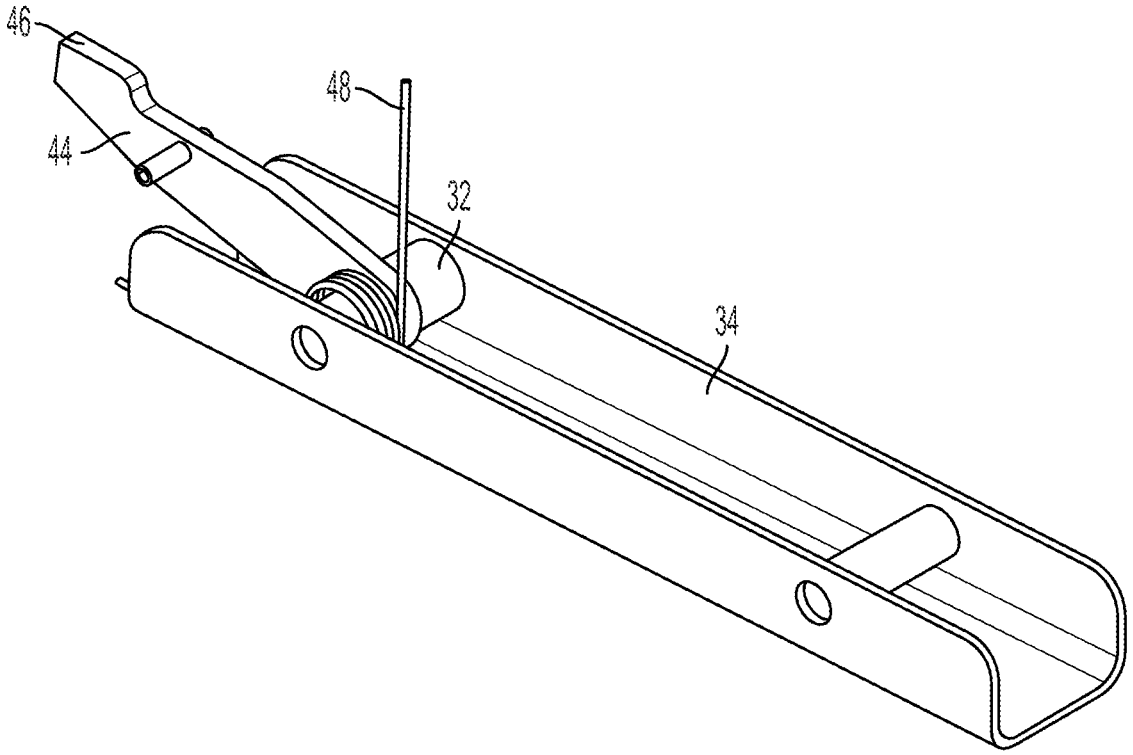
FIG. 11 is a perspective view of a detail of the sliding lock mechanism with lockout feature.

As previously noted peak brackets 16 and chord knee joints 26, contain a secondary lockout feature which allows joints to be set into an unlocked position until the joint is bent, at which time the lock resets, ready to lock the joint into position on the next setup. This assists the pack up procedure, as multiple joint locks didn't need to be manually held unlocked at the same time. Lockout bars 44 permit the chords 18 to be kept in an extended unfolded position without locking. With reference to FIG. 11, lockout bar 44 is hingedly mounted on pin 32 on sliding locking frame 34. It is biased to an upward position by spring 48. Head 46 is sized to move upwardly into slot 50 of chord knee joint 26 or slot 52 of peak bracket 16. By pulling on cable 42 the operator can unlock the joint by allowing head 46 to extend into slot 50/52 to prevent the joint from re-locking while keeping the joint unfolded. Once the joint is bent, head 46 comes out of slot 50/52 at which time the lock resets, ready to lock the joint into position on the next setup.

Figure 12:
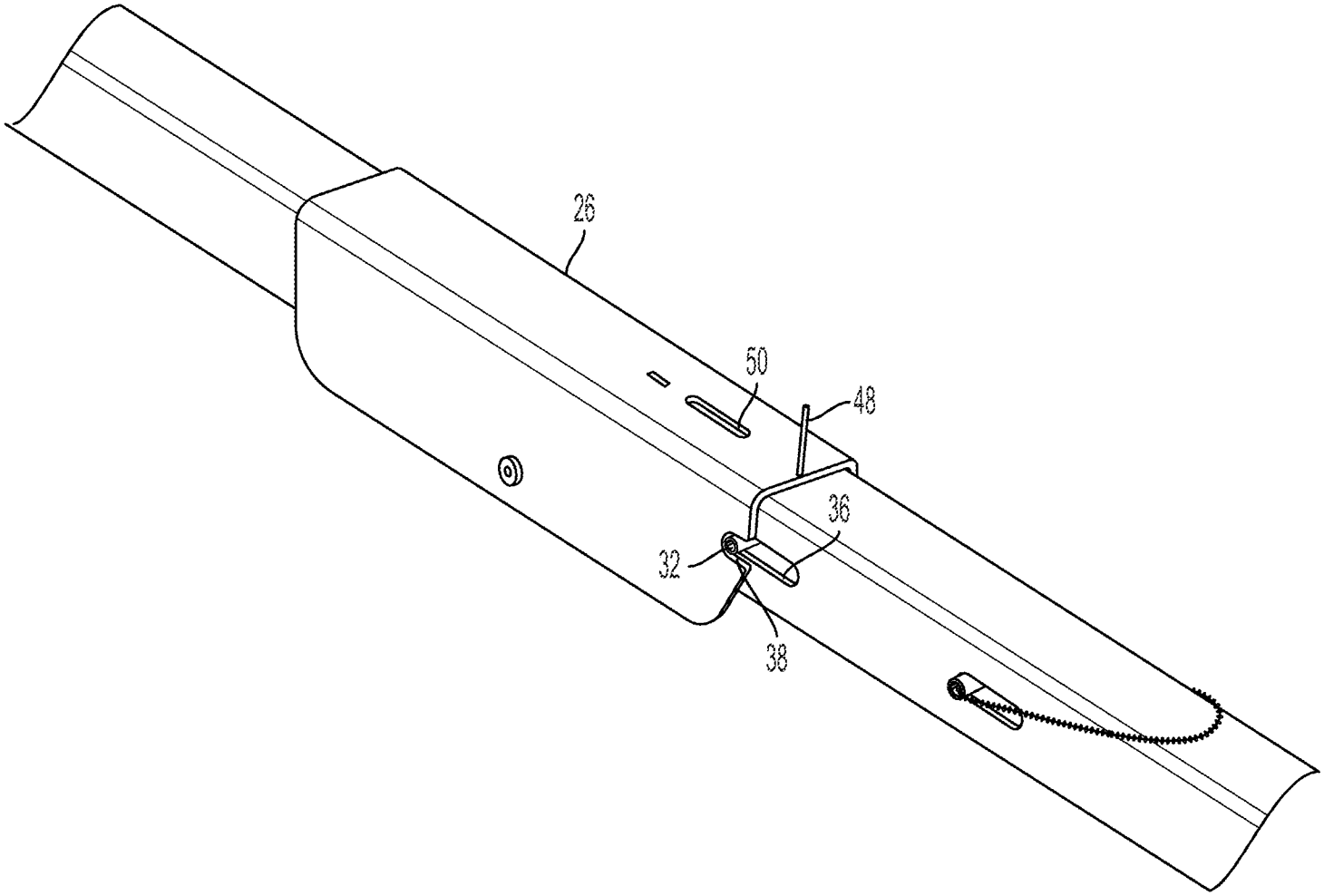
FIG. 12 is a perspective view of the chord knee bracket.
Figure 13:
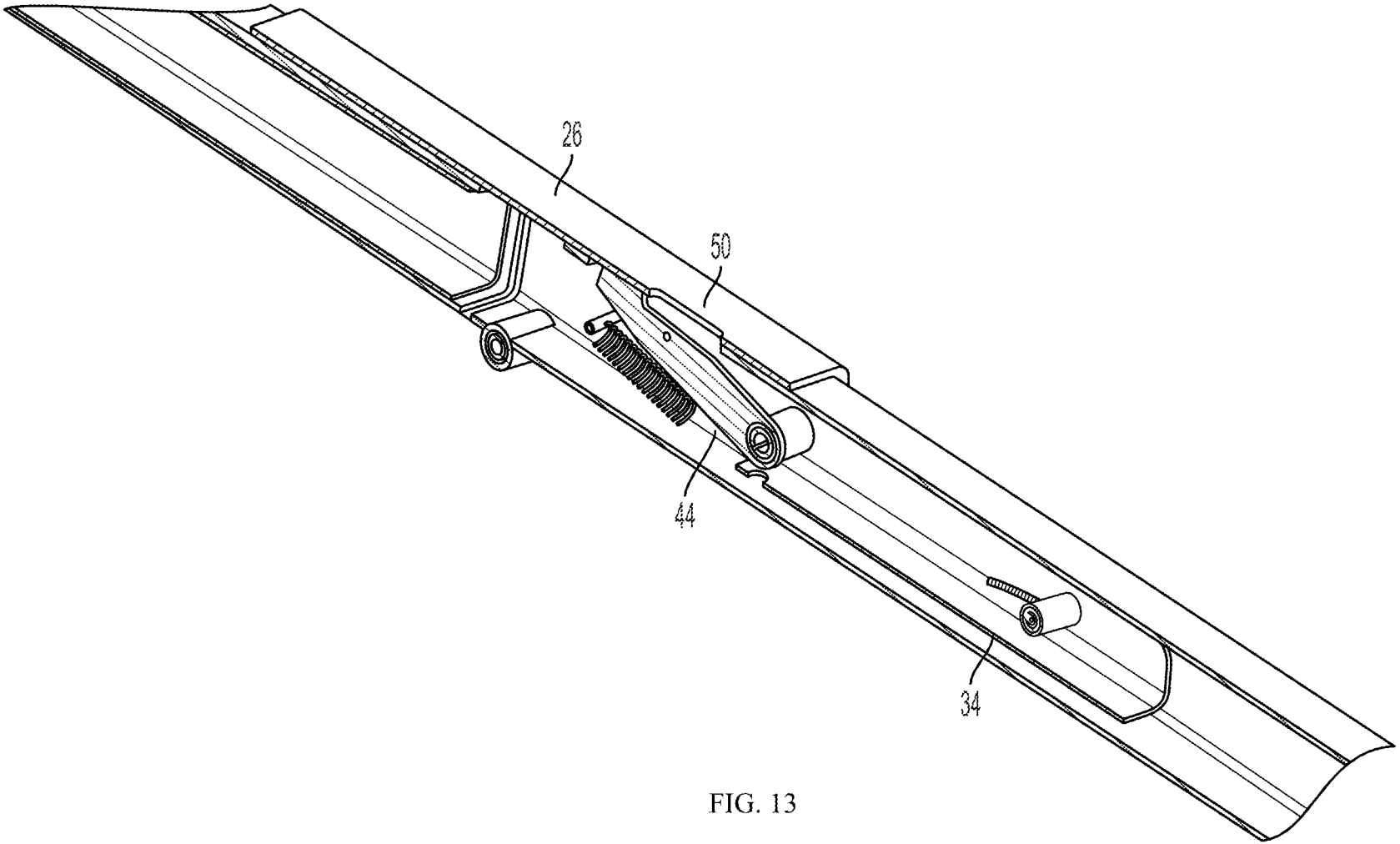
FIG. 13 is a perspective view partially in cross-section of the chord knee bracket of FIG. 12 showing the sliding lock mechanism with lockout feature.

Chord knee bracket shown in FIGS. 12 and 13 operates in the same way as the peak bracket 16 using sliding locking frame 34.

Figure 14:
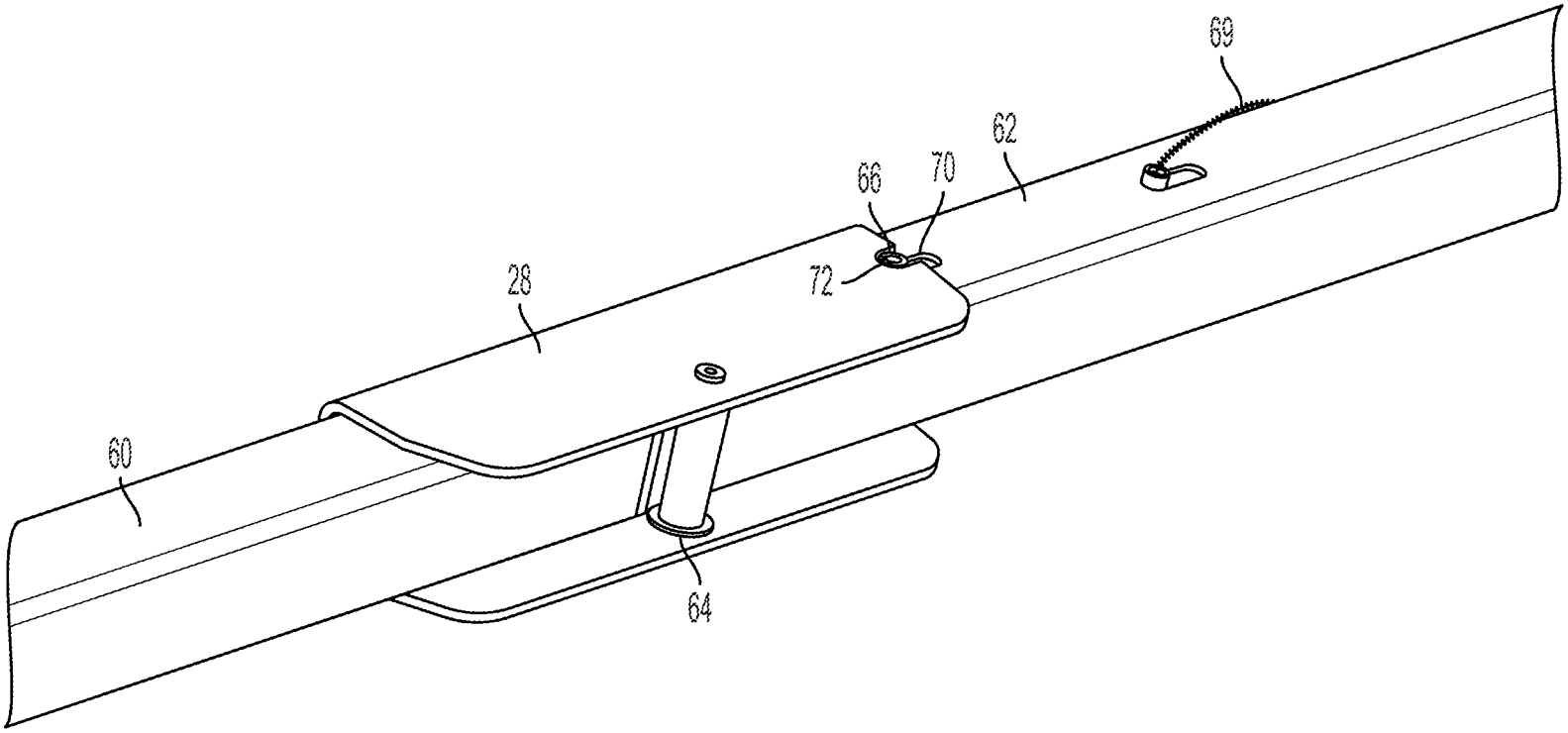
FIG. 14 is a perspective view of a purlin knee bracket.
Figure 15:
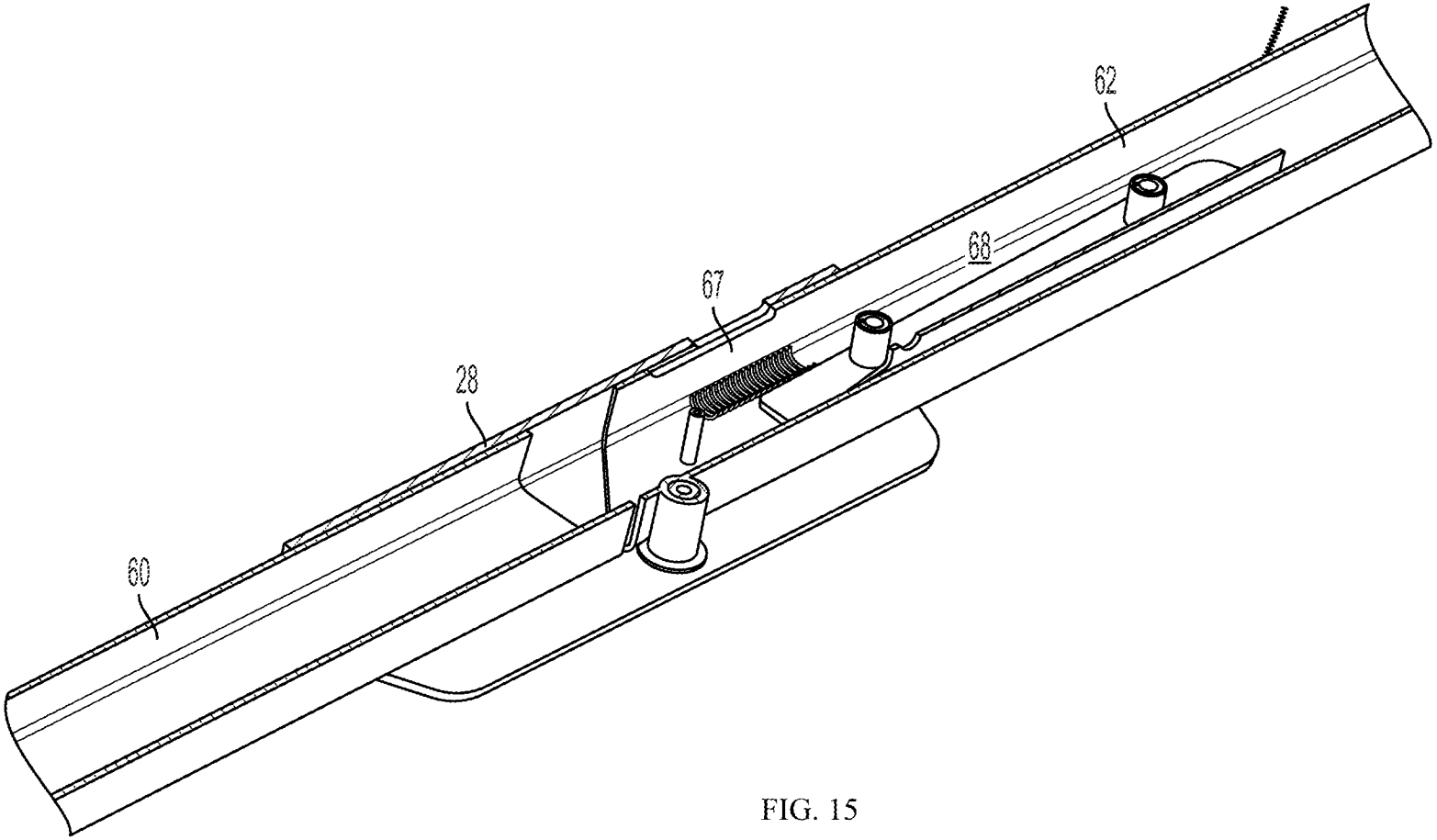
FIG. 15 is a detail front perspective view partially in cross-section of the purlin knee Bracket of FIG. 14, with sliding lock mechanism but no lockout feature.
Figure 16:
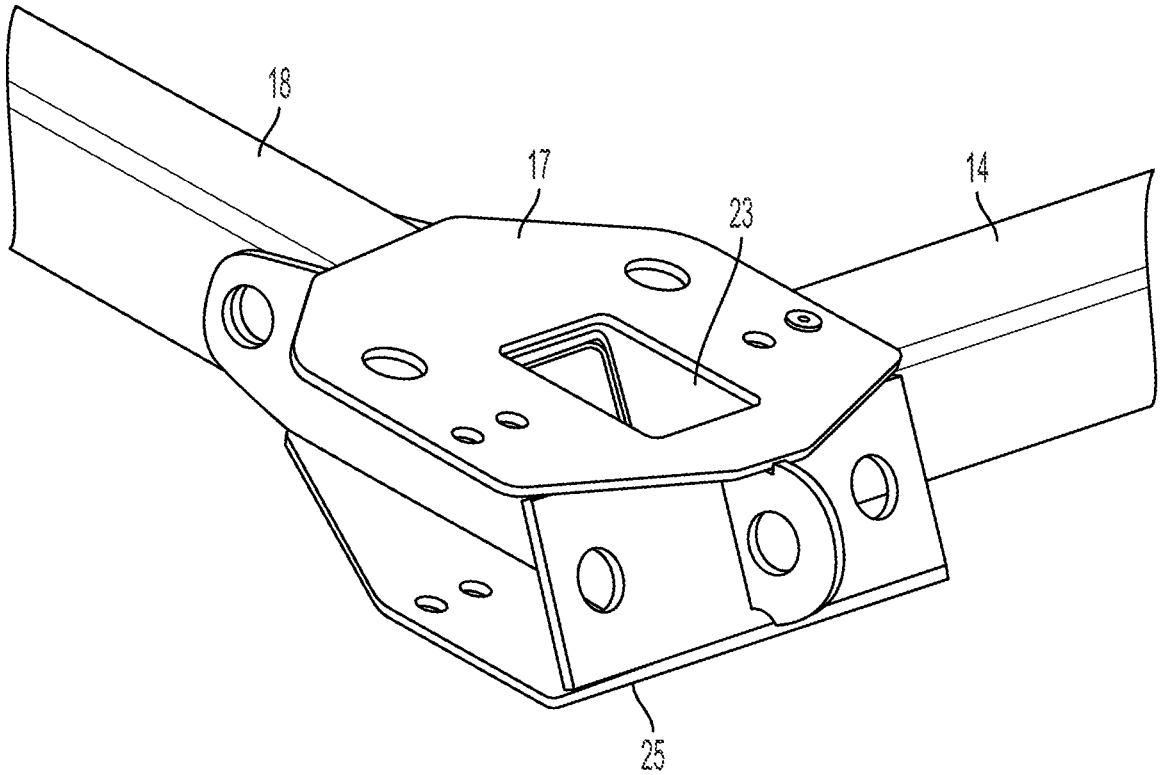
FIG. 16 is a detail rear perspective view of an eave bracket.
Figure 17:
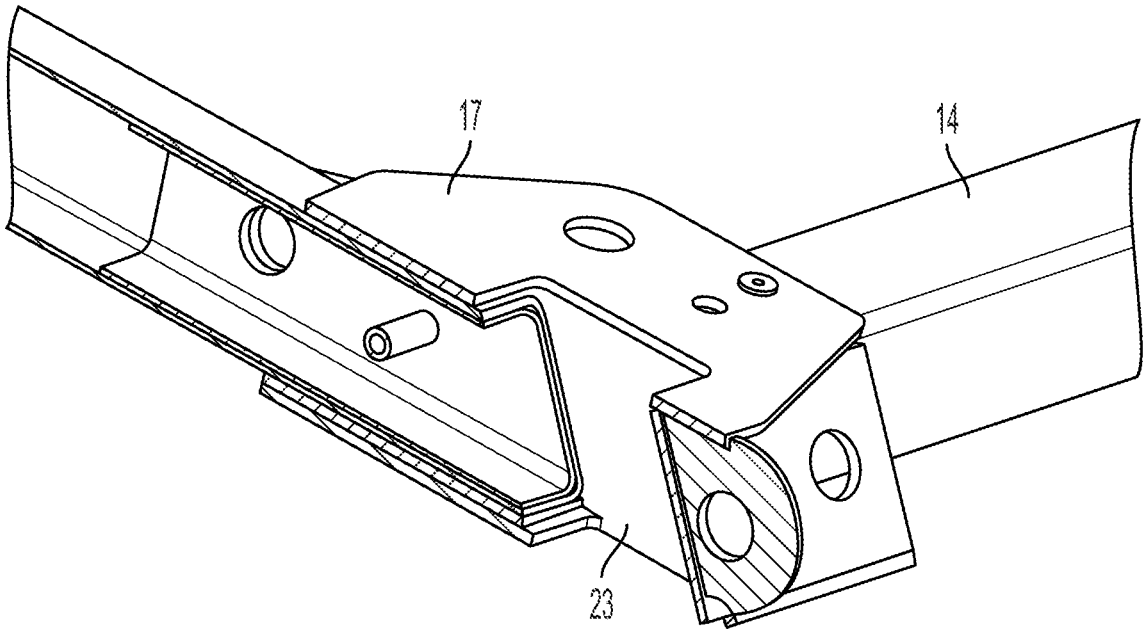
FIG. 17 is a detail perspective view partially in cross-section of the eave bracket of FIG. 16.
Figure 18:
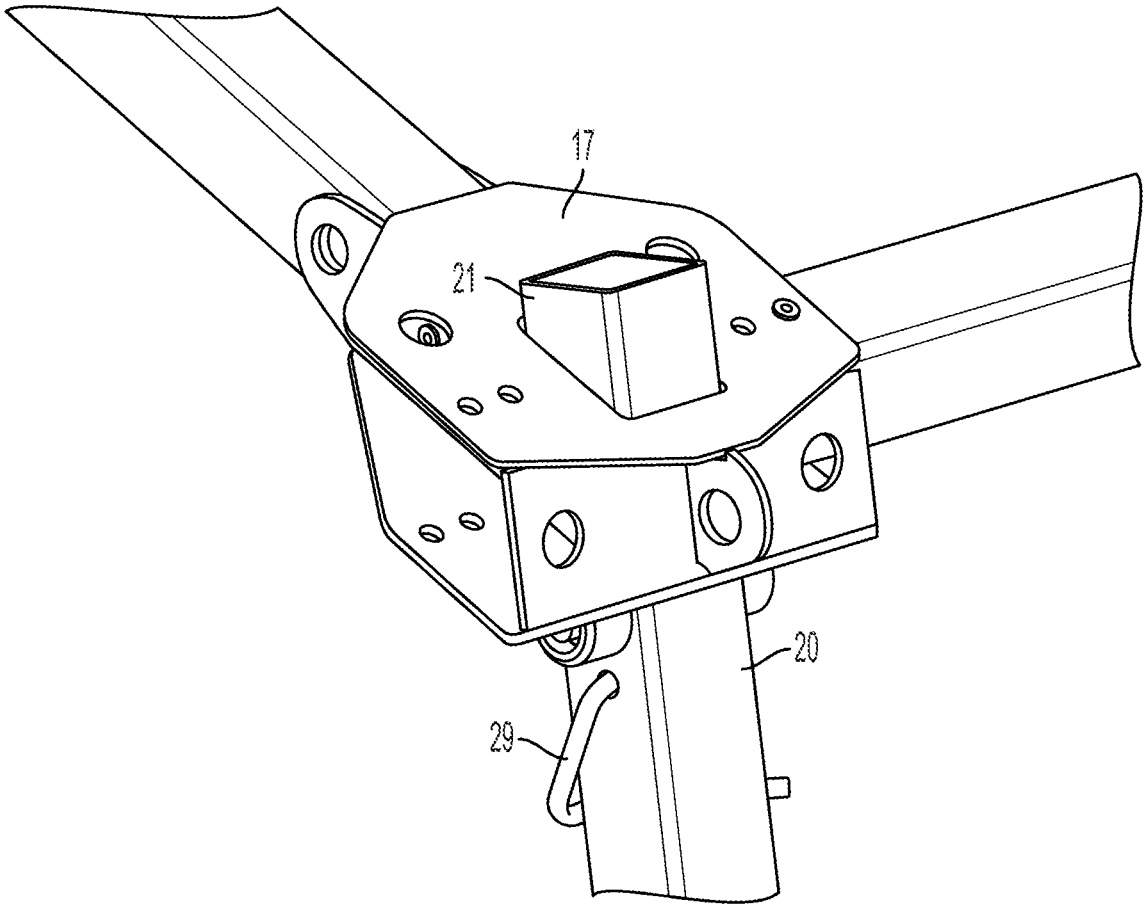
FIG. 18 is a detail front perspective view of the eave bracket of FIG. 16 with a leg inserted.

Purlin knee joints 28, and leg knee joints 30 operate in the same manner as the chord knee bracket 26 and the peak bracket 16 without the secondary lockout feature. Purlin knee bracket 28 is shown in FIG. 14. Purlin sections 60, 62 are hingedly connected about axis 64. When in the unfolded position shown in FIGS. 14 and 15, the purlin sections 60, 62 are locked in place by pins 66 which are mounted on interior sliding locking frame 68 and extend through slots 70 in the sides of the purlins, and into slots 72. Pins 66 are biased by spring 67 into the locked position shown in FIG. 14. Pulling on cable 69 slides locking frame 68, releasing pins 66 from slot 72 and allowing purlin sections 60, 62 to rotate.

Figure 19:
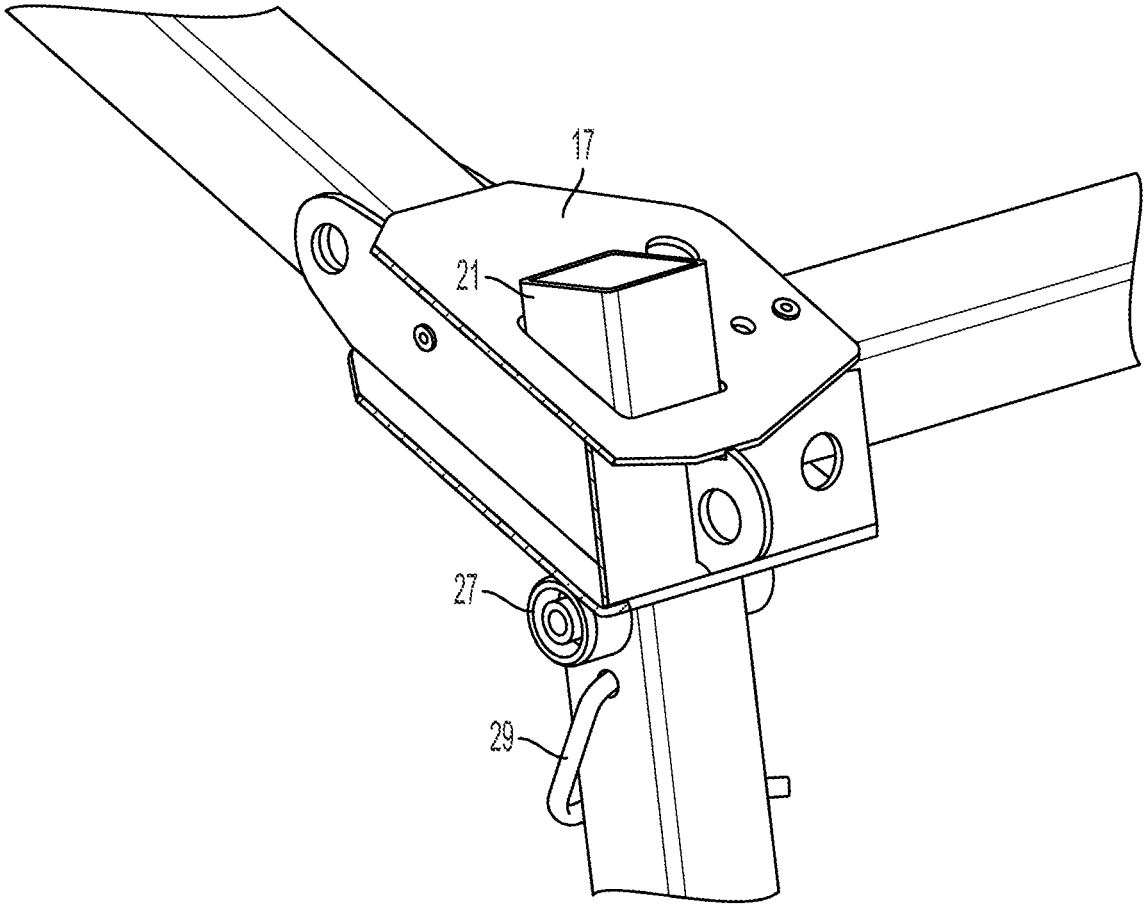
FIG. 19 is a detail front perspective view in partial cross-section of the eave bracket of FIG. 18 with leg inserted, shown resting in place on the upper leg bosses.
Figure 20A:
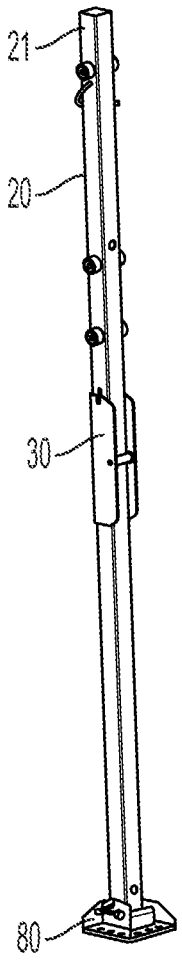
FIG. 20A is a detail front perspective view of a leg assembly.
Figure 20B:
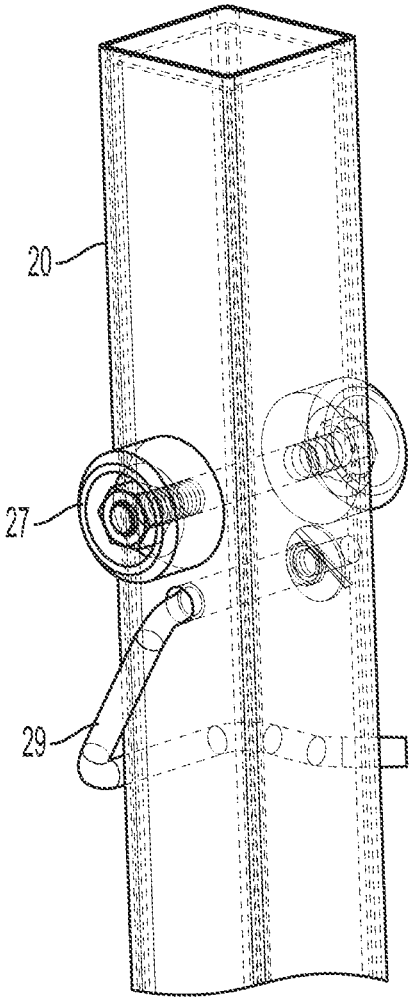
FIG. 20B is a detail front perspective view of a top portion of the leg assembly of FIG. 20A showing pinned bosses and a close haul wire hook for cover connection.
Figure 21A:
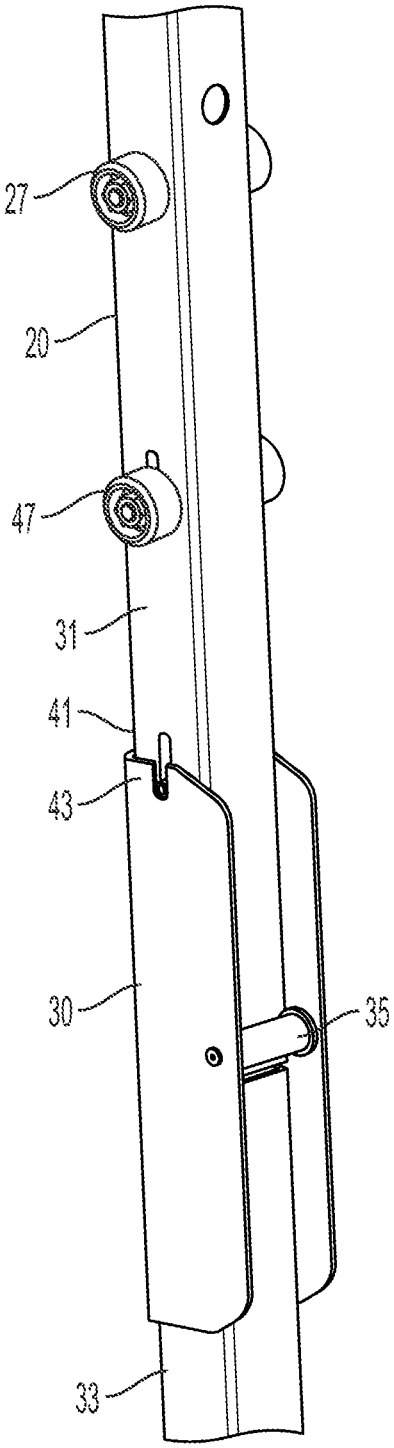
FIG. 21A is a detail front view of a leg knee joint.
Figure 21B:
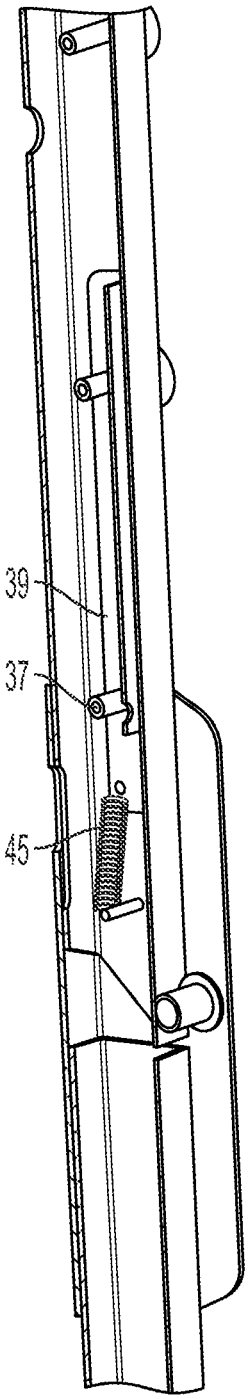
FIG. 21B is a detail front view of the leg knee joint of FIG. 21A partially in cross-section showing a locking slider.

Eave brackets 17 receive the upper end 21 of legs 20 through apertures 23. The lower surface 25 of bracket 17 rests on upper leg bosses 27 when the legs are in place. As shown in FIGS. 19 and 20B, leg 20 may be provided with close haul wire j-hook 29 for cover connection. As noted above, leg knee joints 30 operate in the same manner as the chord knee bracket 26 and the peak bracket 16 without the secondary lockout feature. Leg knee joint 30 is shown in FIGS. 21A and 21B. Leg sections 31, 33 are hingedly connected about axis 35. When in the unfolded position shown in FIGS. 21A and 21B, leg sections 31, 33 are locked in place by pins 37 which are mounted on interior sliding locking frame 39 and extend through slots 41 in the sides of the legs 20, and into slots 43. Pins 37 are biased by spring 45 into the locked position shown in FIG. 21A. Pulling on boss 47 slides locking frame 39, releasing pins 37 from slot 43 and allowing leg sections 31, 33 to rotate. This lock mechanism allows for a two-handed grip when lowering the shelter.

Figure 22:
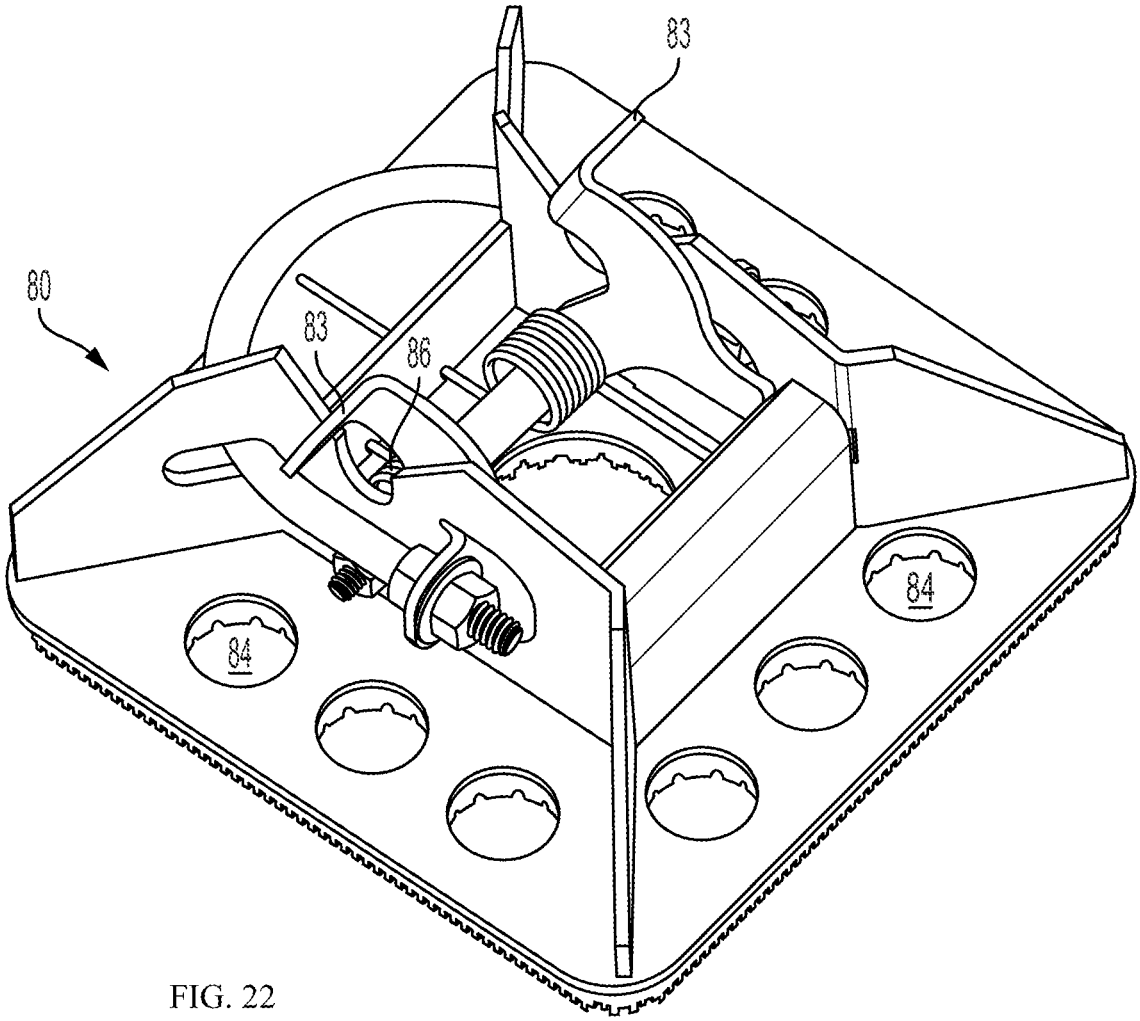
FIGS. 22 and 23 are perspective detail views of a quick release foot assembly.
Figure 23:
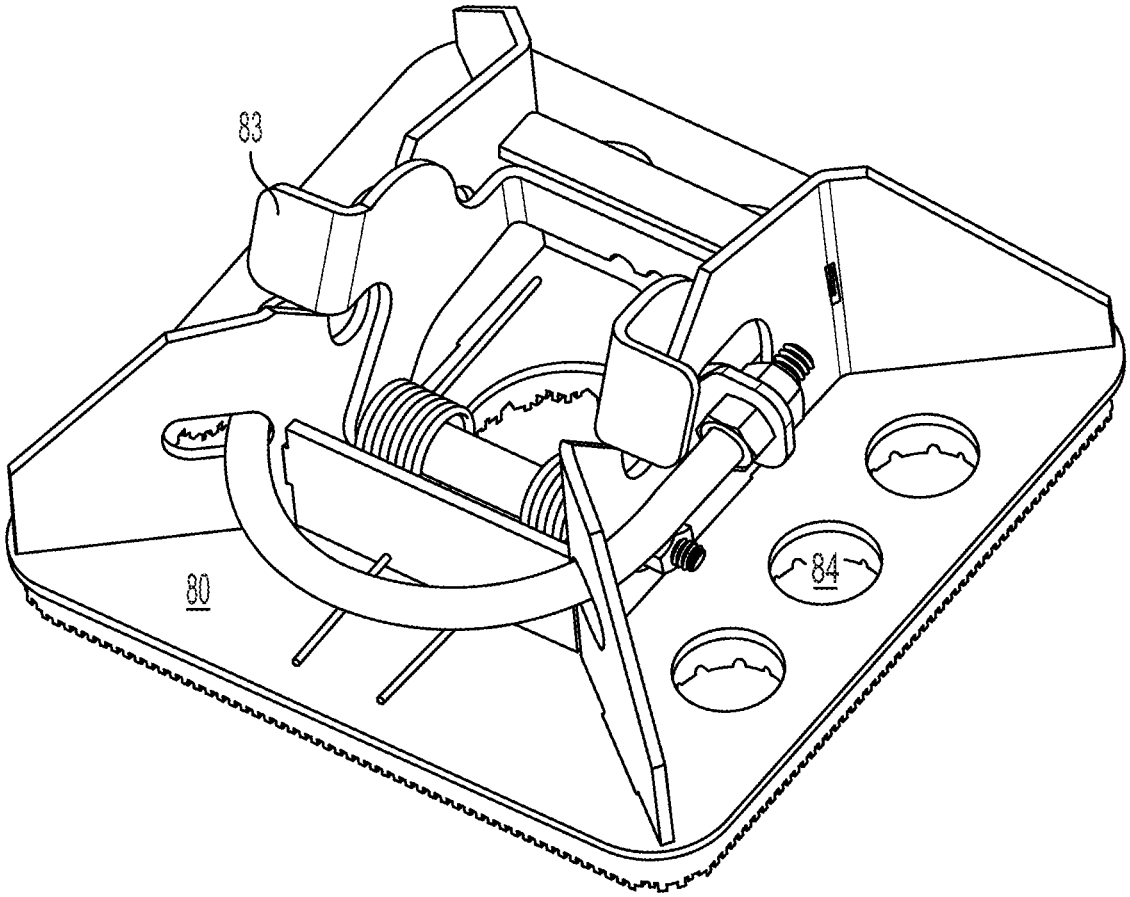

FIGS. 22 and 23 show a quick release foot assembly 80 for attachment to legs 20. Such quick release feet allow a high wind set up and tear down procedure, where the feet 80 are removed from the legs 20 before setup, attached to the shelter's floor and securely anchored to the ground through apertures 84. When the frame is erected, horizontal cylindrical extensions (not shown) on the legs 20 snap into slots 86 in the pre-anchored feet 80 to be held in place by spring-biased hinged arms 83, greatly reducing the risk of injury to personnel or damage to equipment. High wind take down is the opposite of set up, where the shelter feet can be released from the leg assembly by using a foot to force open arms 83, which allows a steady two-handed grasp on the leg at all times. Foot pads 80 are also sized to allow a low enough ground pressure, even with a snow loaded shelter, such that any ground capable of supporting a walking individual, or a vehicle driving on normal tires, is sufficient to support the shelter.

Figure 24:
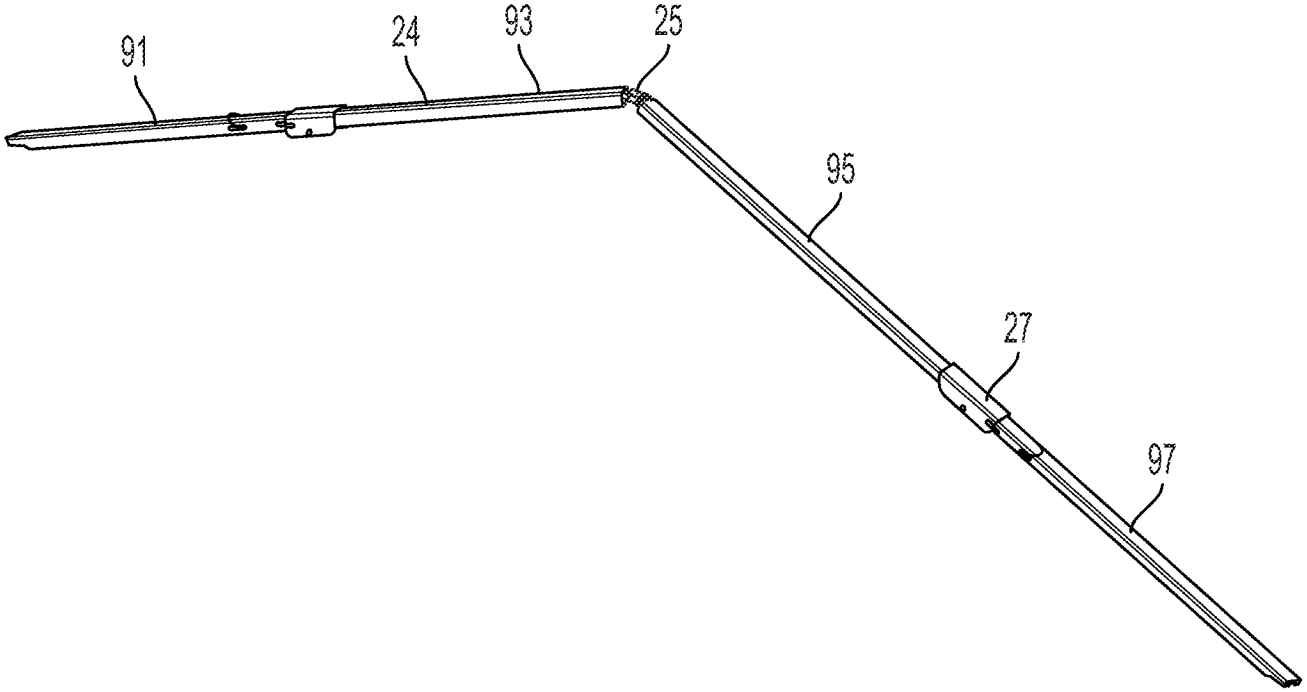
FIG. 24 is a perspective view of the midspan chord.
Figure 25:
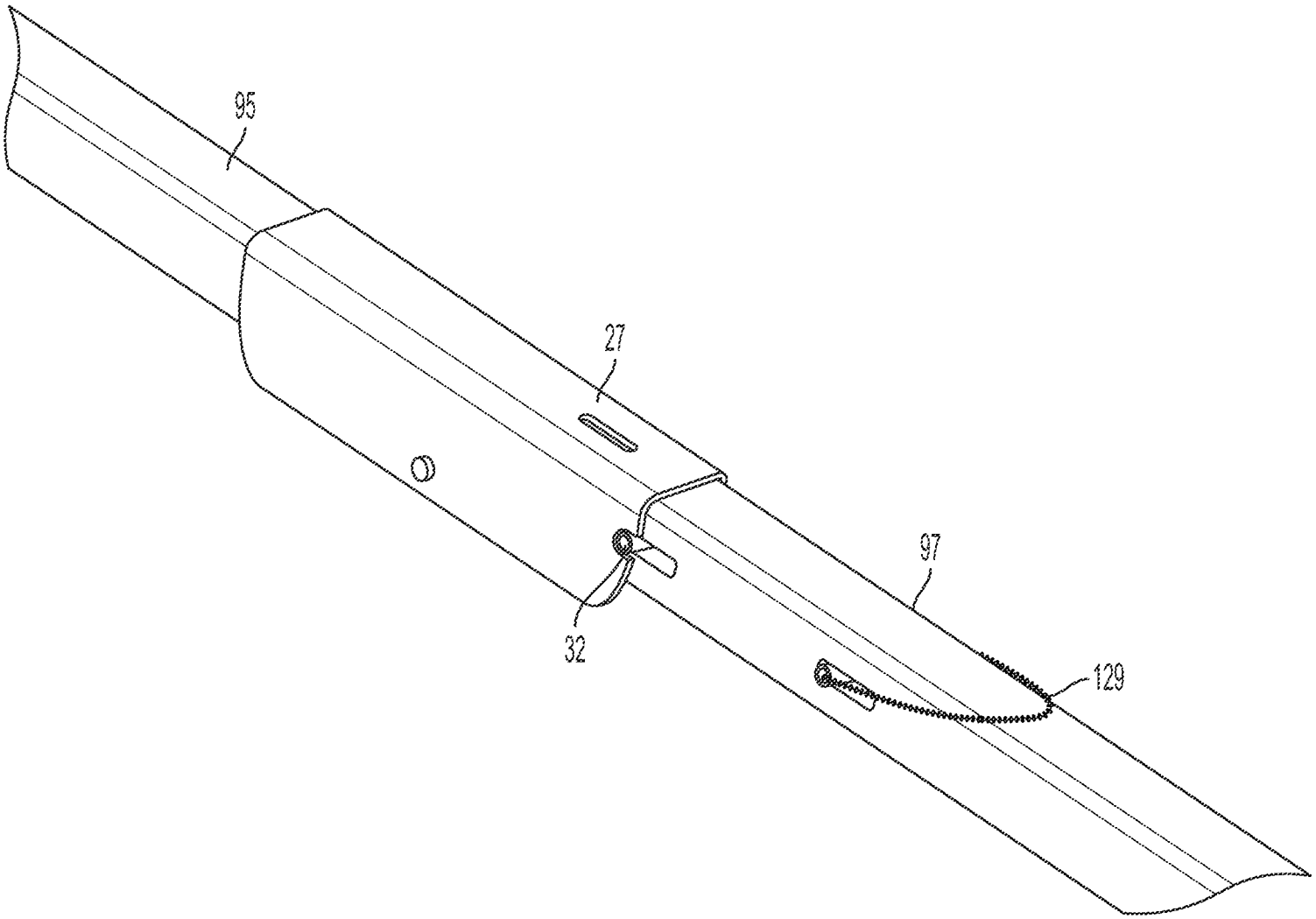
FIG. 25 is a detail perspective view of the midspan chord knee joint.
Figure 26:
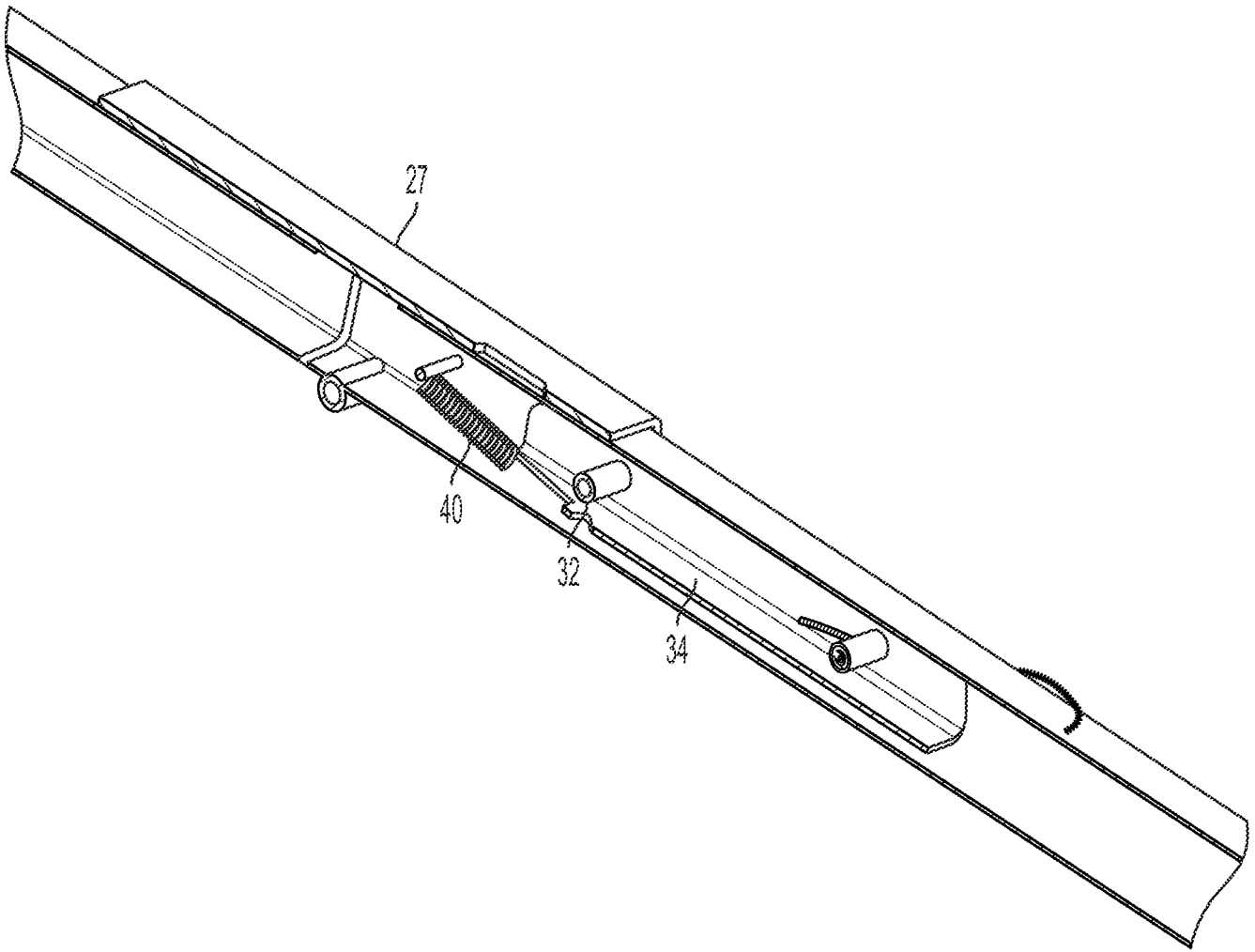
FIG. 26 is a detail perspective view partially in cross-section showing the midspan chord knee joint with lock slider.
Figure 27:
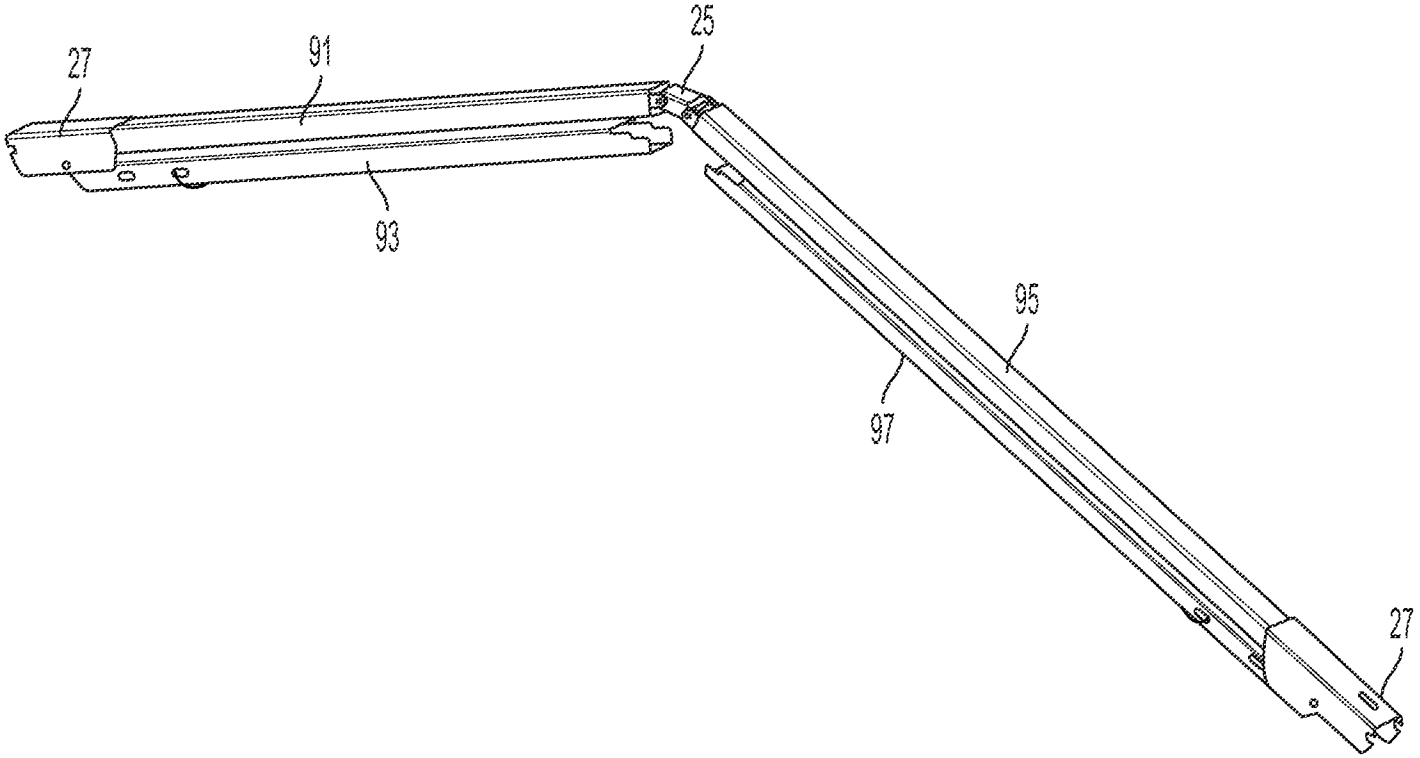
FIG. 27 is a perspective view of the midspan chord partially folded.
Figure 28:
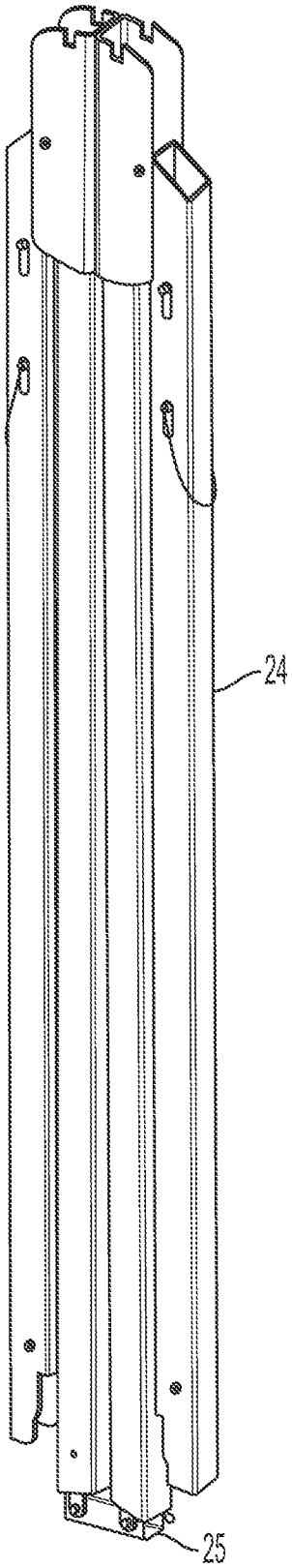
FIG. 28 is a perspective view of the midspan chord fully folded.
Figure 29:
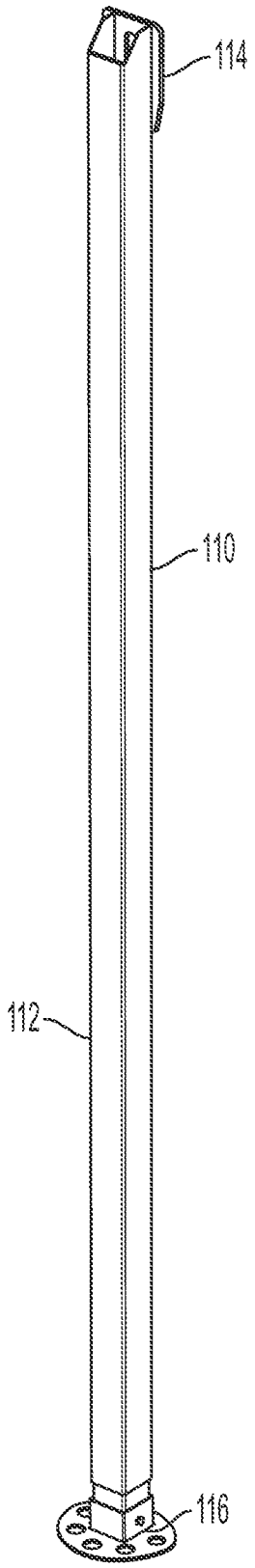
FIG. 29 is a perspective view of a telescoping wind kit post.
Figure 30:
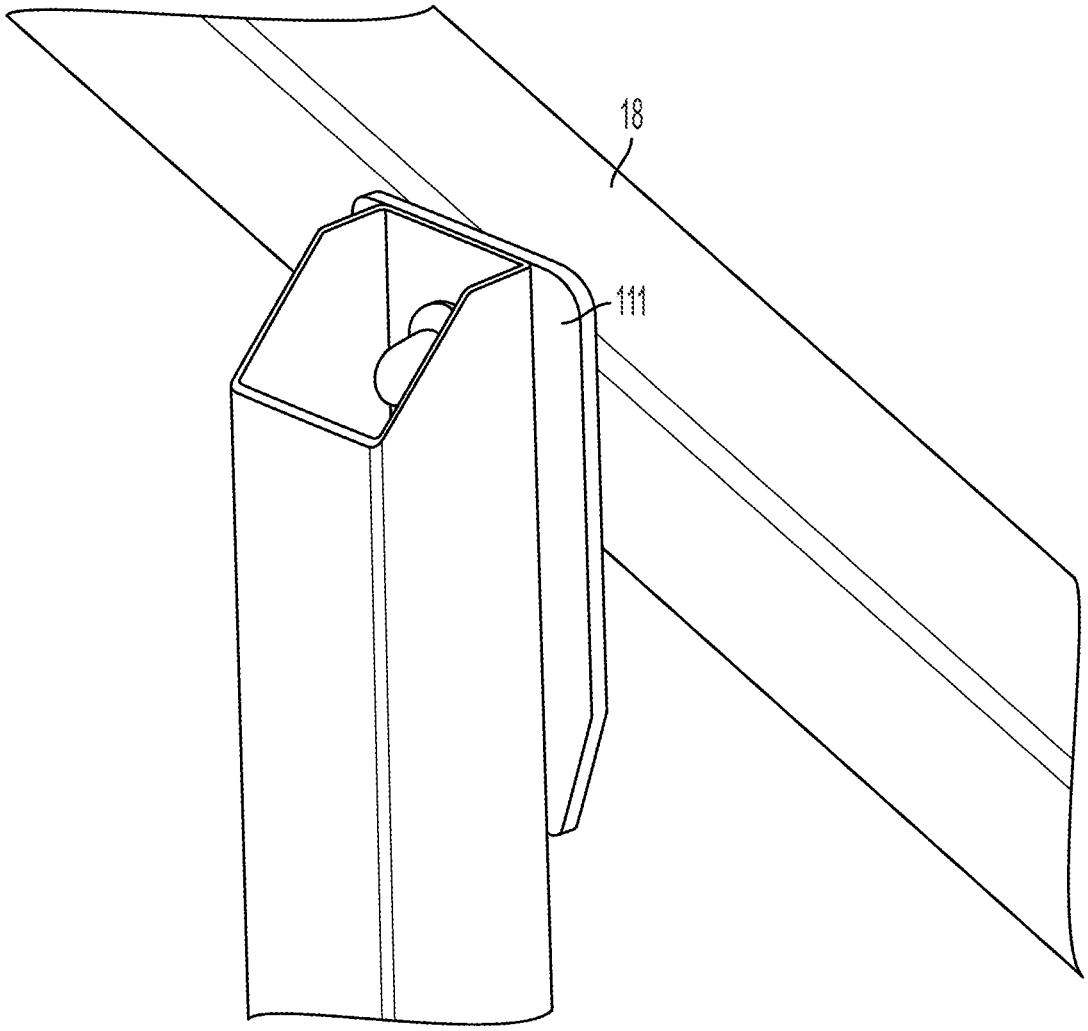
FIG. 30 is a detail perspective view of the wind kit post connection.
Figure 31:
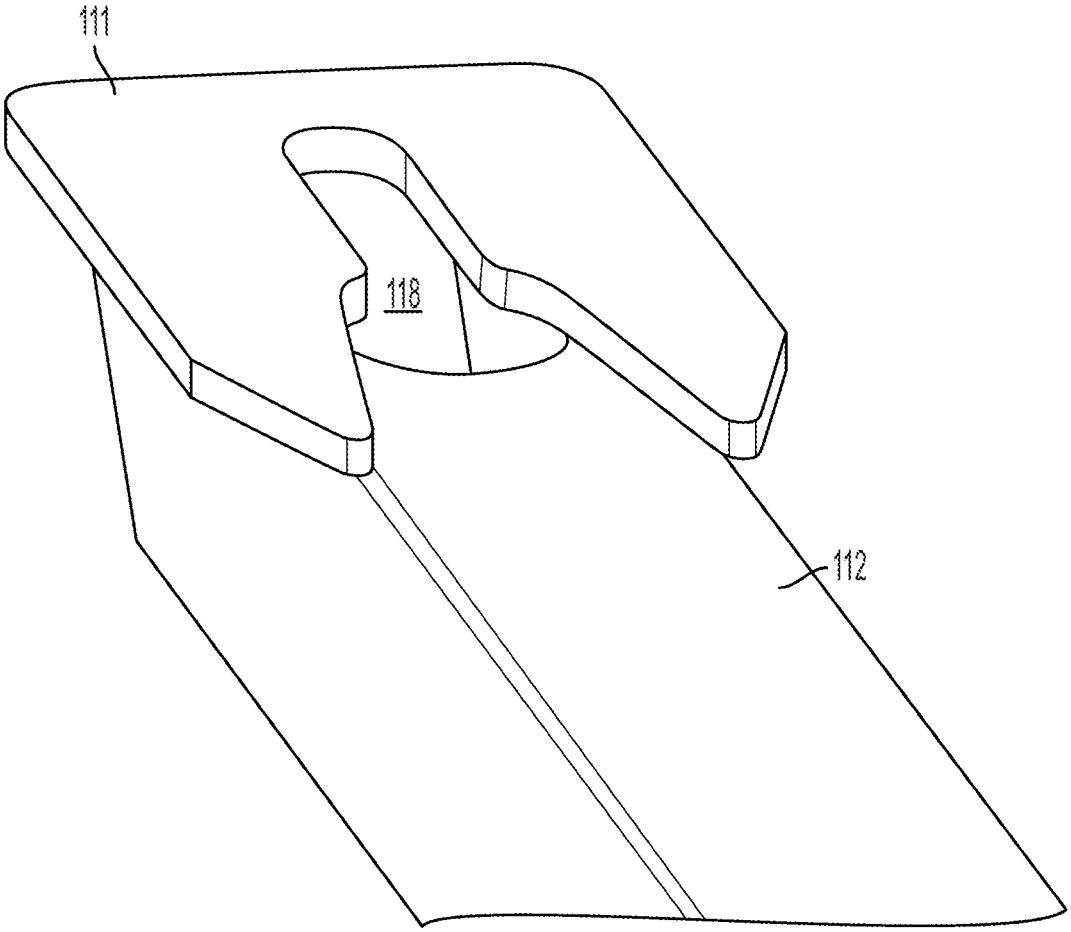
FIG. 31 is an isolated detail perspective view of the connecting bracket of the wind kit post.
Figure 32:
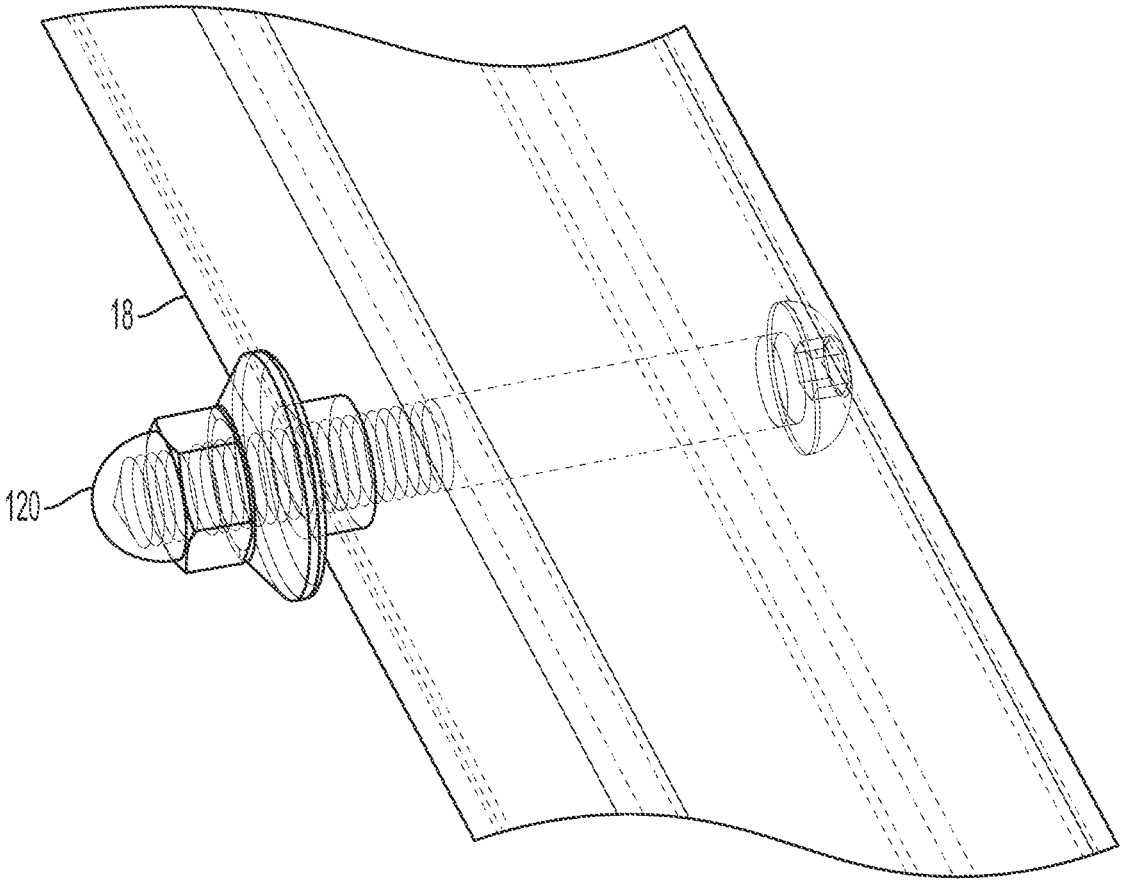
FIG. 32 is an isolated detail perspective view of the connecting fastener on the chord for the wind kit post.
Figure 33:
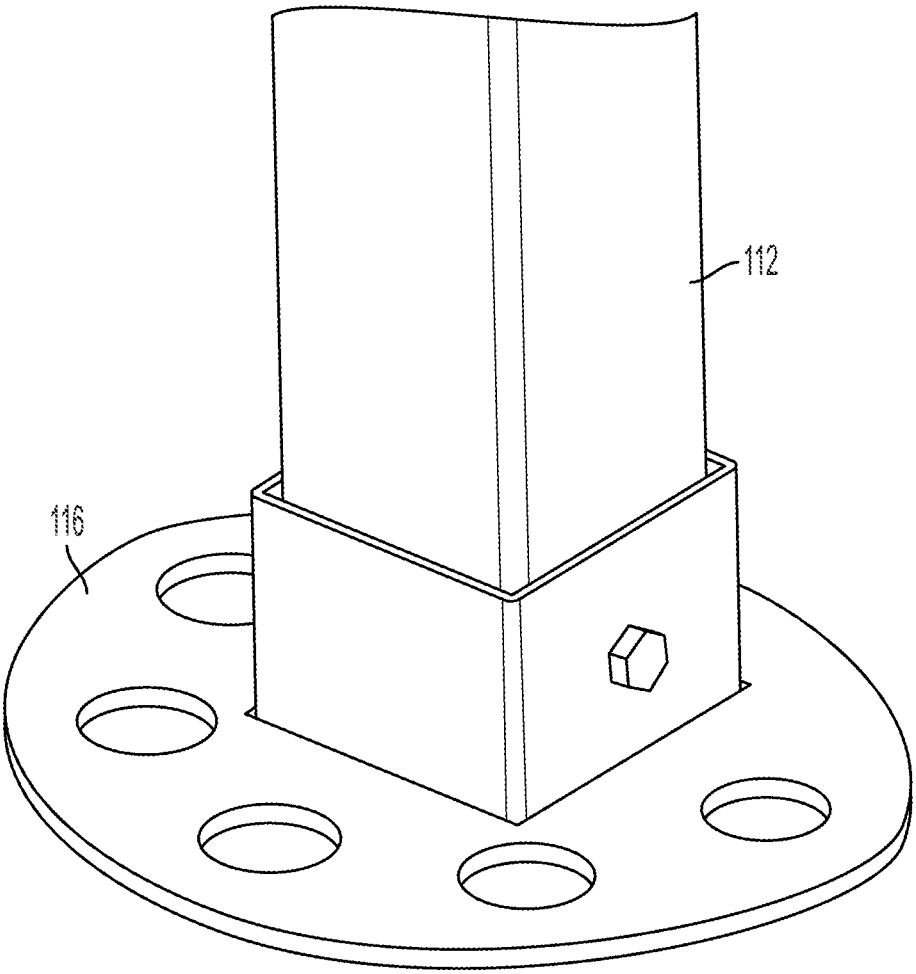
FIG. 33 is a detail perspective view of the wind kit foot.

Midspan chords 24 are shown in FIG. 24 through 28. Each chord 24 comprises a single folding element which, when unfolded as shown in FIG. 24, rests on upper frame assembly 12, with its central hinge 25 on peak purlin bracket 28 and its ends on lower purlin brackets 28. The midspan chord knee joints 27 fold and lock/unlock the chord sections 91, 93, 95, 97 in the same manner as the purlin knee joints 28, using cable 129 to unlock the joint.

A telescoping wind kit post 110 is illustrated in FIG. 29 through 33. Such posts can be attached to chords 18 at either end of the frame 10, in order to assist in securing the cover to the structure, as follows. Each post 110 has a telescoping vertical post 112, the interior telescopic section being secured at its lower end to wind kit post foot 116. At its upper end the post 112 is provided with a bracket 113 having a keyhole slot 118 which engages a bolt 120 on chord 18.

As shown in FIGS. 34 and 35, the size of the modular structure can be increased by increasing the number of chords 18, purlins 14 and peak brackets 16 in the upper frame assembly 12, with proportionate increase in the number of legs 20 and midspan chords 24. The resulting structure may thereby accommodate a two or four bays for equipment storage.

Figure 36:
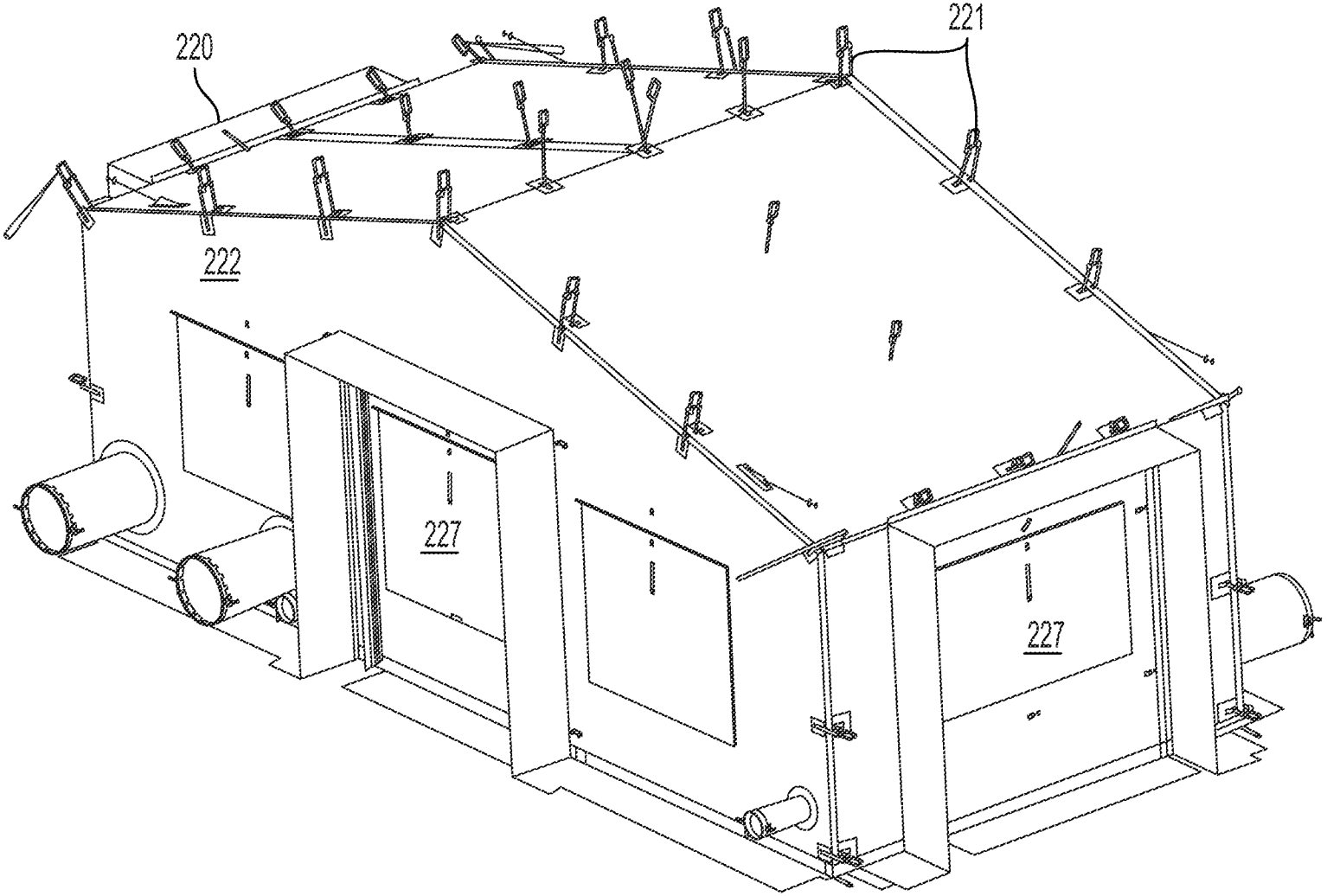
FIG. 36 is a perspective view of a completed cover for a one bay structure.
Figure 37:
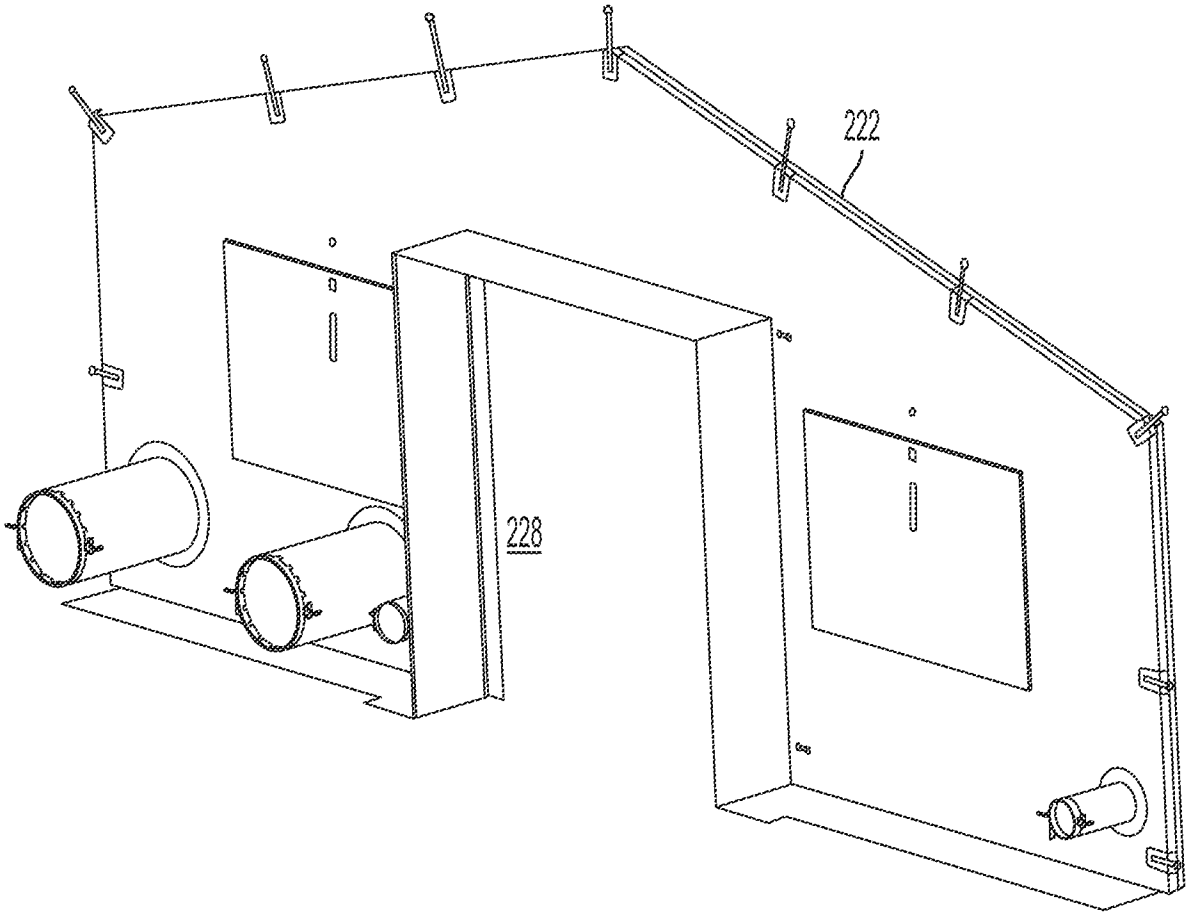
FIG. 37 is a detail perspective view of one endwall for the cover shown in FIG. 36.
Figure 38:
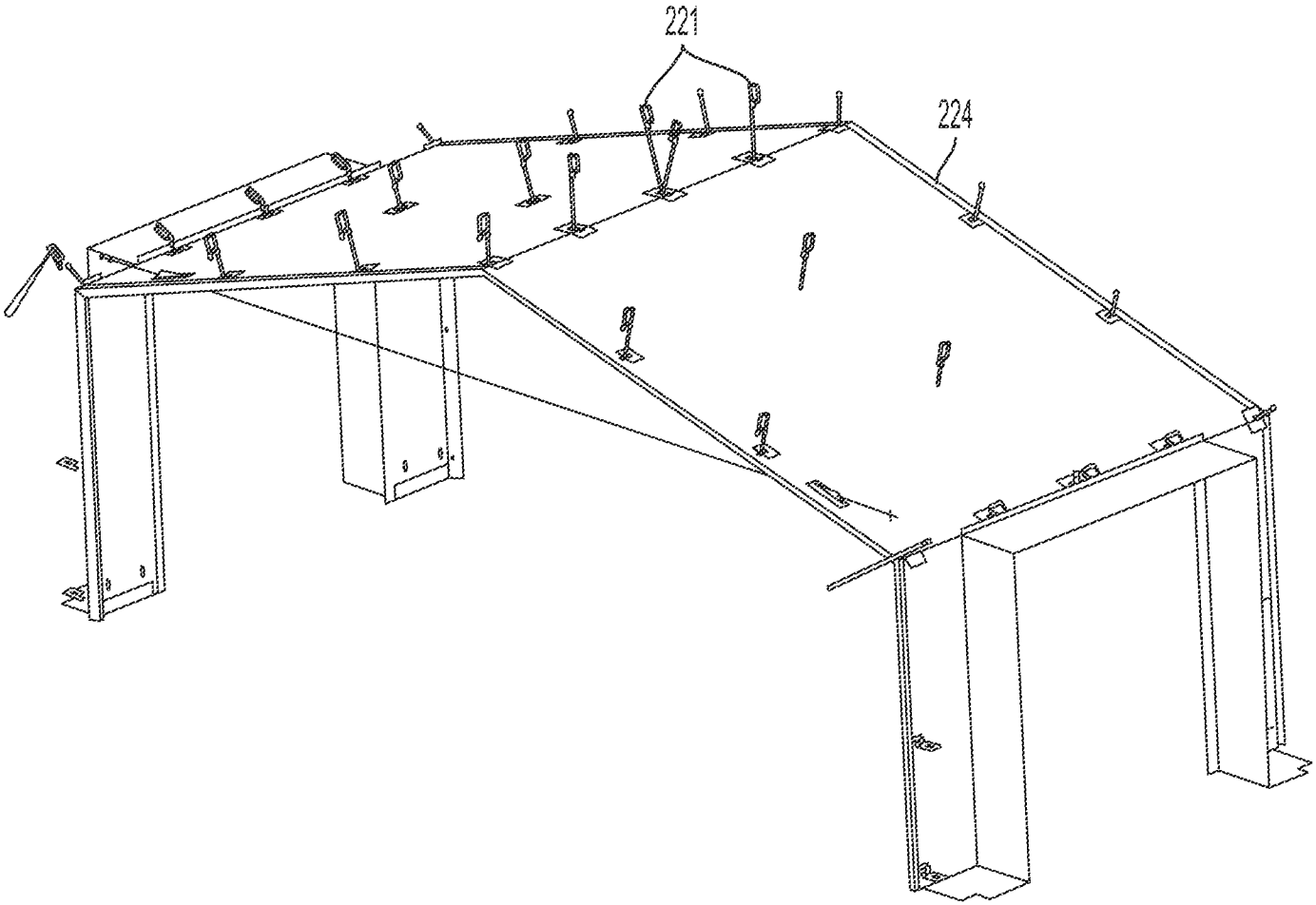
FIG. 38 is a detail perspective view of the barrel section for the cover shown in FIG. 36.
Figure 39:
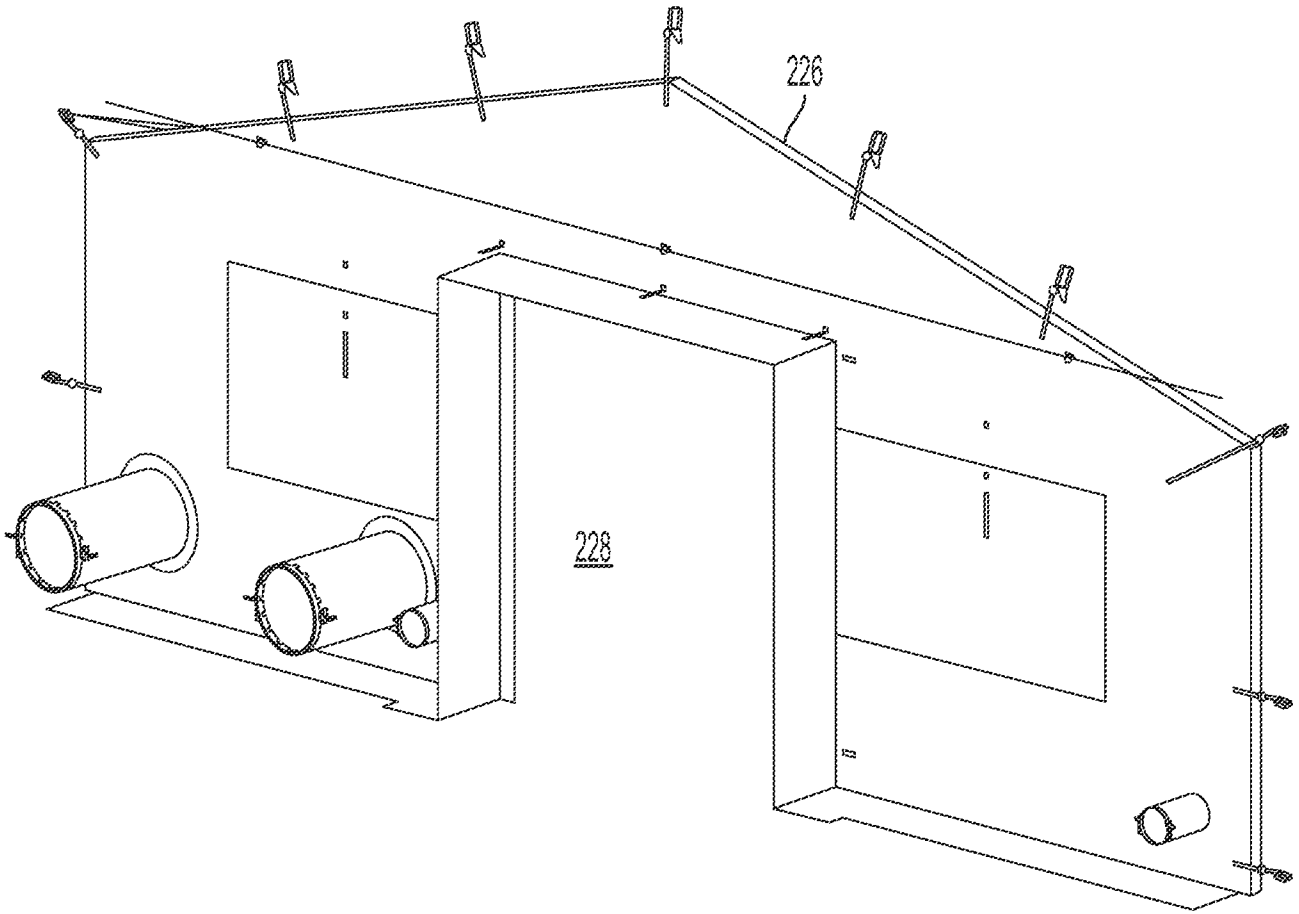
FIG. 39 is a detail perspective view of the second endwall for the cover shown in FIG. 36.
Figure 40:
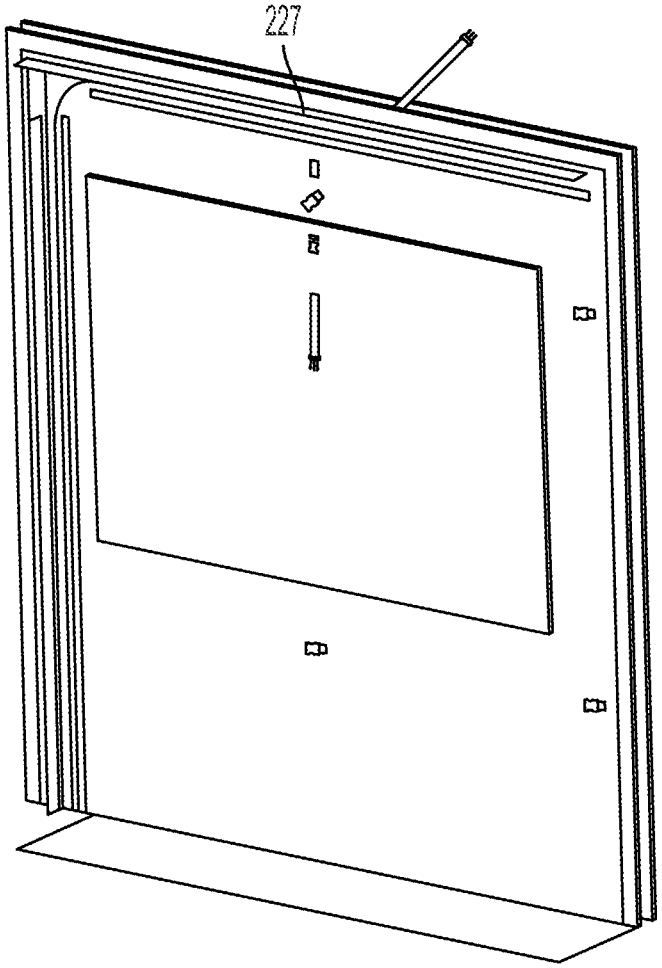
FIG. 40 is a detail perspective view of the exterior of a soft door assembly for the cover shown in FIG. 36.
Figure 41:
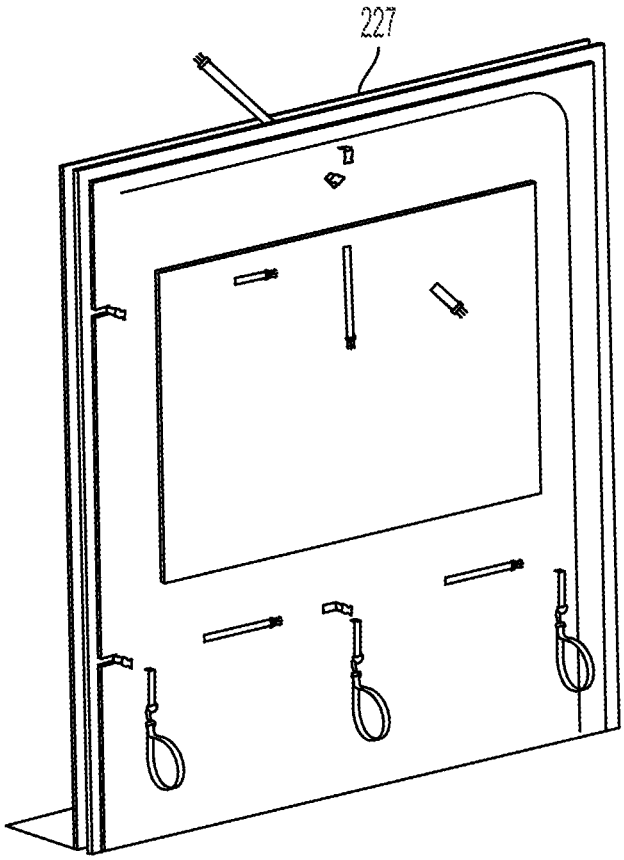
FIG. 41 is detail perspective view of the interior of the soft door assembly for the cover shown in FIG. 36.
Figure 42:
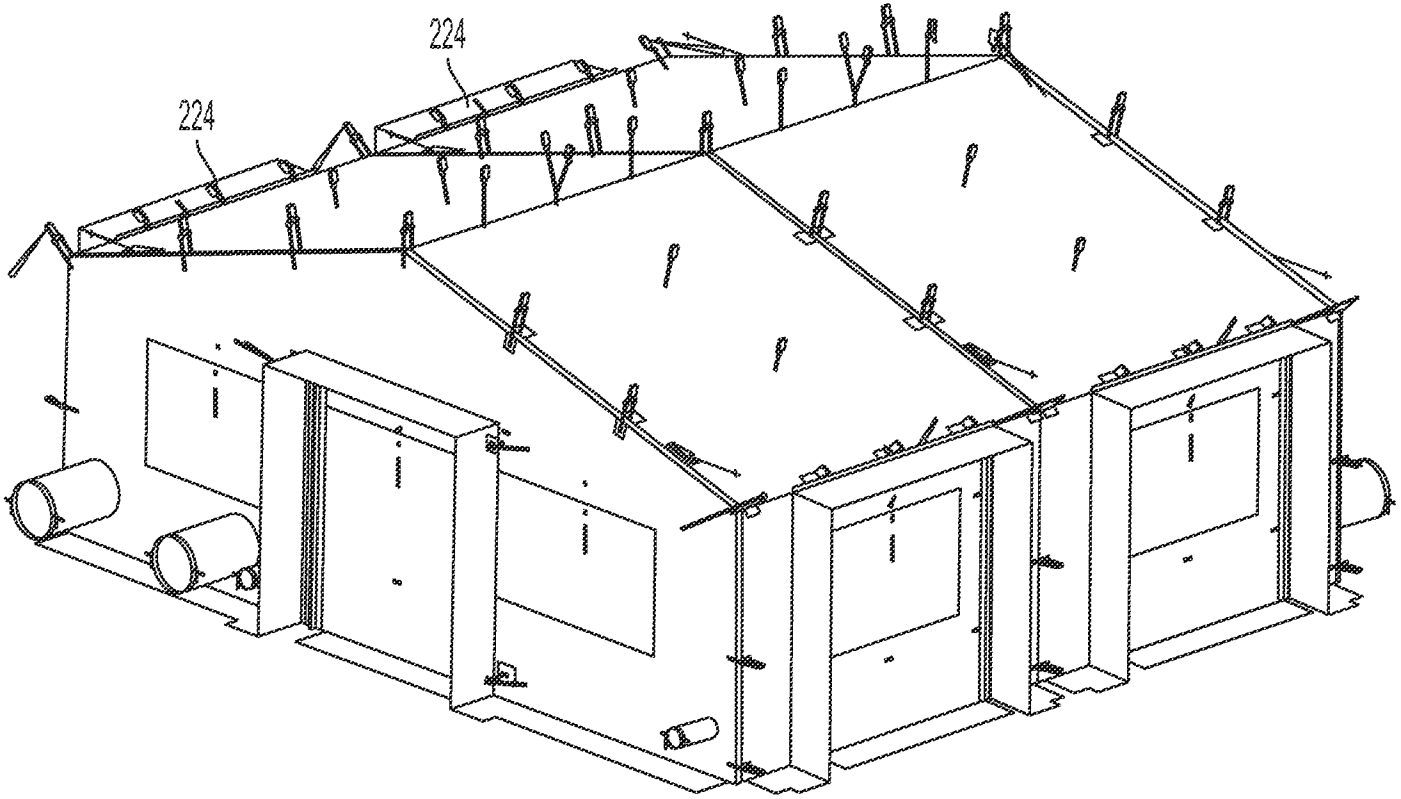
FIG. 42 is a perspective view of a completed cover for a two bay structure.
Figure 43:
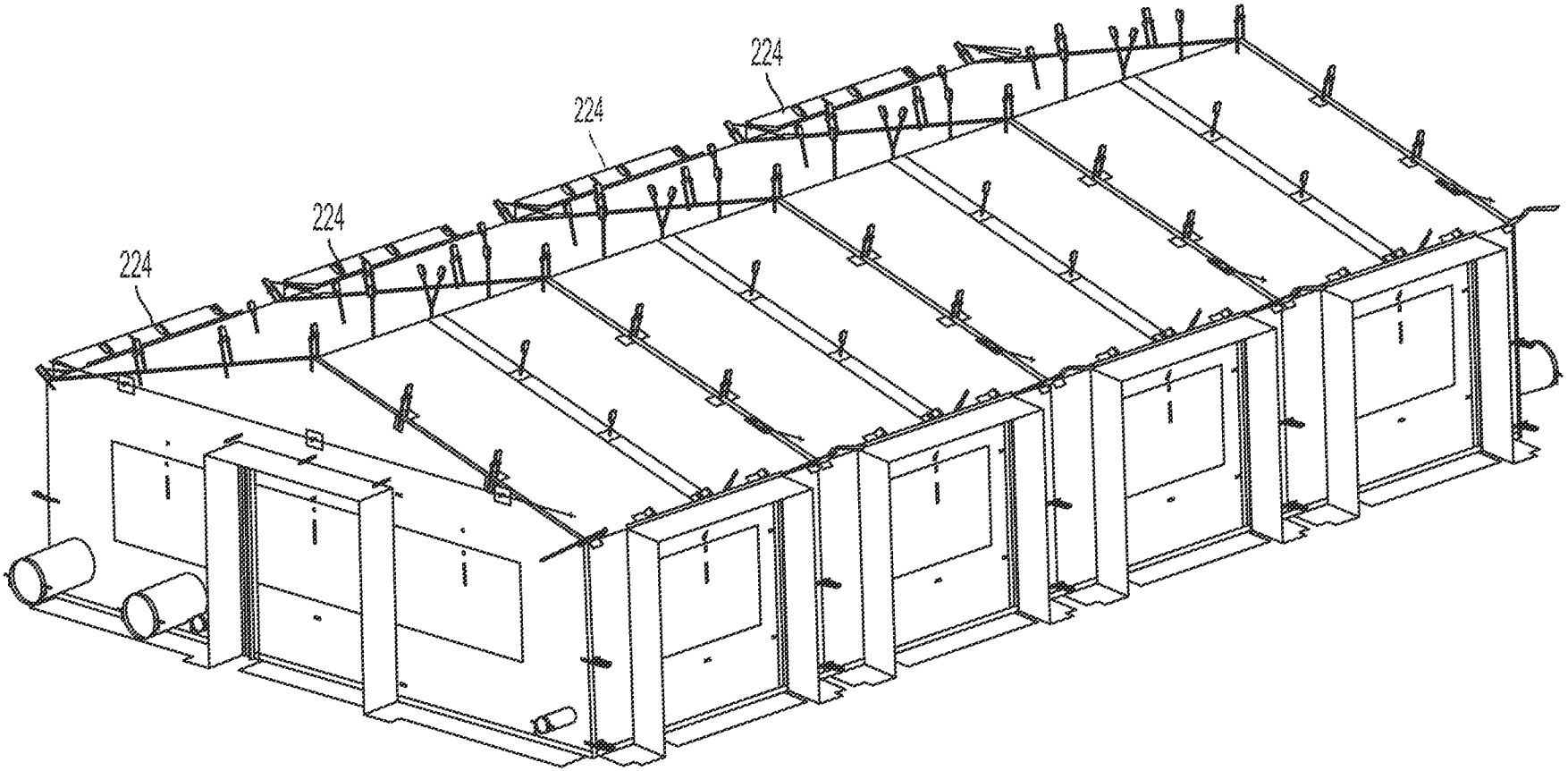
FIG. 43 is a perspective view of a completed cover for a four bay structure.

FIG. 36 illustrates a completed fabric cover 220 for the one bay structure whose frame 10 is shown in FIG. 1. It includes an endwall 222 shown in FIG. 37, a barrel section 224 shown in FIG. 38, and a second endwall 226 shown in FIG. 39. A soft door assembly 227 may be used for doors 228, whose exterior is shown in FIG. 40 and interior in FIG. 41. For the two bay structure shown in FIG. 42, two barrel sections 224 are used and four are used for the four bay structure shown in FIG. 43.

Figure 44:
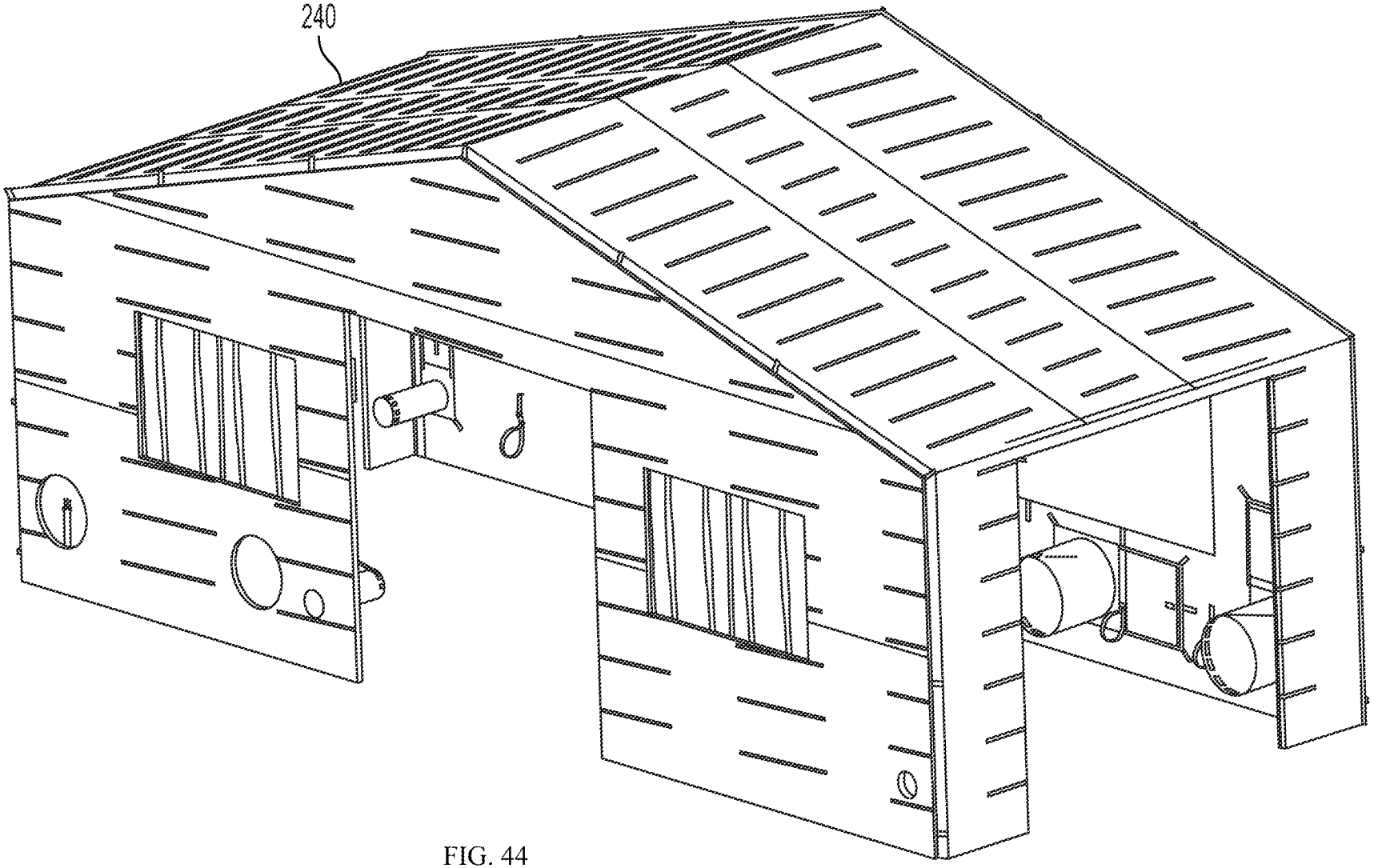
FIG. 44 is a perspective view of a removable insulation package for a single bay structure.
Figure 45:
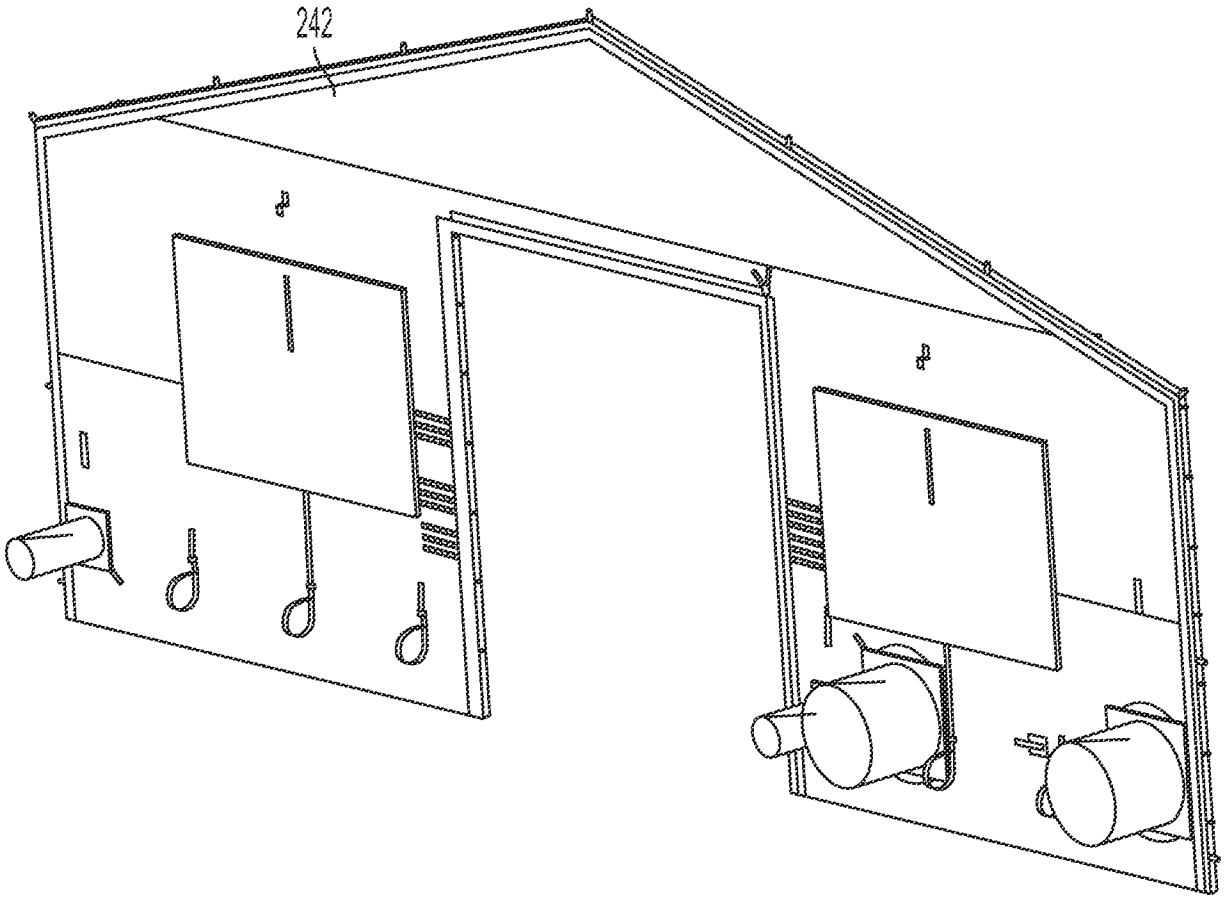
FIG. 45 is a perspective view of the endwall for the removable insulation package shown in FIG. 44, both endwalls being the same.
Figure 46:
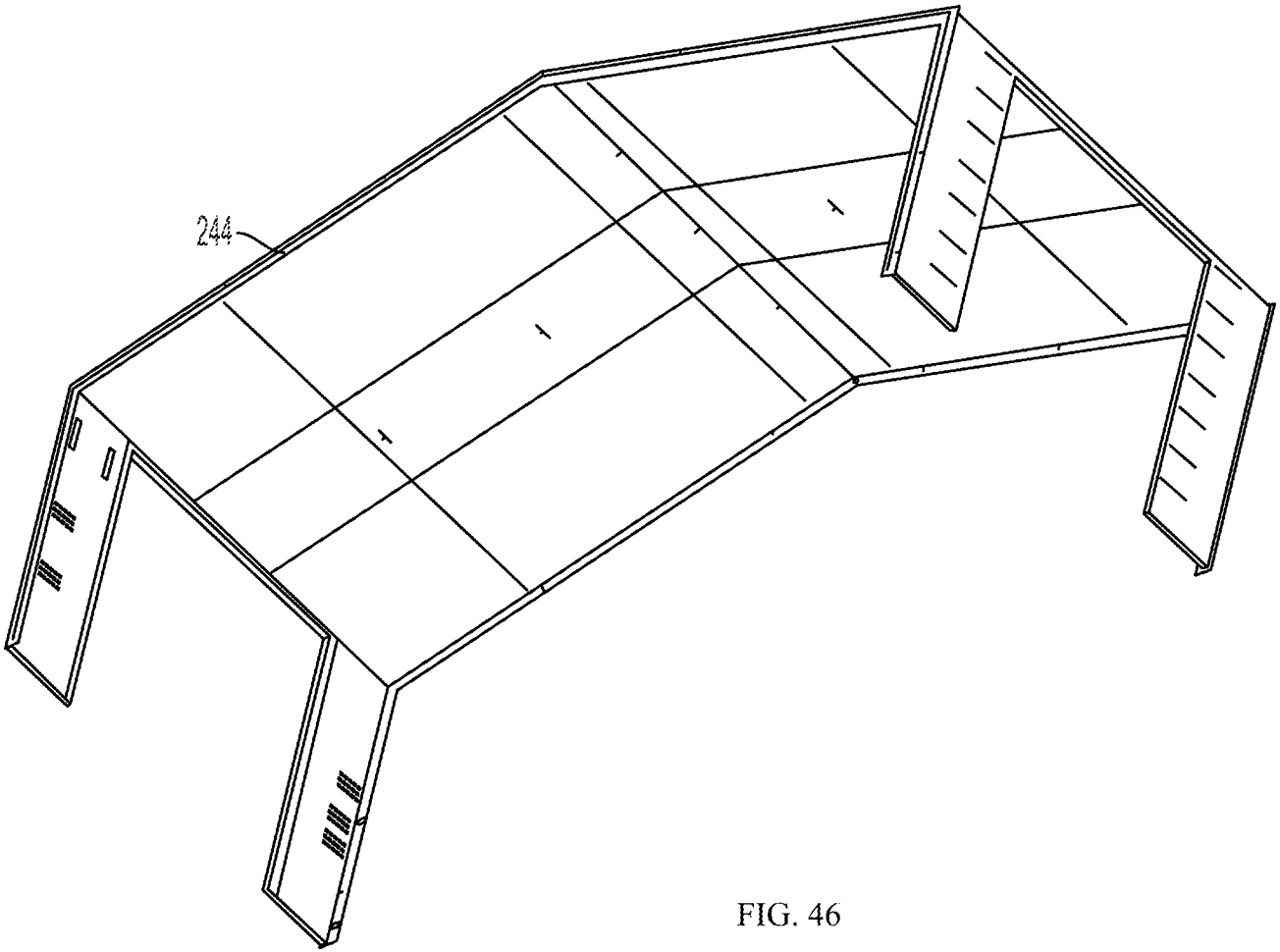
FIG. 46 is a perspective view of the barrel for the removable insulation package shown in FIG. 44.
Figure 47:
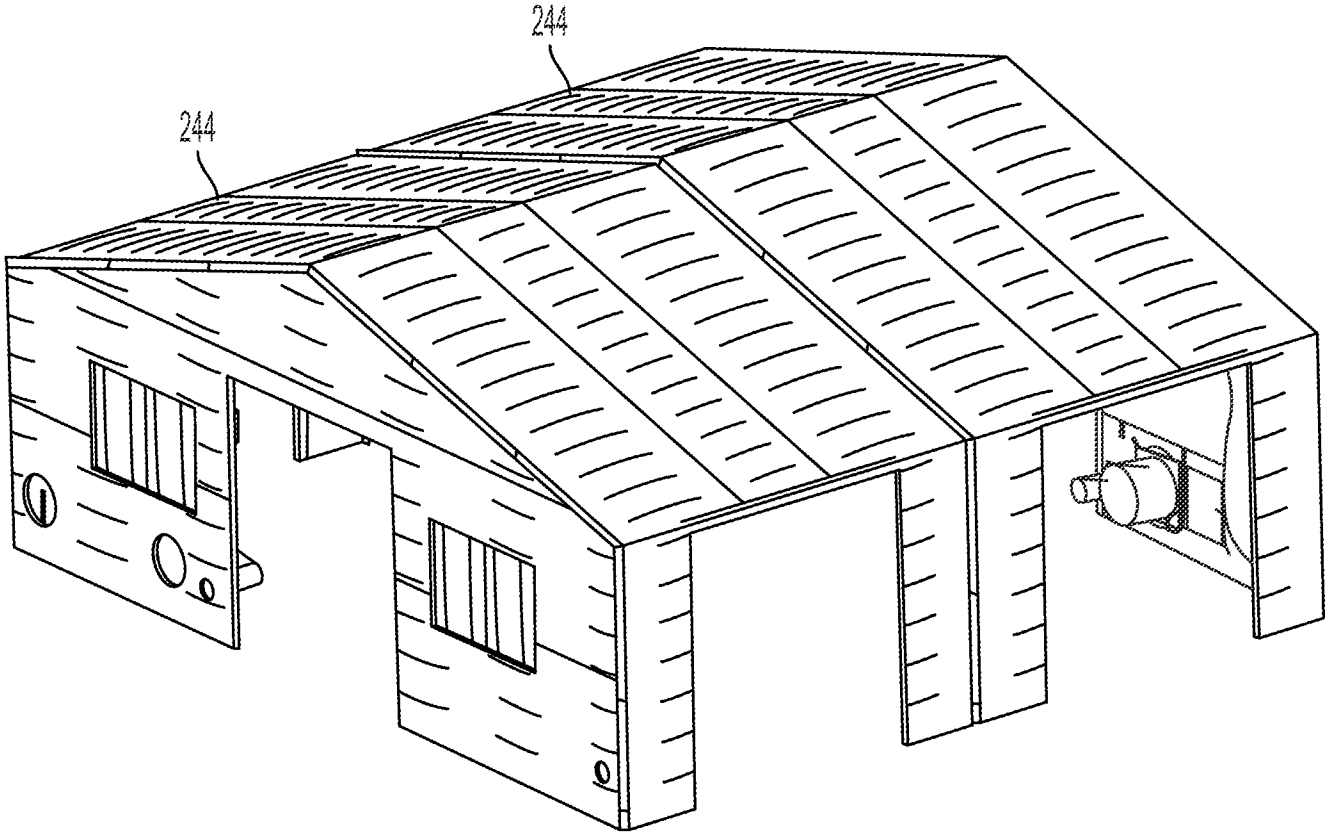
FIG. 47 is a perspective view of the removable insulation package for a two bay structure.
Figure 48:
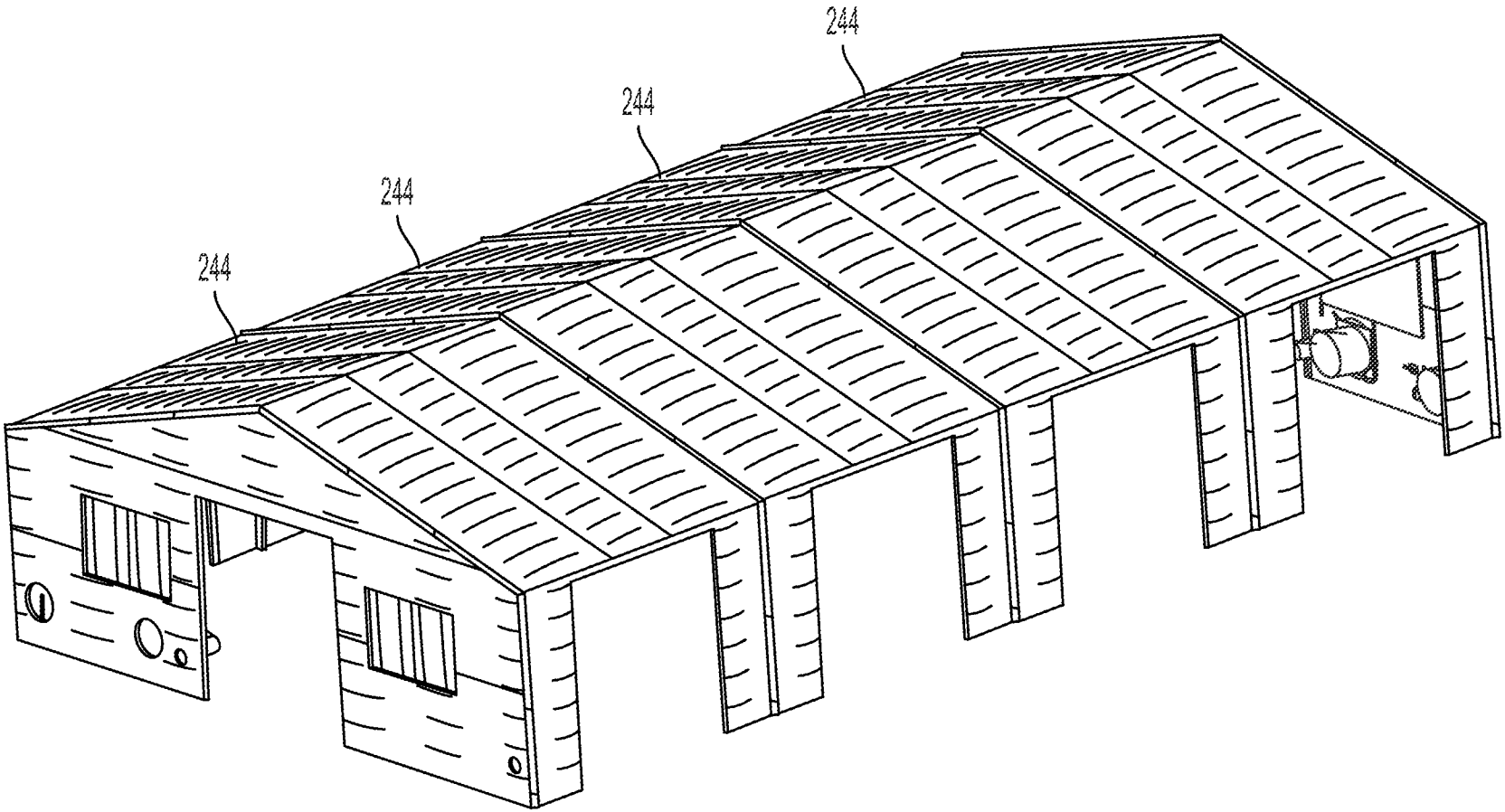
FIG. 48 is a perspective view of the removable insulation package for a four bay structure.

Insulation 240 can be added to the structure as shown in FIG. 44 for a single bay structure. It comprises two insulation endwalls 242 for the removable insulation package shown in FIG. 45, both endwalls being the same. The barrel 244 for the removable insulation package is shown in FIG. 46. Again for the two bay structure as shown in FIG. 47, two barrel sections 244 are used and four are used for the four bay structure shown in FIG. 48.

Figure 49:
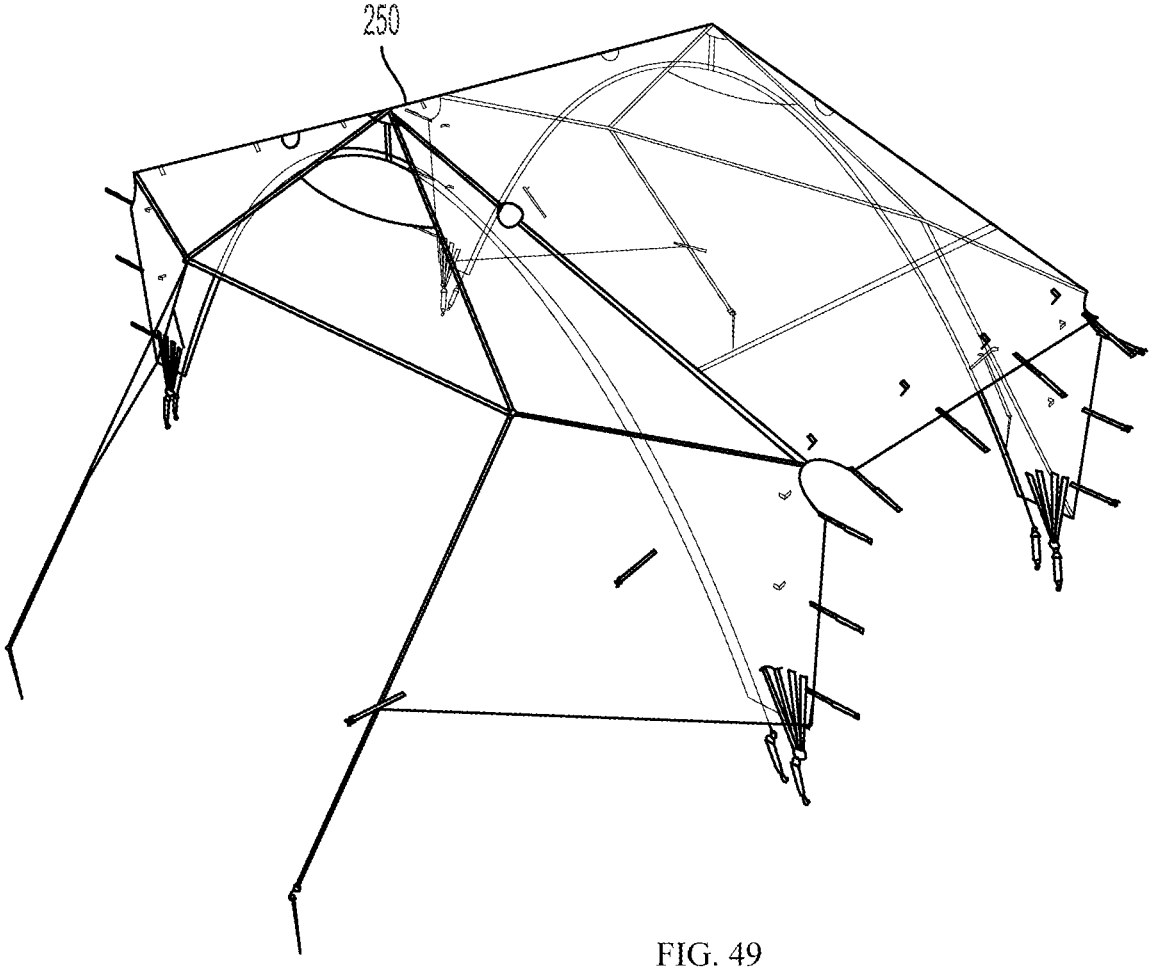
FIG. 49 is a perspective view of a solar shade for use with the shelter shown in FIG. 36.
Figure 50:
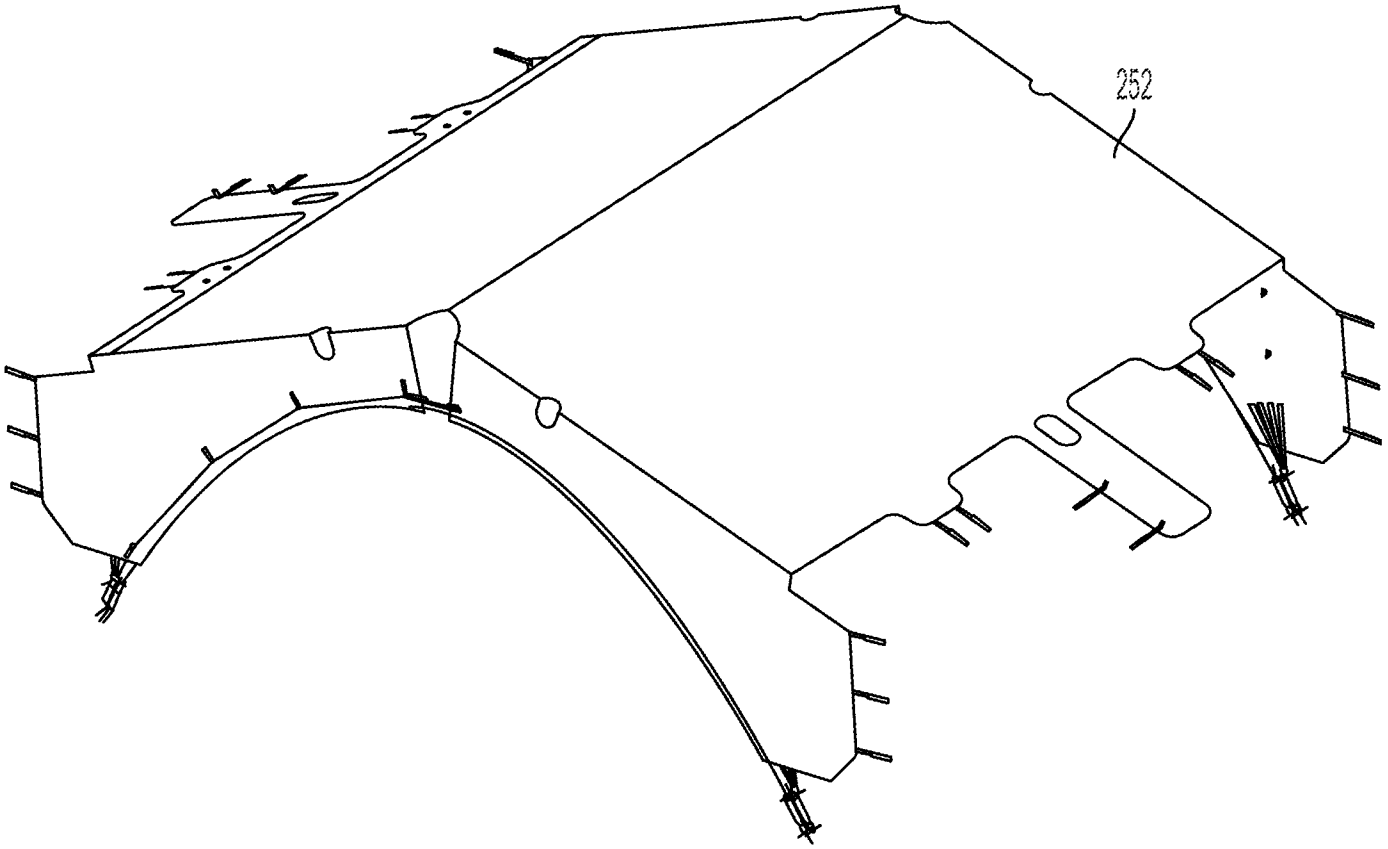
FIG. 50 is a perspective view of a winter fly for use with the shelter shown in FIG. 36.

FIG. 49 illustrates a solar shade 250 for use with the one bay shelter shown in FIG. 36, and FIG. 50 illustrates a winter fly 252 for use with the one-bay shelter. Both assemblies are tensioned just at the gable ends with a parabolically curved wire rope which is anchored to the feet on the corner legs. This wire rope acts similarly to the main support cable in a tension bridge, only inverted. This makes fitment and proper tensioning simpler.

The fabric cover 220 can be attached after the frame has been erected. Fabric cover 220 may be suspended from the frame elements using fasteners such as hooks or hook and loop fasteners 221 and in particular close haul j-hooks 29 at the eaves as previously noted above. Fabric dry bag style port closures are preferred. PALS (Pouch Attachment Ladder System)/Modular Lightweight Load-carrying Equipment i.e. PALS/MOLLE webbing attachment patches as universal hardware mounts may be incorporated. Universal webbing strip/patches may be sewn into the ceiling for attaching accessories such as air distribution ducts, lights, room dividers, etc. Glow in the dark, reversible, fabric exit signs may be used. Double layered windows allow visibility without losing insulating air gap between cover and insulation layer.

FIG. 51 through 63 illustrate a further variation of a tent-based shelter system using rapidly deployable frame elements. In this embodiment the leg elements are modified to facilitate set-up of the shelter particularly in high winds. The leg elements comprise sliding rather than folding elements. The main body of the leg is always the full length and the portion of the leg to which the roof frame attaches to is able to slide up and down the main leg body. In this way the roof section and attached tent fabric can be assembled at the ground level and attached to the slidable leg section in lowered position with the main leg sections secured to the ground at their base. The roof and tent assembly can then be raised by sliding the slidable leg section up the main leg section. This facilitates assembling the tent, particularly in high winds. Also in this variation midspan chords are replaced in the roof frame by removable purlins which run in the opposite direction to the midspan chords previously disclosed.

Figure 51:
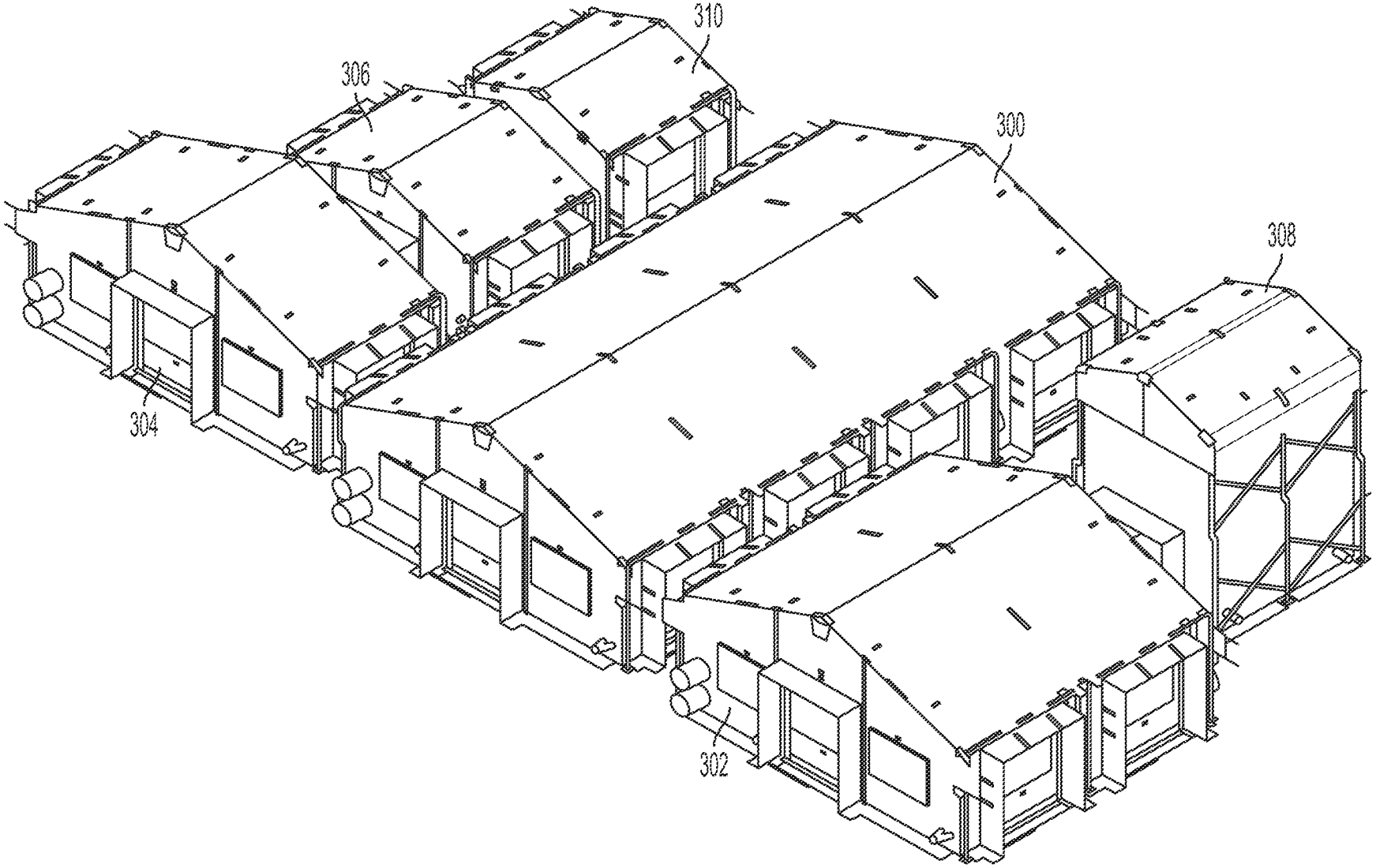
FIG. 51 is a perspective view of a further embodiment of a tent-based shelter system designed for rapid erection and mobility to perform under adverse environmental conditions.

With reference to FIG. 51, as in the previous embodiment there is disclosed a tent-based shelter system designed for rapid erection and mobility to perform under adverse environmental conditions. The system can be configured for example as a deployable command post, accommodation, medical facility or as operations and command centres for disaster relief, for example. For handling and stowage, the shelter system breaks down into various packed bags that are small and light enough for users to carry and pack.

Figure 52:
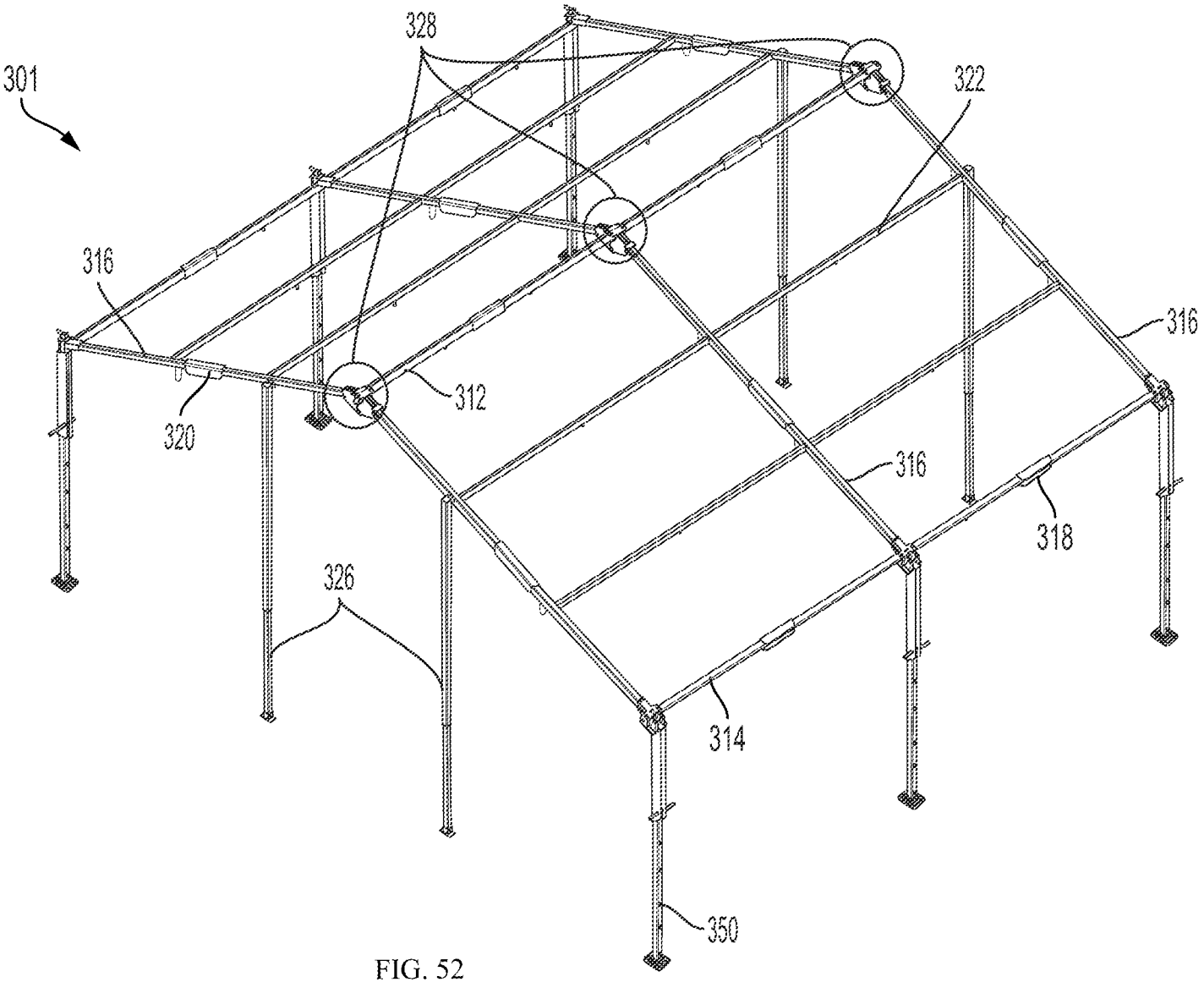
FIG. 52 is a perspective view of a 2-module frame used in the tent-based shelter system as shown in FIG. 51.

The different shelter modules provided in the system, using common components, are shown in FIG. 51 in a standard configuration, however the particular arrangement may be changed to suit the particular requirements of the deployment. The system includes the following shelter modules: 4-module shelter 300; 2-module shelter 302; 1-module shelter 304; 4-Door Hub 306 for shelter interconnection; Vehicle Interface shelter 308; and entrance Vestibule 310. As in the previous embodiment, the shelter system is a self-standing, external-frame all-weather tent system. The tent frame is the structural component of the shelter and is external to the tent, with the tent body suspended under the frame. This external frame design provides significant advantage for deployment and tear-down timing. The frame for the various modules is designed with a minimum number of unique parts. The 2-module frame 301 is shown in FIG. 52 as exemplary, however the assembly concept is the same for all of the frames. The primary difference between the various frames is the number of arch sections and legs used to accommodate the length of the shelter. The illustrated 2-module shelter frame 301 shows the three-arch folding frame 301 supported on six telescoping legs 350 and four end stanchions 326. The folding frame includes the arches 316, ridge beams 312, and eave beams 314. Each arch and beam section is hinged to allow folding for stowage. The frame 301 is preferably constructed of powder coated aluminum for reduced weight and corrosion protection.

Figure 62A:
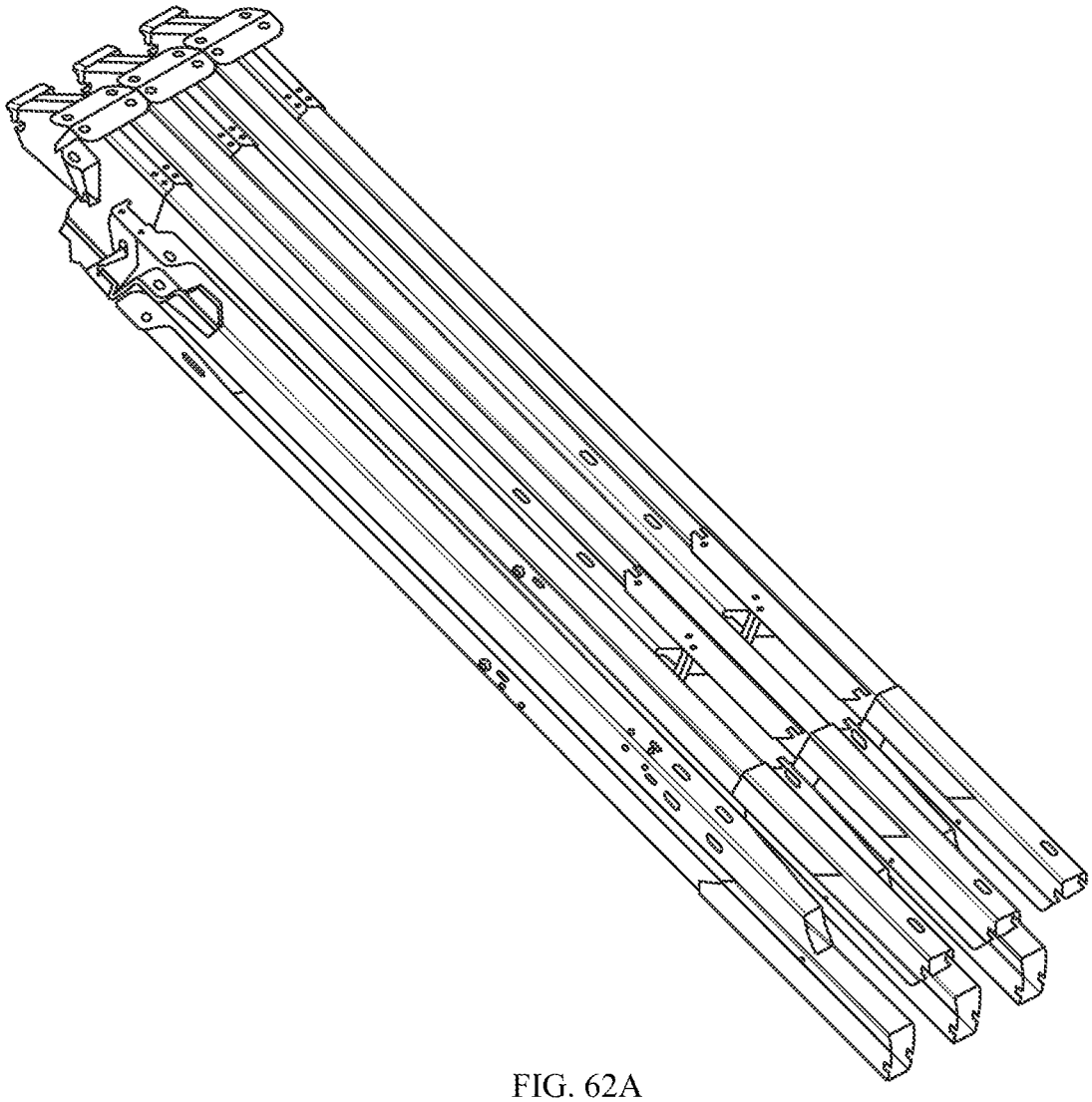
FIG. 62A-F is a series of schematic drawings illustrating the initial steps in the assembly process for the 2-module shelter.

The basic frame assembly 301 in this embodiment consists of folding beams (horizontal elements that form the ridge beam 312 and eave beams 314), and folding arches 316 (sloping beams that join the ridge and eave beams 312, 314). Each beam and arch has a latched hinge 318, 320 at its mid-point allowing the entire assembly to fold to minimize its size for transportation and storage as shown in FIG. 62A. Arches 316 are hingedly connected to ridge beam 312 at peak brackets 328. Once the main frame is unfolded during deployment, separate removable purlins 322 are secured between the arches 316 to provide additional rigidity to the frame and support points for the roof fabric. The beam and arch latched hinges 318, 320 comprise automatic spring-loaded latches which automatically lock into place during erection. These are constructed as disclosed in the previous embodiment. The arch latches have a 'free' position during teardown, which resets itself into a primed position for subsequent deployment when the frame is fully collapsed. See FIG. 9-13. The beam latches must be held open while they are initially folded. See FIG. 25, 26.

The frame 310 is supported on legs 350 that attach by inserting them into brackets 368 (FIG. 60) at the junction of each arch and eave beam 316, 314. Separate endwall stanchions 326 attach to each end of the shelter to provide additional support for the end walls. The modular purlins 322 are beam elements installed between the arches 316, parallel with the eave and ridge beams 312, 314. The purlins 322 provide frame rigidity and support for the tent fabric. Endwall stanchions 326 at the end walls provide additional support for the tent fabric and hard door if installed.

Figure 53:
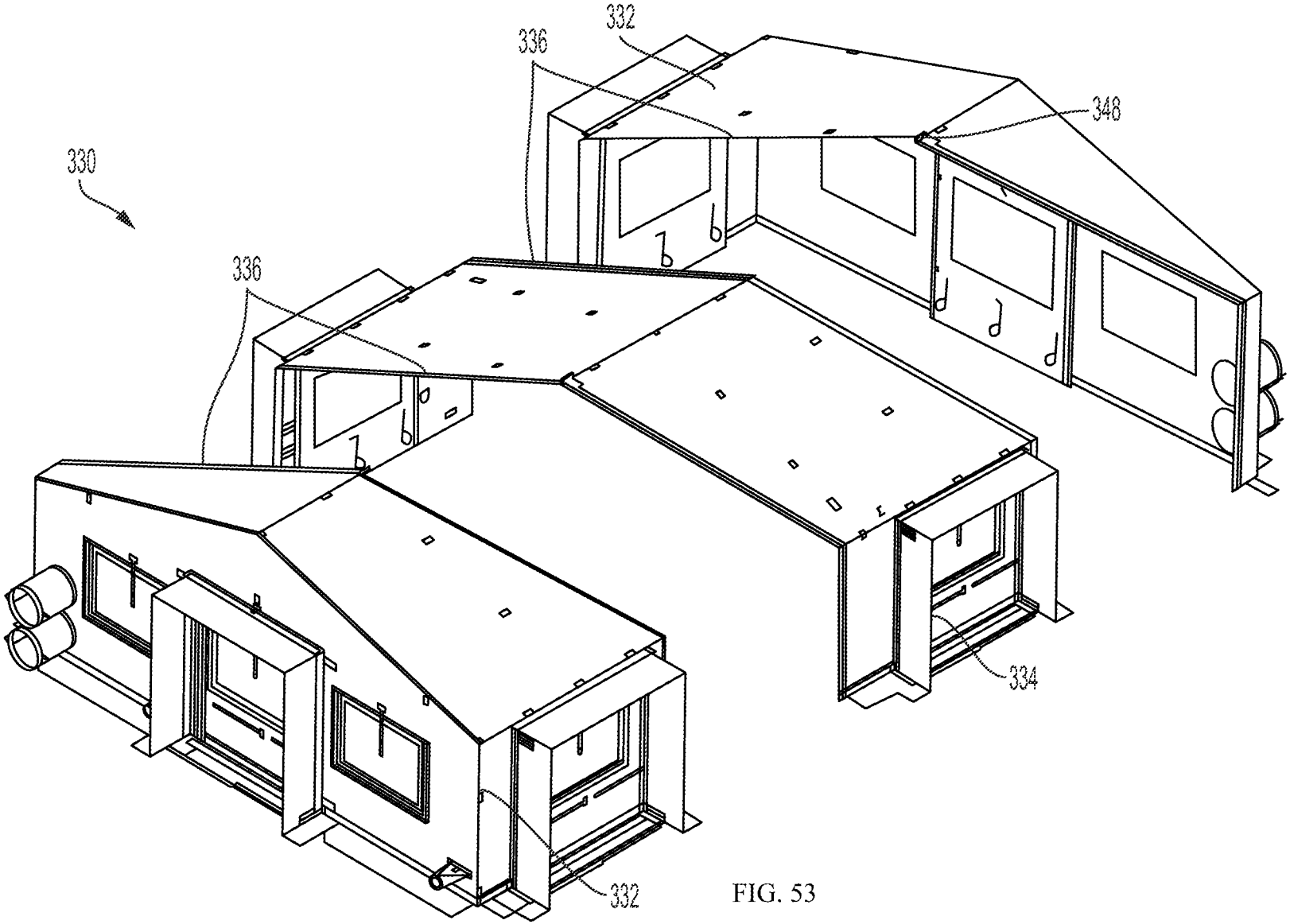
FIG. 53 is a perspective view of the tent body for the 2-module frame used in the tent-based shelter system as shown in FIG. 51 with sections separated.

The tent body 330 as shown for the 2-module shelter in FIG. 53 is preferably made of military-grade fabric and integrates wall and roof sections. The 1-module, 2-module, and 4-module shelters use multi-part fabric bodies as shown in FIG. 53. The multi-part bodies are composed of endwall sections 332 and barrel sections 334 where required to add length. The 1-module shelter uses two endwall sections 332 directly joined together. The 2-module shelter uses one barrel section 334 between the endwall sections 332 to provide the required length (as illustrated) and the 4-module shelter uses three barrel sections 334. The endwall and barrel sections are joined using heavy-duty zippers 336 which start at the roof peak 338. The section roof panel edges are diagonal in order to facilitate a modular design with identical endwall and barrel sections 332, 334. The connecting edges of each endwall and barrel are identical so that they may be joined in any sequence—there is no front or back orientation. This design simplifies deployment compared to other systems that have directional connections and must be oriented in a specific way in order to assemble.

Figure 54:
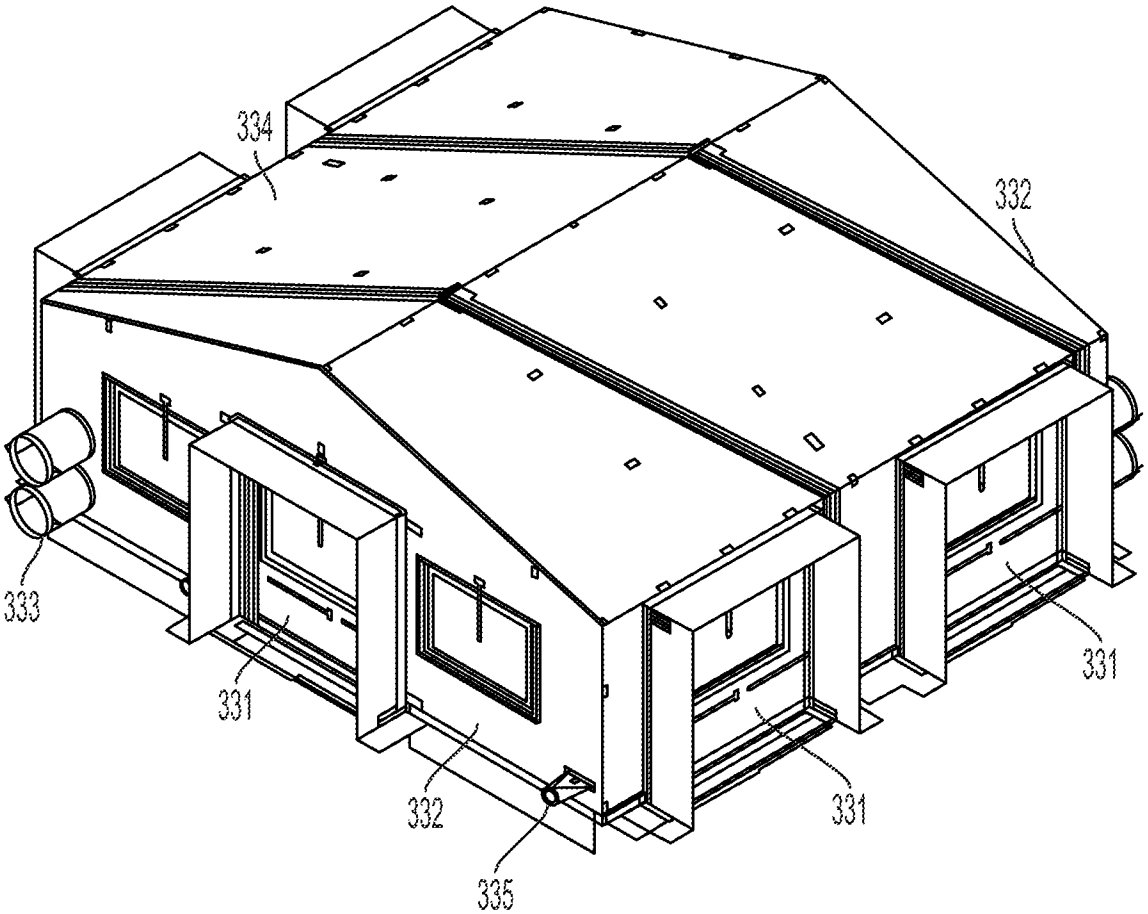
FIG. 54 is a perspective view of the assembled tent body for the 2-module frame used in the tent-based shelter system as shown in FIG. 51.
Figure 55:
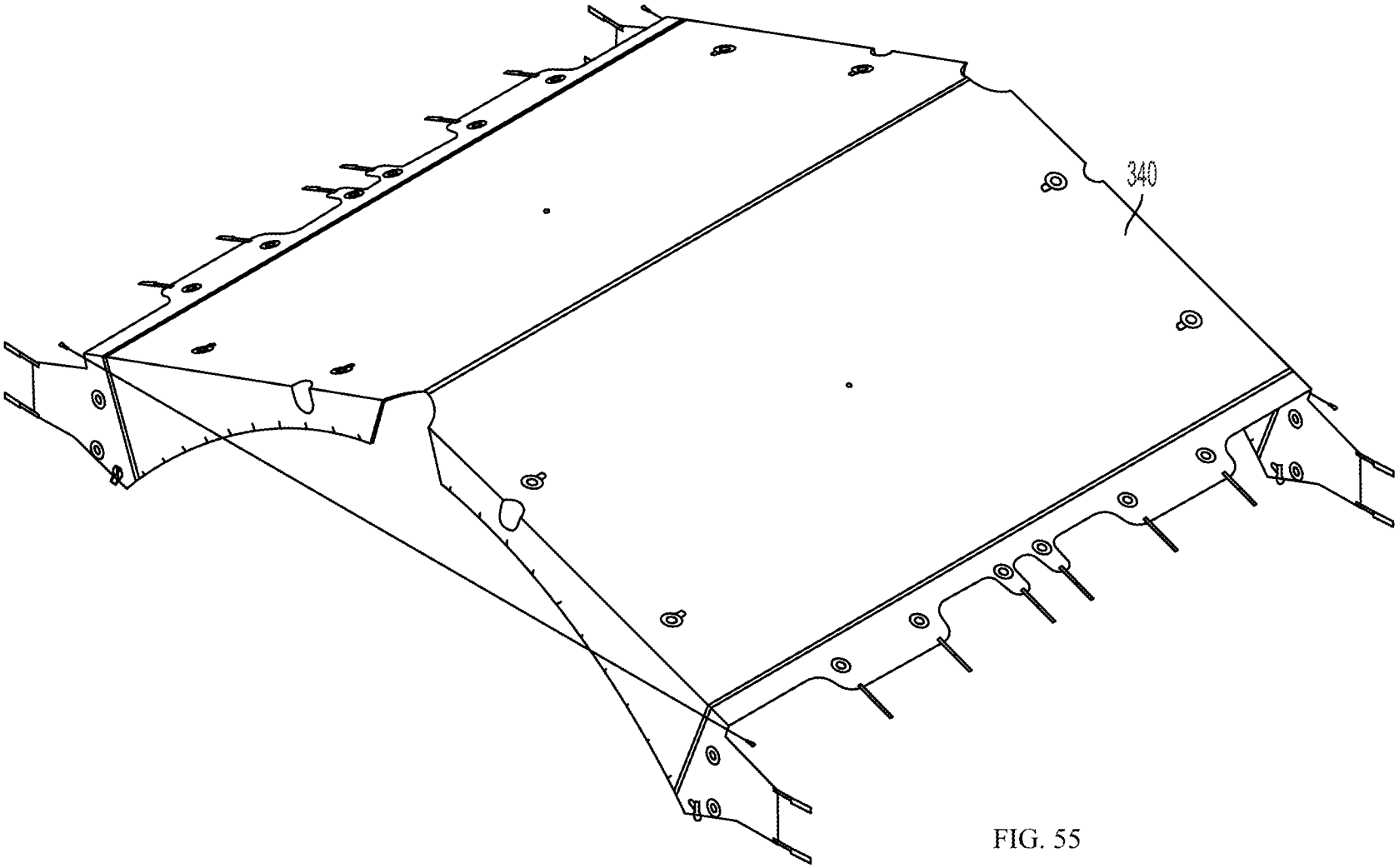
FIG. 55 is a perspective view of a shelter fly for the 2-module shelter as shown in FIG. 51.

FIG. 54 illustrates the assembled 2-module shelter 330 using one barrel section 334 between the endwall sections 332. The endwall sections 332 preferably have two soft doors 331, one on the end face and one on the sidewall section, each with a window panel and a window opening on each side of the door. The soft doors may be replaced with hard doors if required. The endwall sections 332 may incorporate two large sleeves 333 to accommodate external heating or air conditioning ducts. Two small sleeves 335 may also be incorporated to pass power and communication cables in and out of the shelter. Each barrel section 334 preferably also has two soft doors 331 which can remain sealed, used as windows, or as connections to other modules in the complex. An example of a shelter fly for the 2-module shelter is shown as 340 in FIG. 55.

Figure 56:
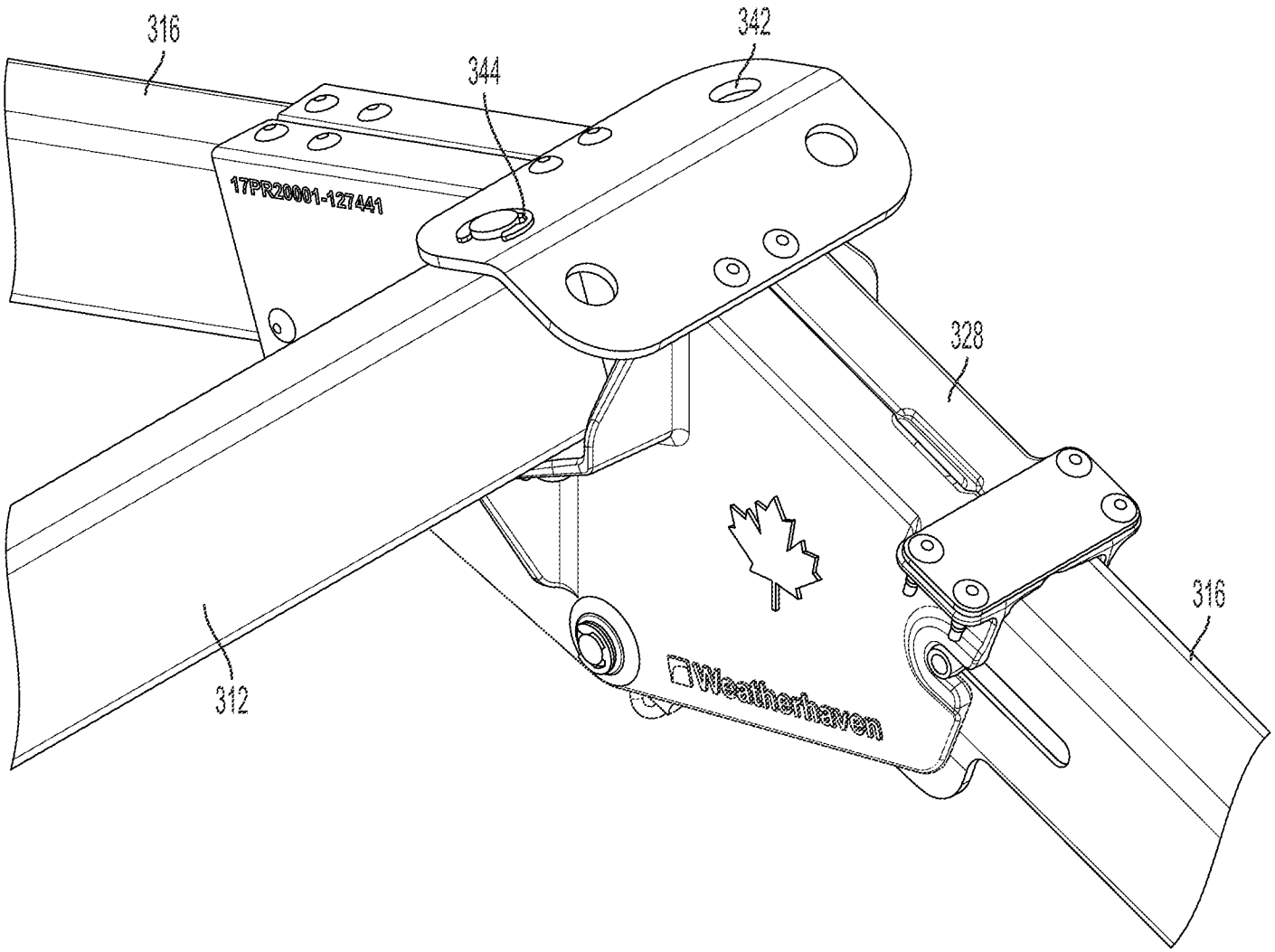
FIG. 56 is a detail perspective view of the peak bracket.
Figure 57:
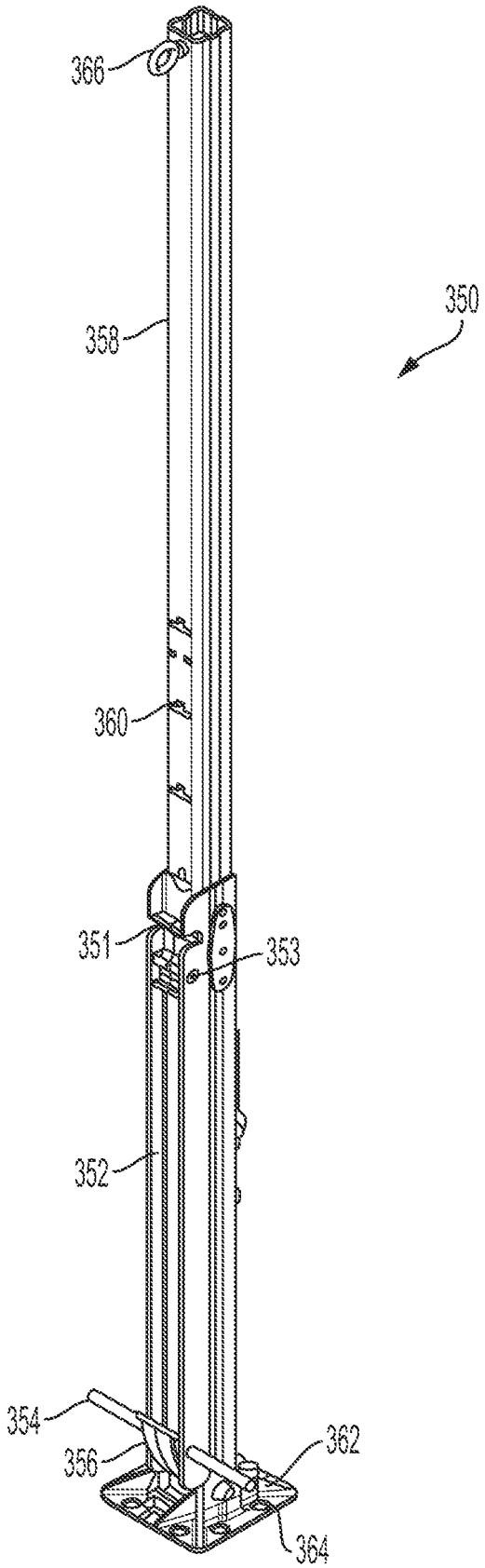
FIG. 57 is a perspective view of the leg element 350 in lowered position.
Figure 58:
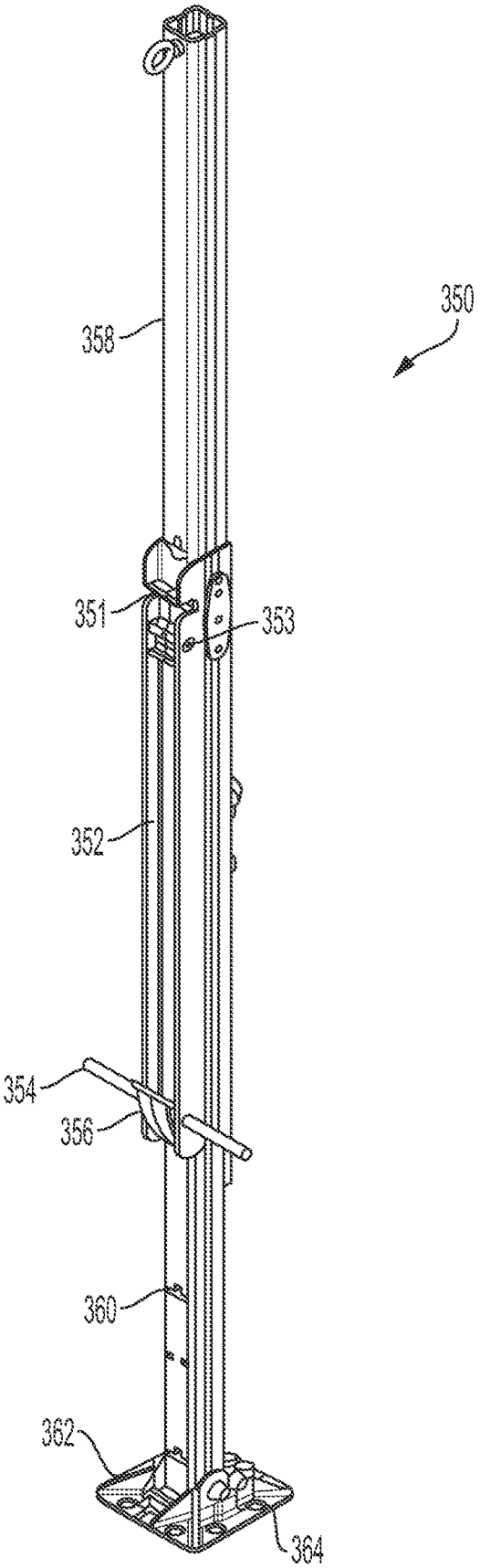
FIG. 58 is a perspective view of the leg element 350 in semi-raised position.
Figure 59:
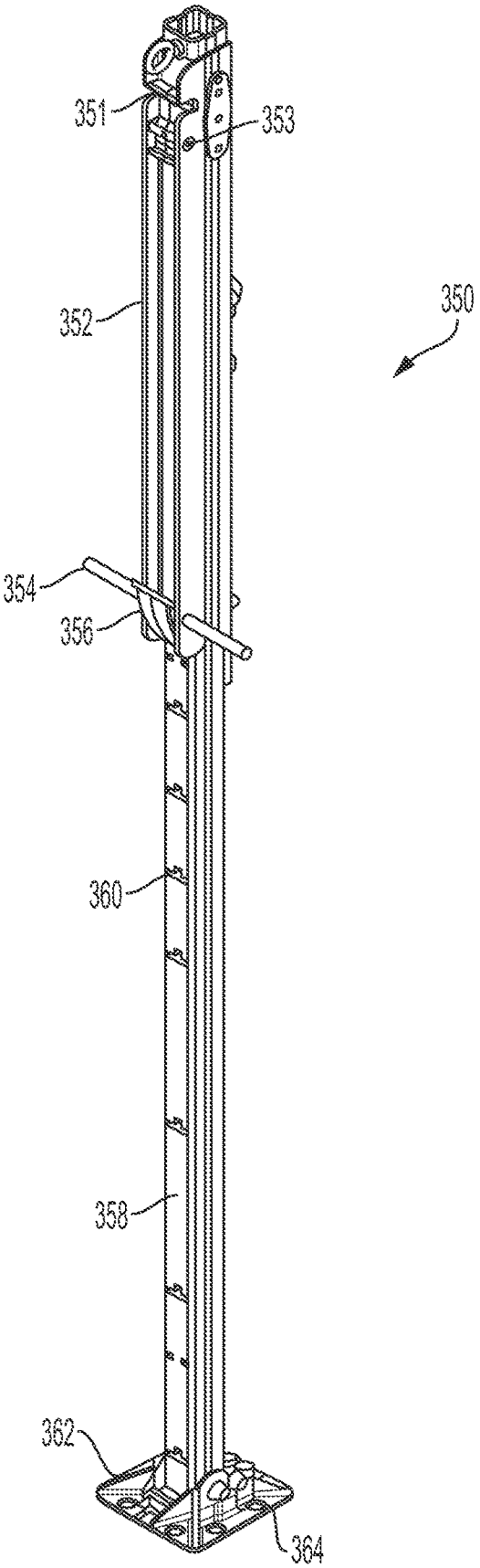
FIG. 59 is a perspective view of the leg element 350 in fully-raised position.
Figure 60:
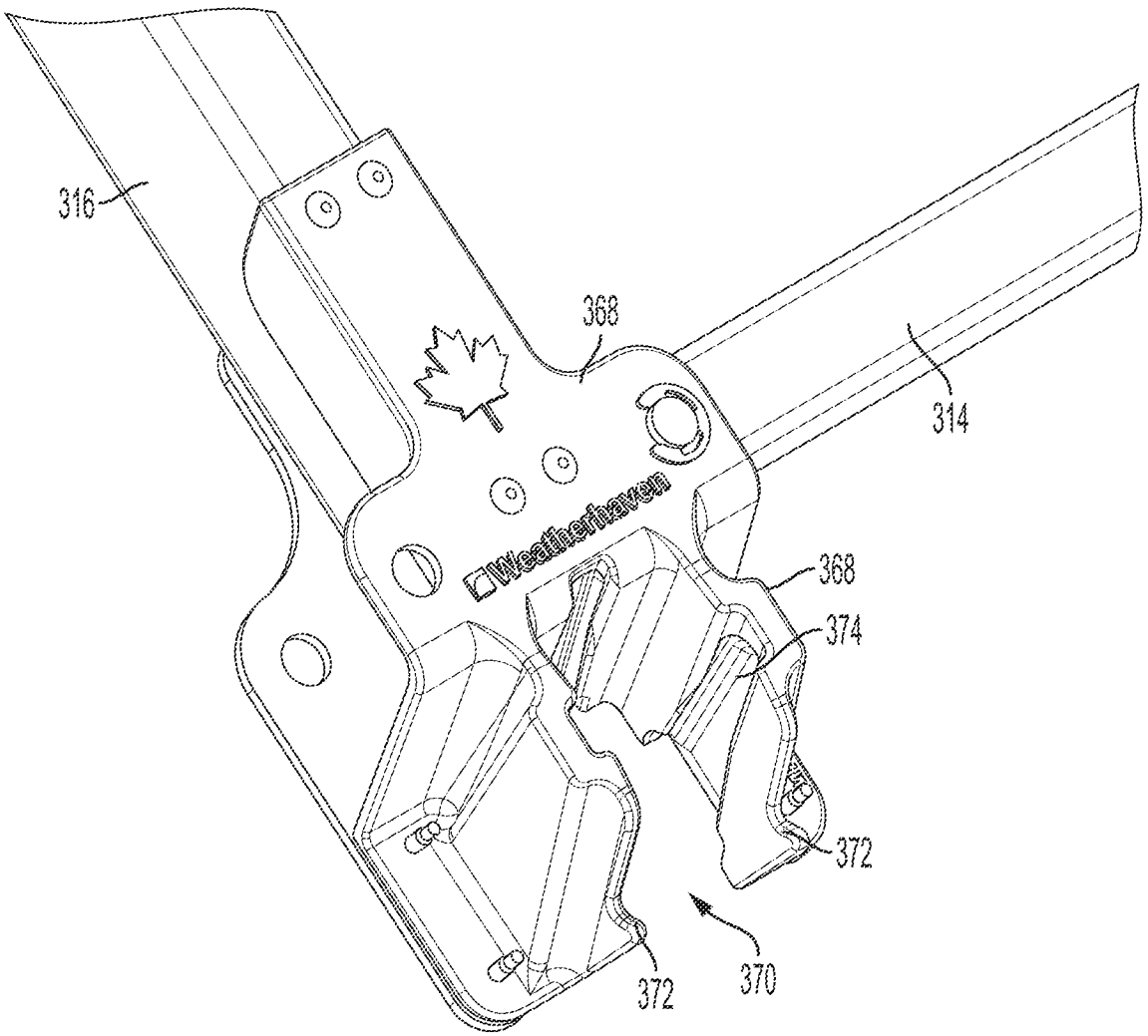
FIG. 60 is a detail perspective view of a frame leg socket at the end of an arch.
Figure 61:
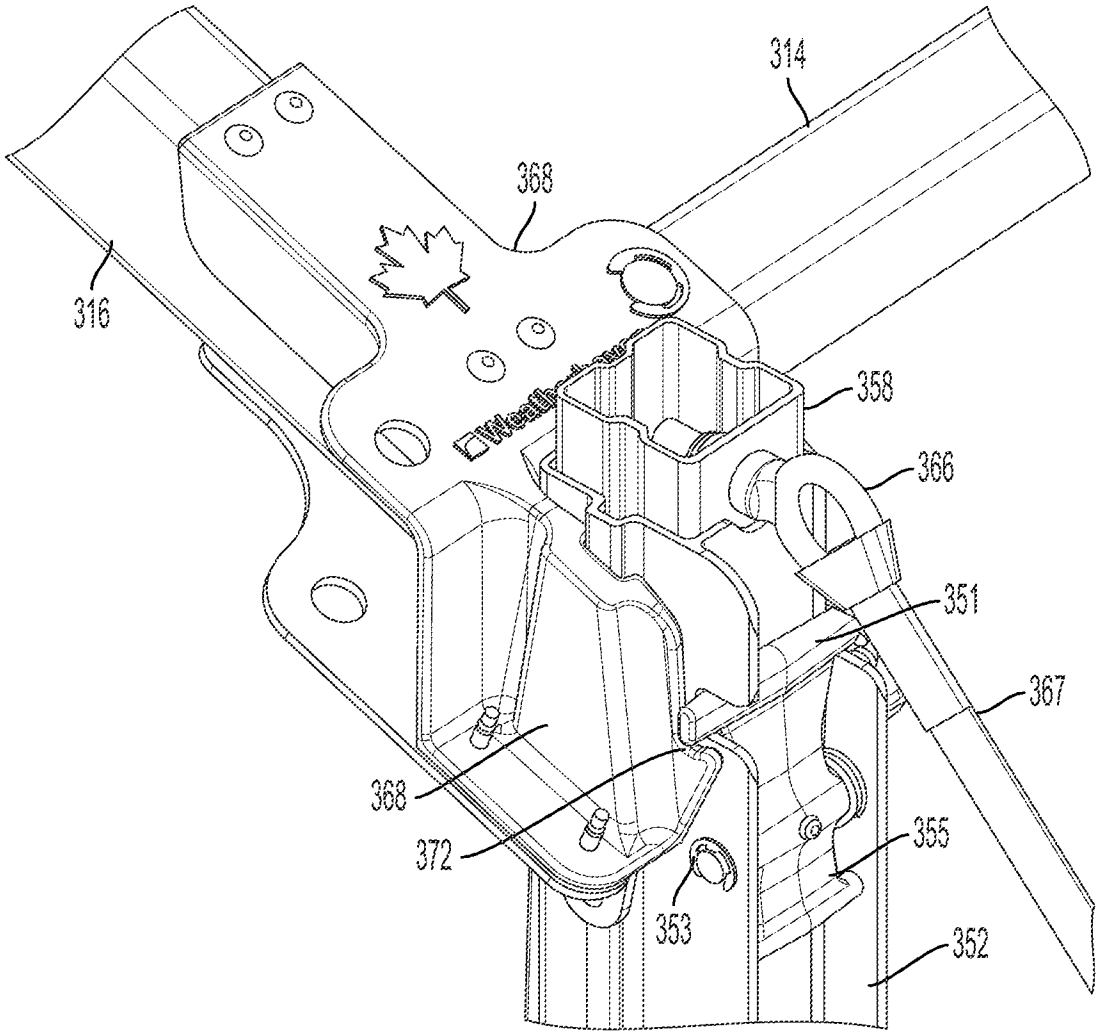
FIG. 61 is a detail perspective view of the frame leg socket shown in FIG. 60 with a leg element in place.

A detail perspective view of the peak bracket 328 is shown in FIG. 56. It receives the ends of ridge beams 312, of the 2-module shelter frame as shown or potentially of the extension frame for a 4-module shelter frame, and is provided with apertures 342 to accept ridge beams 312 and secure them by a hitch pin 344. FIGS. 57, 58 and 59 are perspective views of the leg element 350 in lowered, semi-raised and fully-raised positions respectively. Leg element 350 consists of outer sliding leg element 352 with lifting handle 354 and spring-loaded lift handle latch 356, inner leg element 358 having latch slots 360 mounted on base 362 having base apertures 364. Upper supporting horizontal leg latch bar 351 forms the upper end of a T-shaped spring loaded lever 355 which rotates about axis 353 to facilitate removal of the legs 350 from frame leg socket 368. As outer sliding leg element 352 is slid up the inner leg element 358, lift handle latch 356 slides out of the prior latch slot 360 and is then biased into the next higher latch slot 360 where it secures the leg element 352 until it is again moved upwardly. FIG. 60 is a detail perspective view of the frame leg socket 368 on arch 316. It has open front face 370 to receive the leg 350, so that bar latch 351 engages socket latch flanges 372 as shown in FIG. 61. The outer surface of sliding leg element 352 engages the tapered inner surface 374 of frame leg socket 368 so that arch bracket 368 and attached frame 310 is firmly supported on the sliding leg element 352. In FIG. 61 the sliding leg element 352 has been slid upwardly to the fully raised position on inner leg element 358. An eye bolt 366 can be bolted to the upper edge of inner leg element 358 with an attached ratchet strap 367 to secure the frame corners to a stake.

Figure 62B:
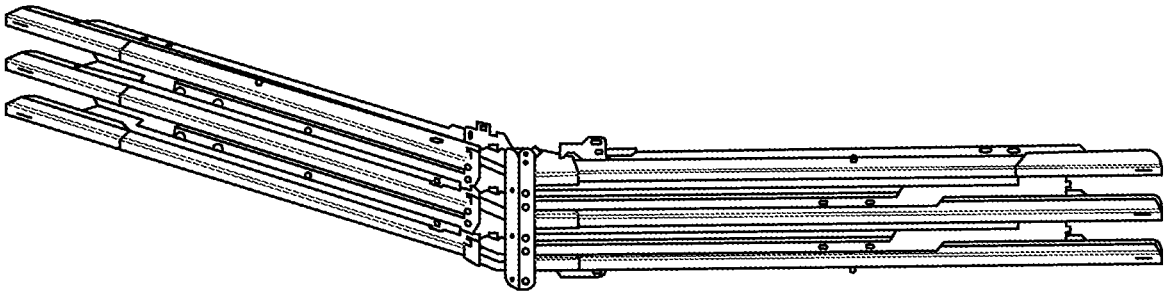
Figure 62C:
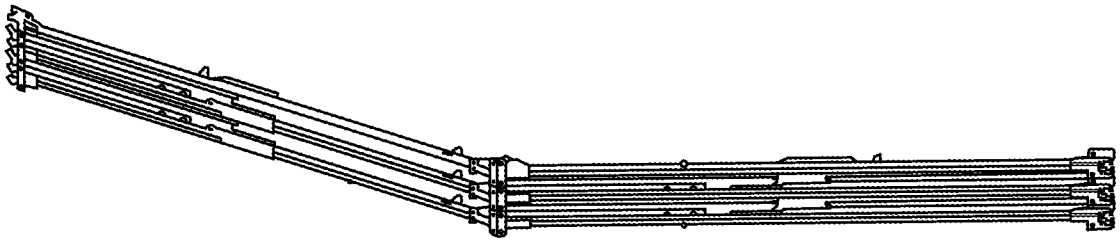
Figure 62D:
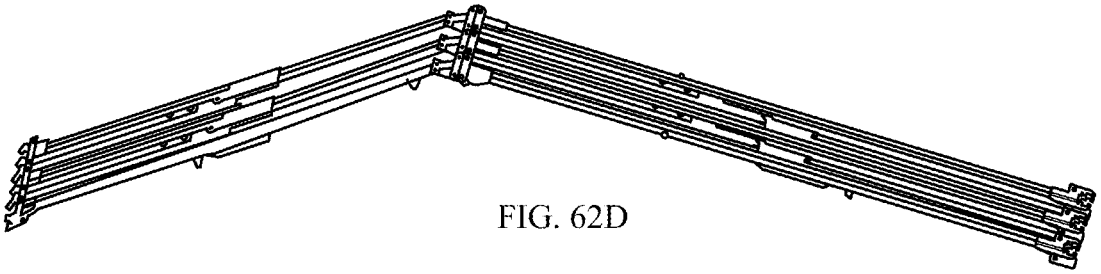
Figure 62E:
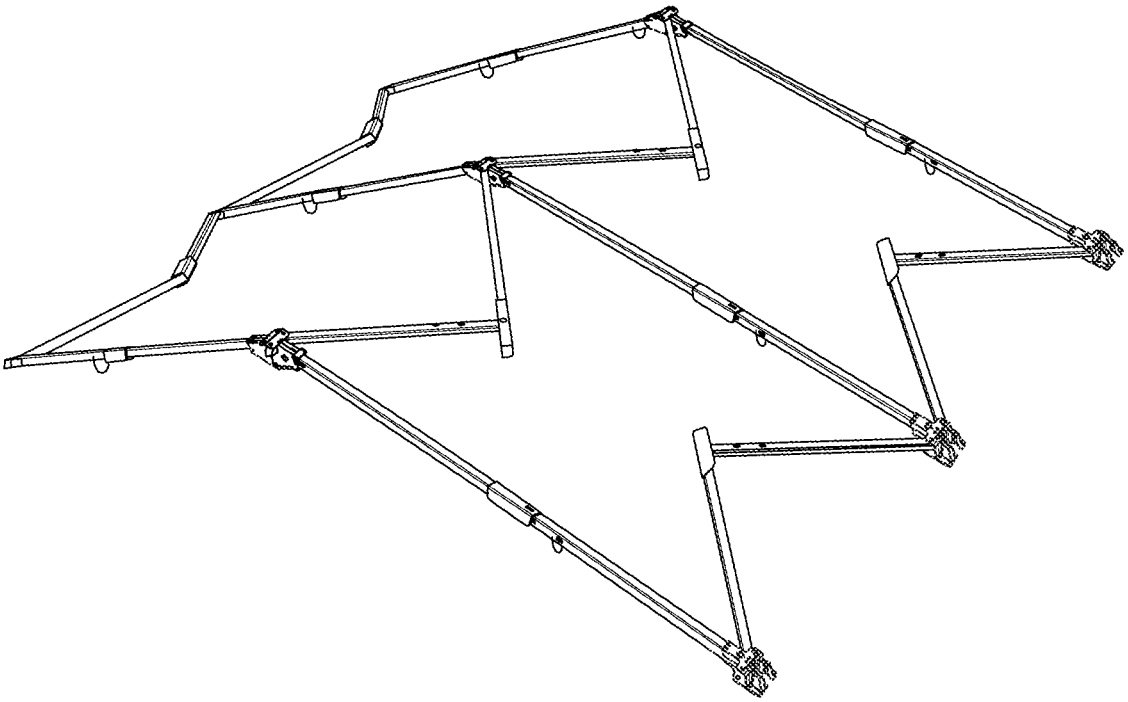
Figure 62F:
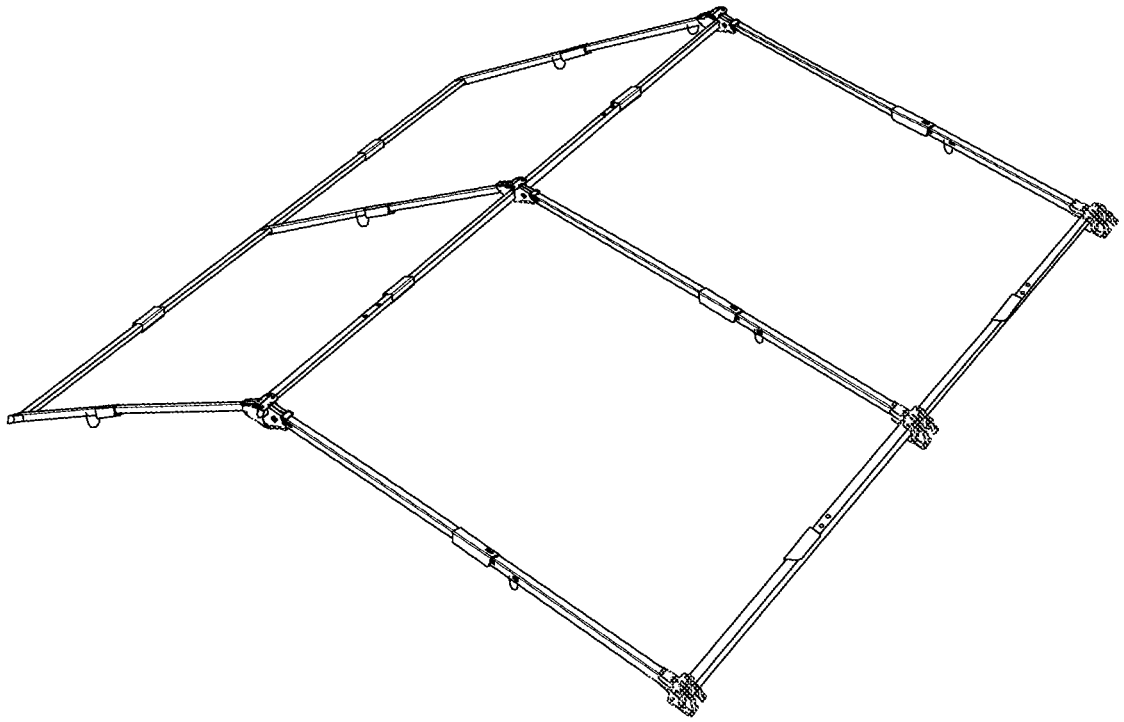

The following describes the assembly process for the 2-module shelter. The assembly process is essentially the same for all of the shelters, the difference being that the Vestibule, 4-Door Hub, and Vehicle Interface shelter use specific one-piece covers, and the 1-module, 2-module, and 4-module shelters use two endwall sections 332 and 0, 1 or 2 barrel sections 334. Initially the shelter fabric sections are laid out on the ground in their intended locations and joined by aligning the zipper starting points in the middle at the roof peak, and closing the zippers a short distance. The folded roof frame (FIG. 62A) is then deployed before proceeding with joining the remainder of the fabric. The frame is unfolded on the ground adjacent to one end of the laid-out shelter fabric to allow it to be expanded out over the fabric (FIG. 62B). With the frame lying on one side, the arches are unfolded at the roof peak hinges to their full length at the centre hinges so the arch hinges lock securely (FIG. 62C). The unfolded frame is stood on the eave beam ends as shown in FIG. 62D. The arches are pulled apart as in FIG. 62E, unfolding the beam sections so the beam hinges lock securely as shown in FIG. 62F. Arch cables are secured between the lower ends of the arches and roof fabric is partially secured to the roof beams by connecting cables from the tent roof to the ends of the respective arches by engaging cable hooks in slots on the underside of the arches where they join the eave beam 14 (not shown). The tent fabric is secured by roof attachment straps to roof beam D-rings (not shown).

Figure 8:
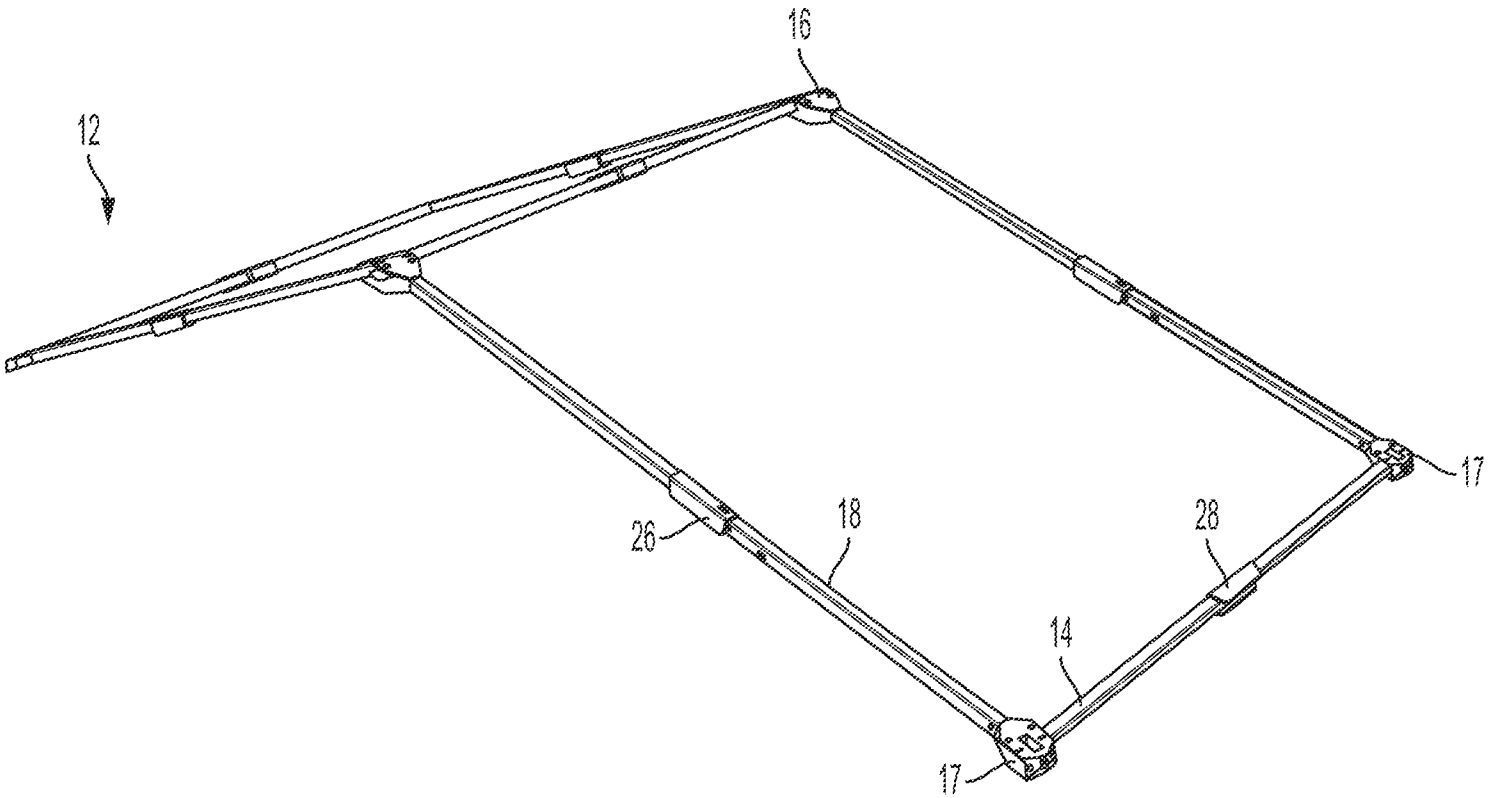
FIG. 8 is a perspective view of the upper folding assembly for the frame as shown in FIG. 2, standing upright completely unfolded.
Figure 63A:
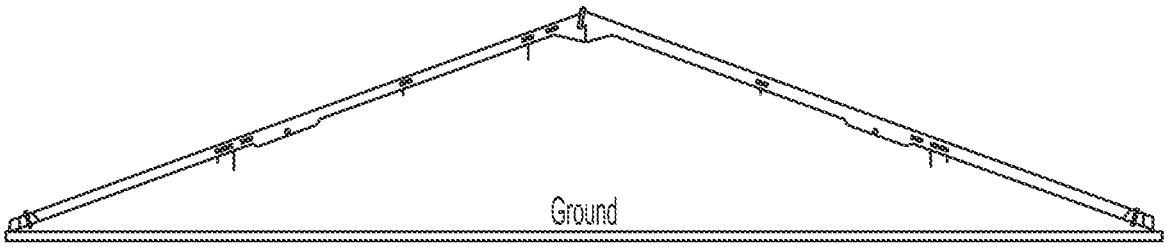
FIG. 63A-G is a series of schematic drawings illustrating the steps in raising of the tent frame for the 2-module shelter.
Figure 63B:
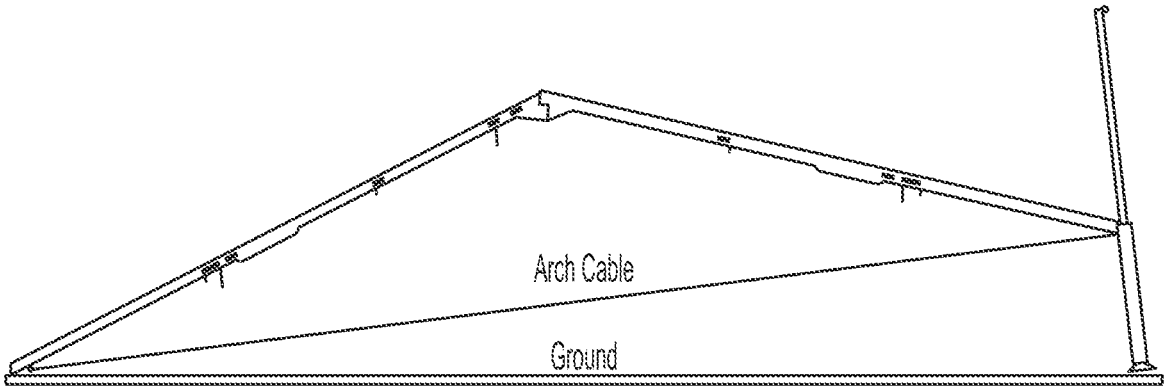
Figure 63C:
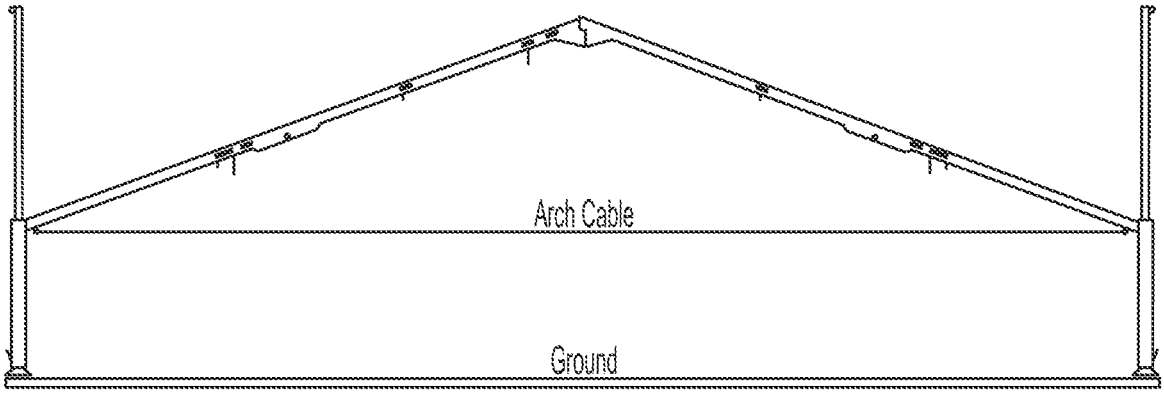
Figure 63D:
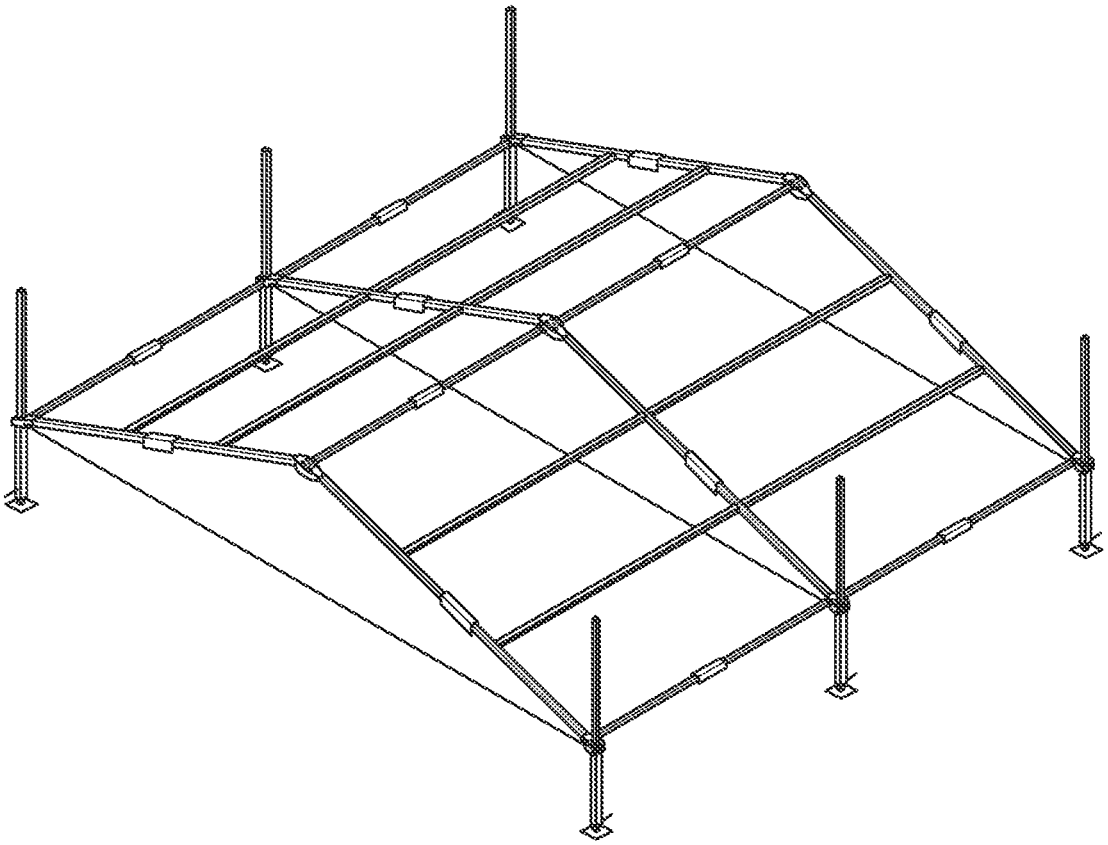
Figure 63E:
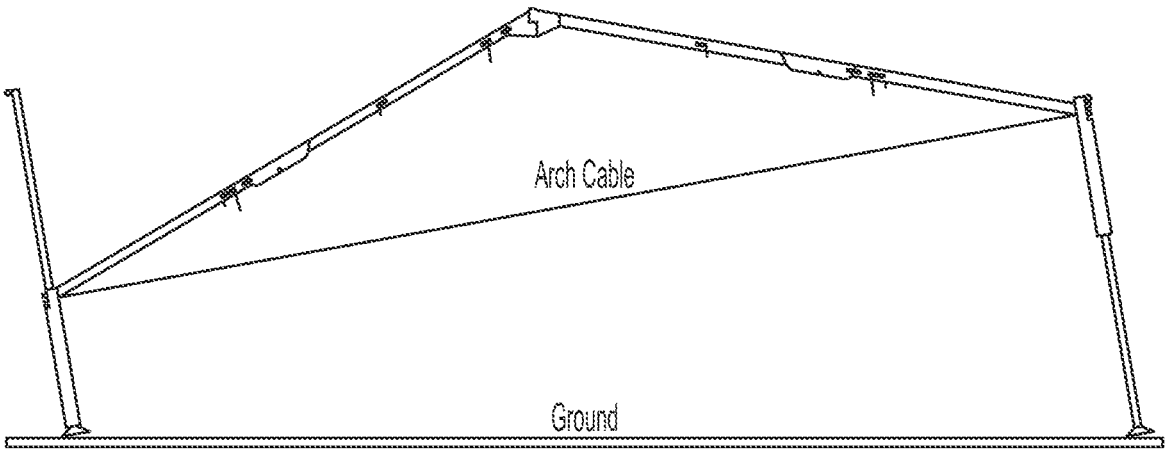
Figure 63F:
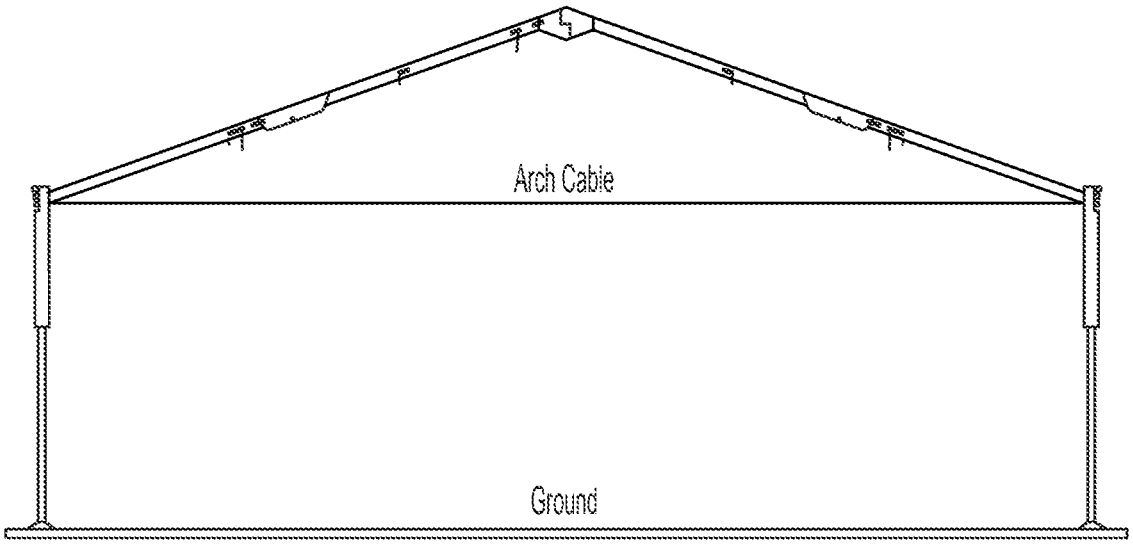
Figure 63G:
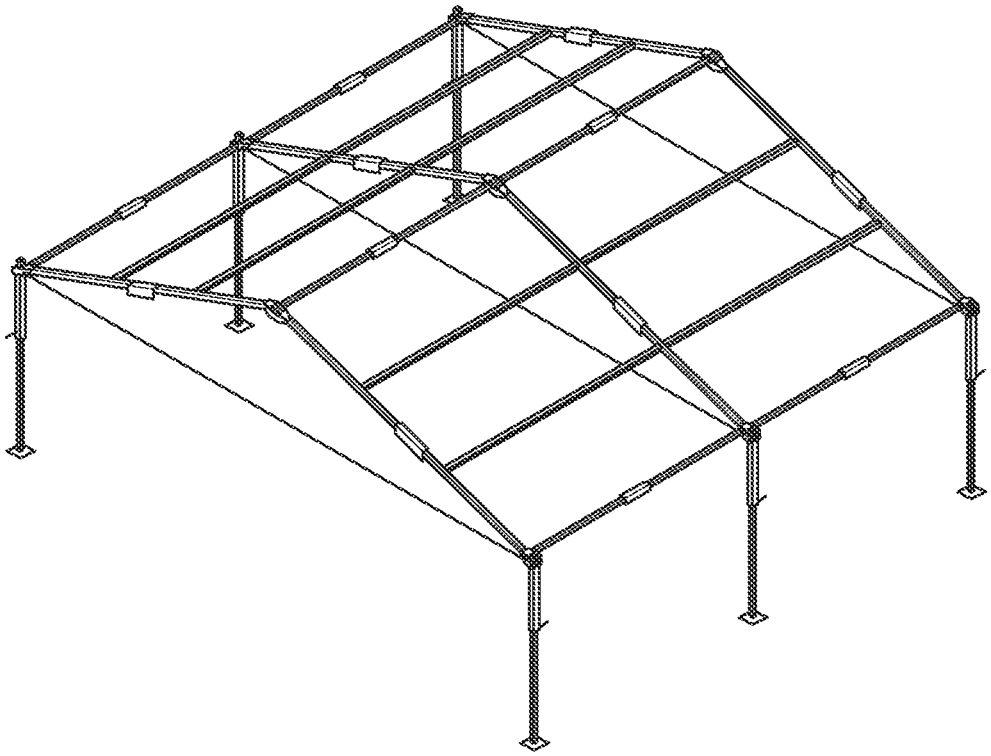

With reference to FIGS. 52 and 62F, 8 modular purlins 322 are then installed between arches 316. The ends of each purlin may have a T-shaped head to slide into securement slots in the sides of arches 316. The roof fabric is then further secured to the frame arches 316 and purlins 322, and fly 340 is centered over the frame 301. The raising of the frame 301 is illustrated in FIG. 63A-G. The frame with attached fabric is positioned on the ground as shown in FIG. 63A. The first side of the frame is lifted and the collapsed legs 350 inserted into the frame arch brackets 368 (FIG. 63B) so that upper latch 351 is positioned in socket latch flanges 372. The second side of the frame is lifted and the collapsed legs 350 similarly inserted into the frame arch brackets 368 on the second side of the frame (FIG. 63C). The frame 301 is now supported off the ground with the shelter fabric suspended below as shown in FIG. 63D. The bases 362 of the legs 350 can be secured to the ground at each stage of the setup as required using takes through apertures 364 of each base. Using the handles 354 on the legs 350 the frame is lifted further, ensuring the latches 356 fully engage the leg tube slots 360 (FIG. 63E). The shelter may be raised incrementally, one side at a time, or fully, both sides at once, depending on the number of personnel available to lift, to the position shown in FIGS. 63F and G. Insulation and sun shades may be installed as described in the previous embodiment.

FIG. 64 to FIG. 68 illustrate a purlin connection assembly 400 according to an embodiment of the invention. Purlin connection assembly 400 permits easy, rapid and secure locking attachment and detachment between a purlin and a frame segment. In some embodiments a frame segment may be, or may be part of, a chord (e.g. chord 18), a midspan chord (e.g. midspan chord 24) or an arch (e.g. arch 316), as described herein. In some embodiments a purlin may be a purlin section (3.g. purlin section 69, 62) as described herein.

Purlin connection assembly 400 includes a purlin 401, frame segment 403 and a spring 410. Purlin 401 is shown in the illustrated embodiment as attaching to a sidewall of frame segment 403. In other embodiments purlin 401 may attach to a bottom wall or top wall of frame segment 403.

Purlin 401 has an end face 415 with a protrusion 402 projecting therefrom. In the illustrated embodiment protrusion 402 projects from an approximate middle of end face 415. In other embodiments protrusion 402 may be higher or lower along the vertical extent of end face 415. Protrusion 402 has a neck 417 connected to end face 415, and a flared head 419 at the other end. In some embodiments flared head 419 and neck 417 of protrusion 402 may have a T-shaped cross-section.

Neck 417 has a height 418 and flared head 419 has a height 416 greater than height 418 of neck 417. Length 430 of neck 417 is greater than the thickness of the wall of frame segment 403 to which purlin 401 attaches. Purlin 401 has a width 427. Protrusion 419 has a width 432. Width 432 of protrusion 419 may the same as or less than width 427 of purlin 401 in some embodiments.

Frame segment 403 has a laterally extending slot 404 for receiving purlin 401. Slot 404 includes a first end 405 and a second end 406. First end 405 is larger than second end 406 and a taper section 428 may be disposed therebetween. In particular, first end 405 has a height 423 that greater than a height 425 of second end 406. Height 423 of first end 405 is also greater than height 416 of flared had 419 of protrusion 402 so that protrusion 402 can be inserted through first end 405. Height 425 of second end 406 is greater than height 418 of neck 417 of protrusion 402 but less than height 418 of flared head 419 of protrusion 402 so that protrusion 402 can be lockingly engaged in second end 406 as explained in greater detail herein. First end 405 has a width 422 at least as wide as width 432 of protrusion 419. Similarly, second end 406 has a width 424 at least as wide as width 432 of protrusion 419. Slot 404 accordingly has a width 426 at least twice width 432 of protrusion 419.

Frame segment 403 also has button holes 407A and 407B. Button hole 407A is located above first end 405. In other embodiments button hole 407A may be located below first end 405. Button holes 407A and 407B are separated by a distance 421. Distance 421 is greater than width 427 of purlin 402.

Figure 66A:
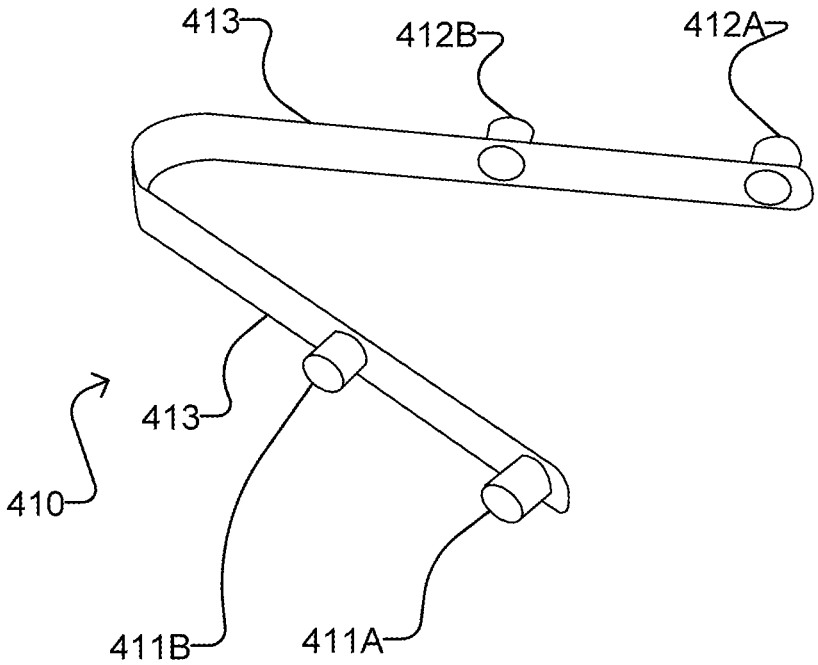
FIG. 66A is a view of a spring of the purlin connection assembly of FIG. 64, wherein the spring is in its untensioned state.
Figure 66B:
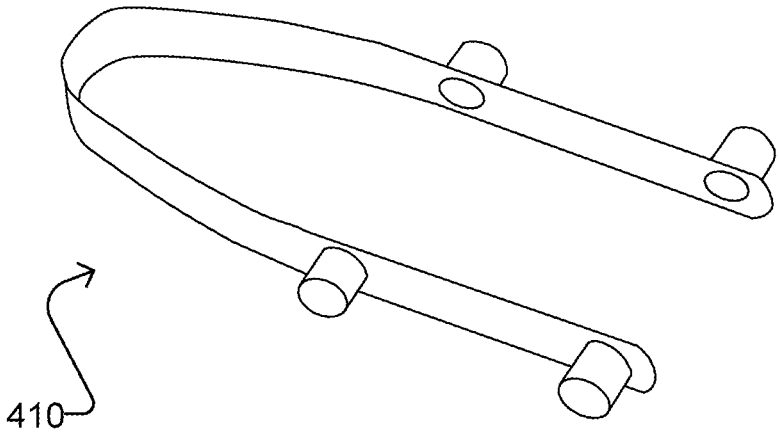
FIG. 66B is a view of the spring of FIG. 66A, wherein the spring is in its tensioned state.

FIGS. 66A and 66B depict spring 410. Spring 410 can be made of an elastic material such as sheet metal. Spring 410 is installed in an interior 409 of frame segment 403. In FIG. 66A, spring 410 is shown in its uncompressed state. Spring 410 has arms 413 with a first button 411A and a second button 411BA. The illustrated embodiment shows spring 410 with a pair of buttons (411A and 411B, and 412A and 412B) on each arm 413, however other embodiments may have buttons on only one arm of the spring. Also in other embodiments the spring may be other than a V-shape so long as the spring buttons are outwardly biased, and a means is provided between the first button and the second button that allows depressing of the second button to cause the first button to simultaneously retracts inward. In the illustrated embodiment, the rigid connection between first button 411A and second button 411B results in the retraction of first button 411A when second button 411B is depressed.

FIG. 66B depicts spring 410 in its compressed state. Spring 410 is in its compressed state when installed in interior 409 of frame segment 403. As shown for example in FIG. 64, buttons 411A and 411B due to their outward bias project outwardly through respective button holes 407A and 407B of frame segment 403.

Figure 64:
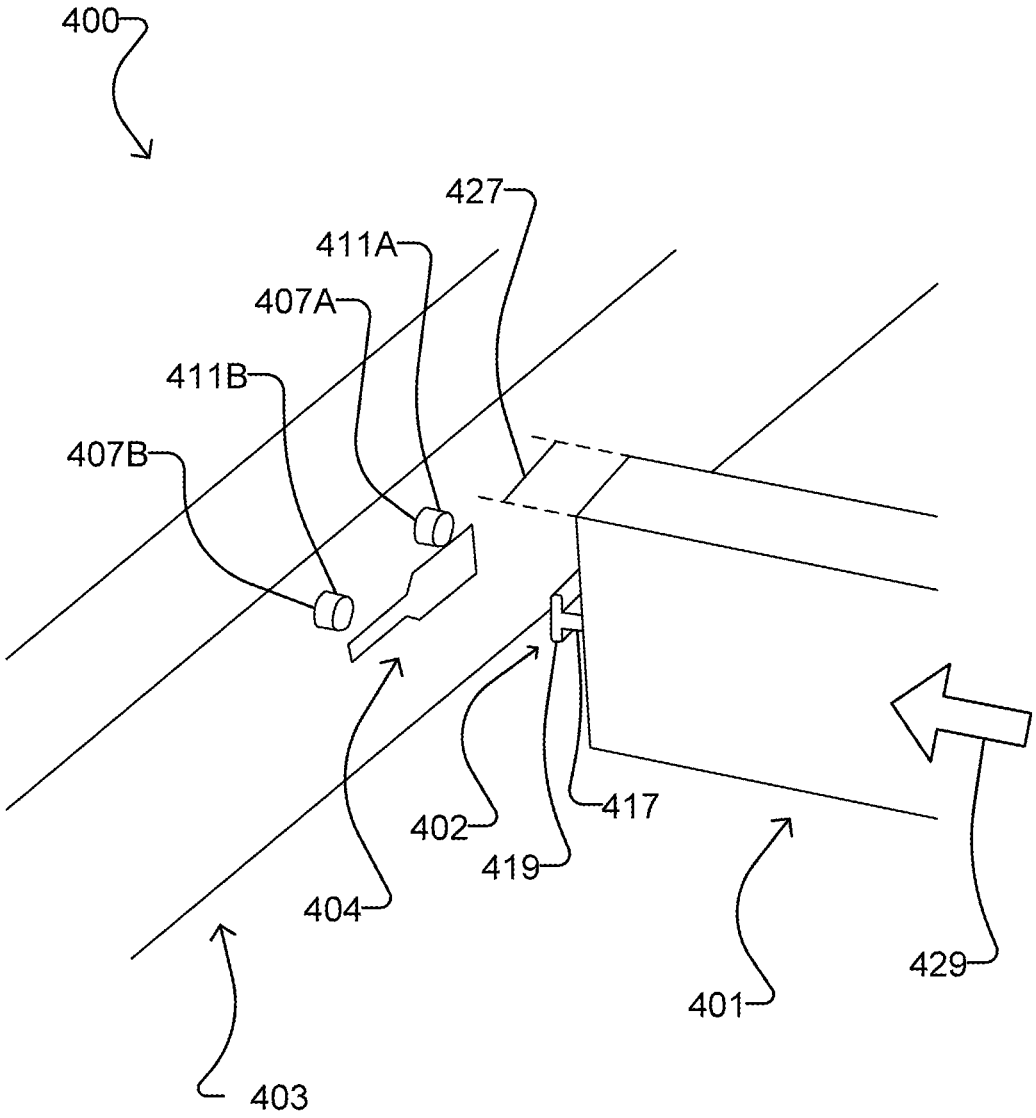
FIG. 64 is a partial view of a purlin connection assembly according to an embodiment of the invention, before insertion of a purlin into a frame segment.
Figure 65A:
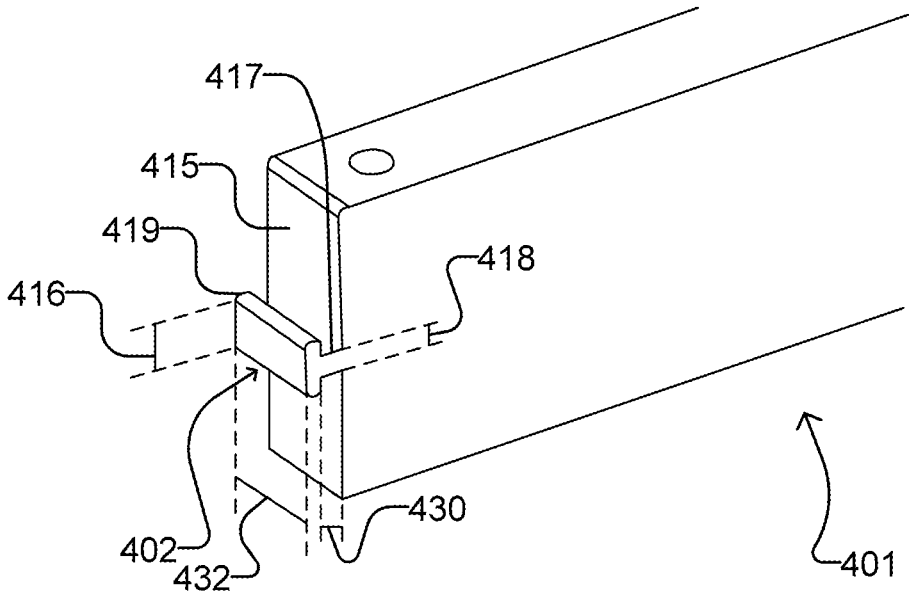
FIG. 65A is a partial view of the purlin of the purlin connection assembly of FIG. 64.
Figure 65B:
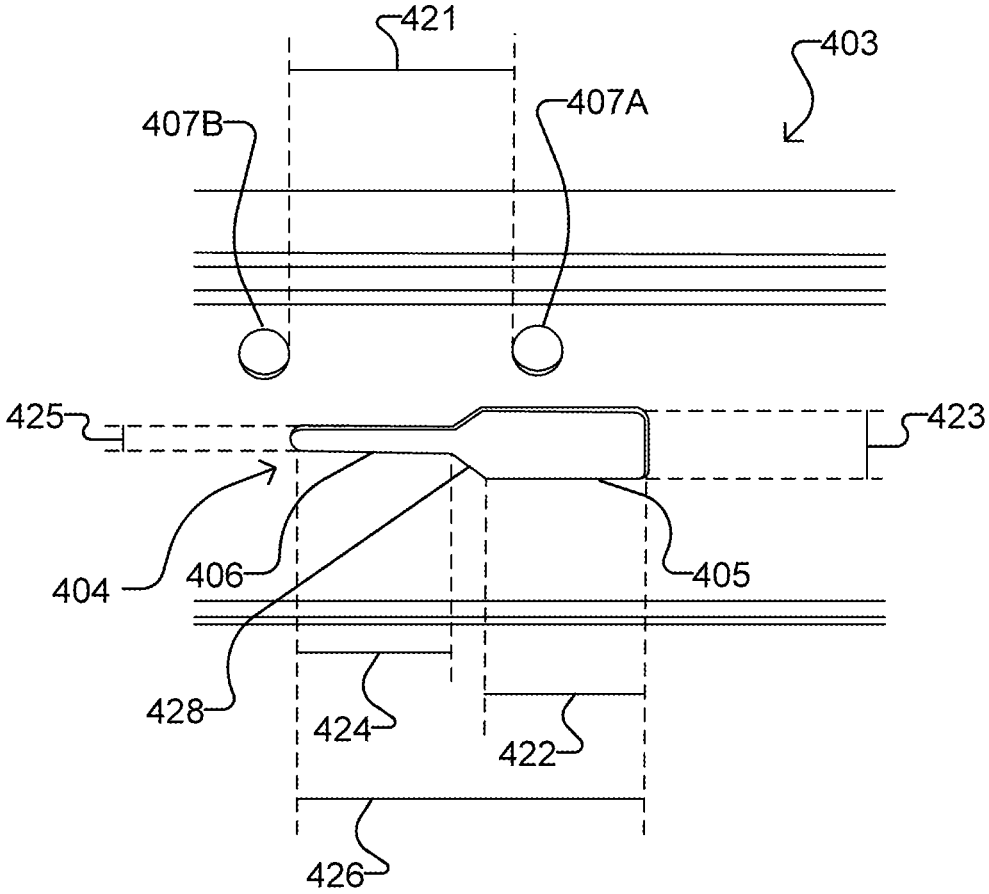
FIG. 65B is a partial view of the frame segment of the purlin connection assembly of FIG. 64.
Figure 67:
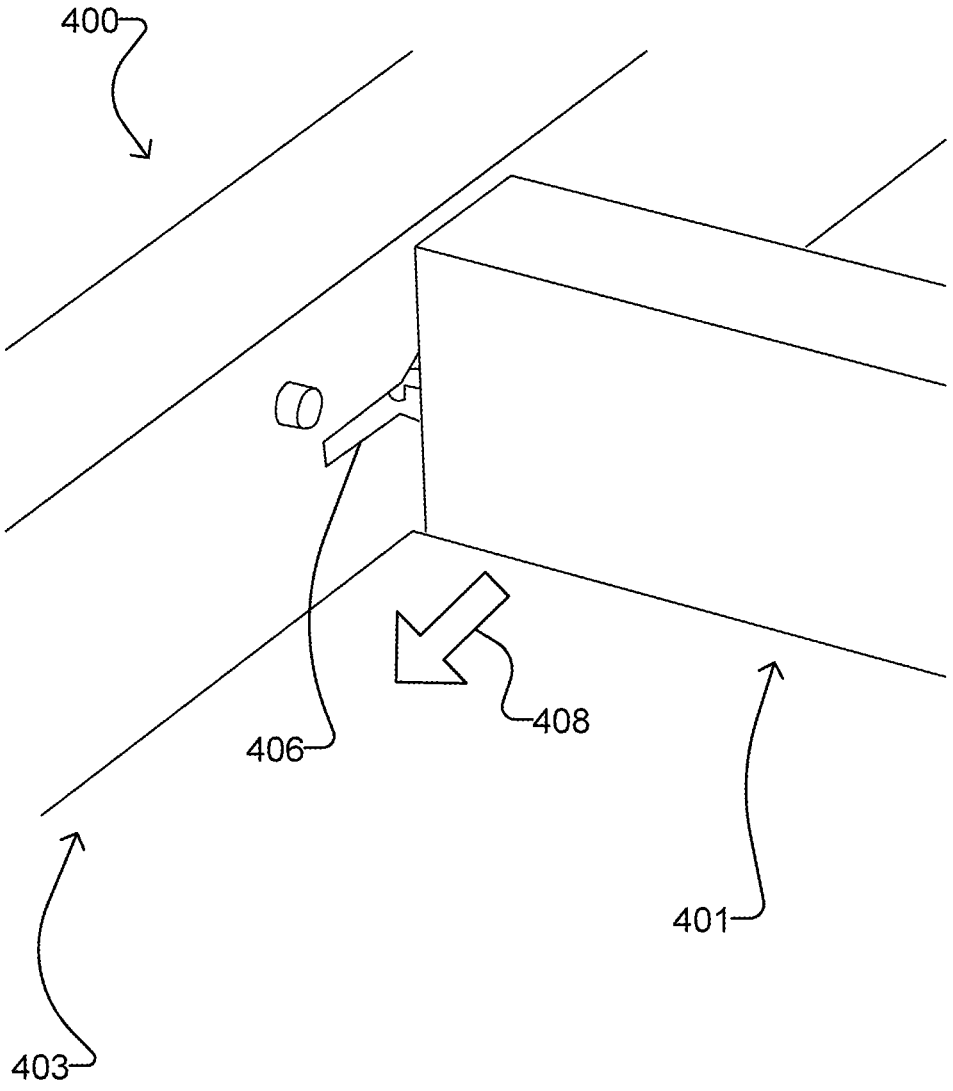
FIG. 67 is a partial view of the purlin connection assembly of FIG. 64 in an initially engaged position.

FIGS. 64, 67 and 68 depict the connection and detachment process of purlin connection assembly 400.

With reference to FIG. 64, purlin 401 is directed towards frame segment 403 in direction 429 such that protrusion 402 engages first end 405 of slot 404. Spring 410 is pre-installed within frame segment 403 in its compressed state, with spring buttons 411A and 411B protruding from frame segment 403 through button holes 407A and 407B.

FIG. 67 depicts purlin 401 pressed against frame segment 403. In FIG. 67, protrusion 402 extends through first end 405 of slot 404, allowing end face 415 of purlin 402 to depress second button 411A inwardly into frame segment 403, so that purlin 401 abuts against the wall of frame segment 403. Purlin 401 can then be slid in direction 408 to lock purlin 401 and frame segment 403 together.

Figure 68A:
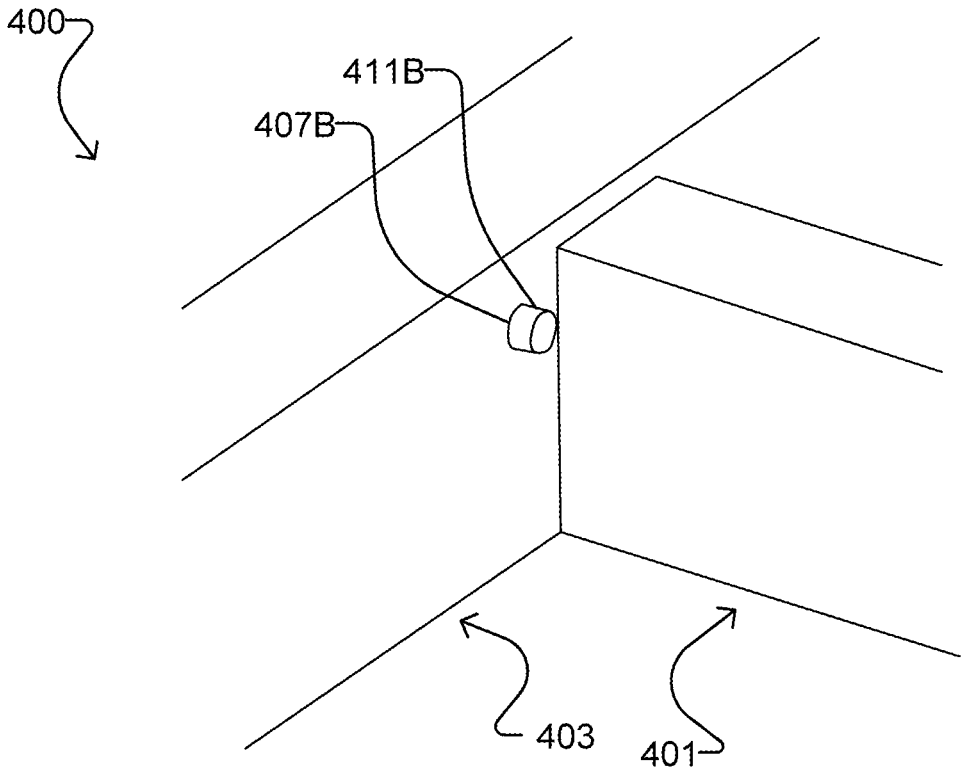
FIG. 68A-C is a partial side view, partial top view, and partial cross sectional top view, respectively, of the purlin connection assembly of FIG. 64 in a locked position.
Figure 68B:
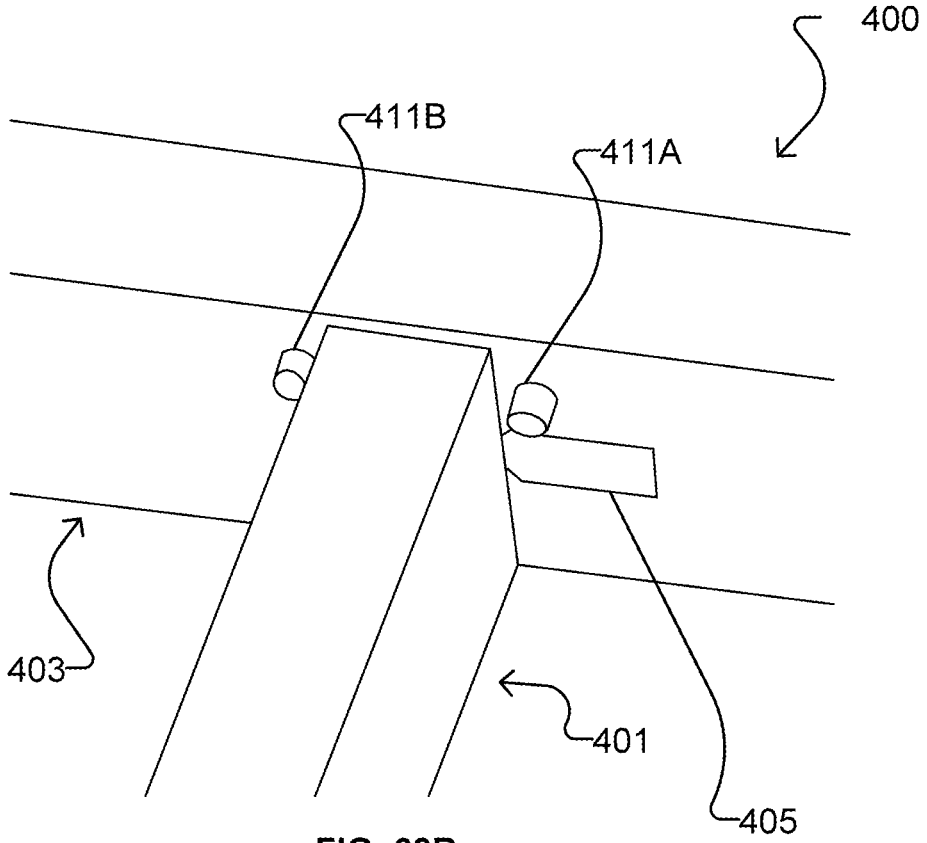
Figure 68C:
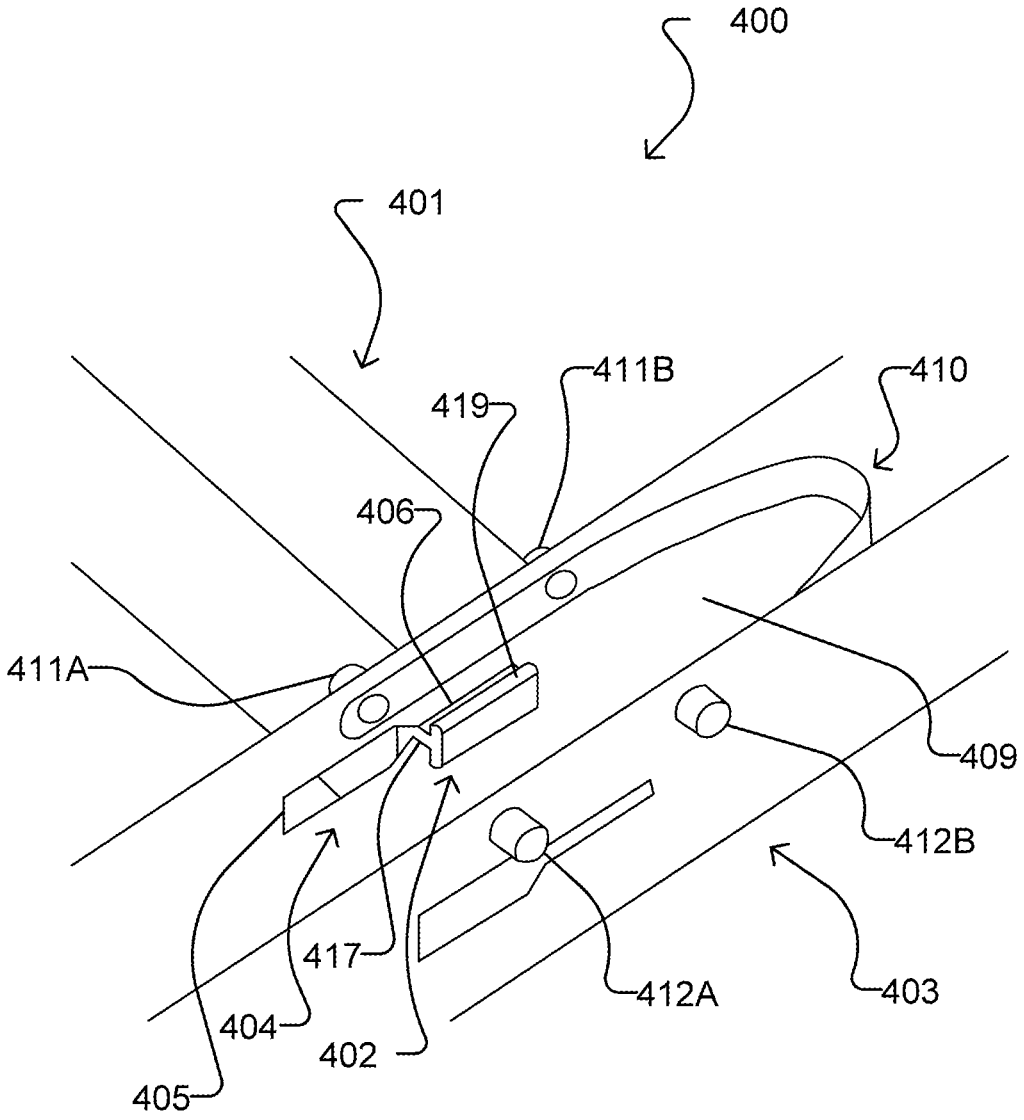

FIG. 68A to 68C depict purlin 401 in a locked position. When purlin 401 is moved in direction 408 (as shown in FIG. 67), end face 415 of purlin 401 no longer contacts first button 411A, allowing first button 411A to protrude again from frame segment 403 as shown in FIGS. 68B and 68C. The protrusion of first button 411A after sliding purlin 401 in direction 408 prevents purlin 401 from moving back in a direction opposite to direction 408. First button 411A and second button 411B thus flank purlin 401, providing lateral locking of purlin 401 to frame segment 403.

FIG. 68C is a cross sectional view of purlin 401 and frame segment 403 in the locked position. FIG. 68C depicts protrusion 402 locked within second end 406 of slot 404. Flared head 419 of protrusion 402 secures purlin 401 in the direction perpendicular to frame segment 403, that is, purlin 401 cannot be pulled out of slot 404 while positioned at second end 406 because height 420 of flared head 419 is greater than height 425 of second end 406. Again, buttons 411A and 411B secure purlin 401 in the direction parallel to frame segment 403.

To unlock and detach purlin 401, second button 411B is depressed into frame segment 403. Depressing second button 411B causes first button 411A to retract into frame segment 403, as buttons 411A and 412A are rigidly connected by spring 410. As first button 411A retracts, purlin 401 can be slid into first end 405 of slot 404. Sliding purlin 401 into first end 405 of slot 404 allows protrusion 402 to be released from slot 404, since height 423 of first end 405 is greater than height 420 of flared head 419, allowing purlin 401 to be detached from frame segment 403.

Also shown in FIG. 68C, on the other side of where purlin 401 attaches, is a second slot similar to slot 404, and buttons 412A and 4128 projecting from button holes similar to button holes 407A and 407B. A second purlin (not shown) can attach and detach to this other side in a similar manner to that described above. In some embodiments, these feature may be absent on this other side and spring 410 may only have buttons on one side.

While a number of exemplary aspects and embodiments have been discussed above, those of skill in the art will recognize certain modifications, permutations, additions and sub combinations thereof. It is therefore intended that the invention be interpreted to include all such modifications, permutations, additions and sub combinations as are within their true spirit and scope.

The invention claimed is:

1. A purlin connection assembly comprising:

a purlin comprising a protrusion, the protrusion comprising a neck and a flared head;

a frame segment comprising an interior, a slot comprising a first end and a second end, wherein a height of the first end is at least as great as a height of the flared head, and wherein a height of the second end is less than the height of the flared head and at least as great as a height of the neck;

a first button hole and a second button hole, the first button hole vertically aligned with the first end, a distance separating the first button hole and the second button hole being greater than a width of the purlin; and a spring comprising a first button and a second button, the spring compressingly disposed in the interior of the frame segment, wherein the first button and the second button are biased to extend outwardly through the first button hole and the second button respectively to project out of the frame segment, and wherein the first button and the second button are rigidly connected whereby depressing the second button effects inward retraction of the first button.

2. The assembly of claim 1 wherein the spring comprises a V-shape with two arms wherein the second button is located relatively proximal along the arm and the first button is located relatively distal along the arm.

3. The assembly of claim 2 wherein, on an opposite side of the frame segment for attachment of a second purlin, the frame segment comprises a corresponding second slot and third and fourth button holes, and the spring comprises corresponding third and fourth buttons.

4. The assembly of claim 1 wherein the first end narrowingly tapers to the second end.

5. The assembly of claim 1 wherein a width of the slot is at least twice the width of the protrusion.

6. The assembly of claim 1 wherein the flared head and the neck of the protrusion form a T-shaped cross-section.

7. A method of connecting and disconnecting a purlin and a frame segment, the method comprising:

a. providing a purlin connection assembly according to claim 1;

b. to attach the purlin to the frame segment:

i. directing the protrusion of the purlin through the first end of the slot of the frame segment, whereby an end face of the purlin abuts and depresses the first button of the spring;

ii. sliding the purlin laterally to engage the protrusion with the second end of the slot, whereby the first button is released and reverts to outward protrusion from the first button hole of the frame segment, whereby the purlin is locked in a direction parallel to the frame segment by the first and second buttons, and locked in a direction perpendicular to the frame segment by the flared head being constrained in the interior of the frame segment by the second end of the frame segment;

c. to detach the purlin from the frame segment;

i. depressing the second button to cause the first button to retract from the first button hole;

ii. sliding the purlin laterally from the second end to the first end; and iii. pulling the purlin away from the frame segment.

* * * * *